US009173500B2

(12) United States Patent
Squires et al.

(10) Patent No.: US 9,173,500 B2
(45) **Date of Patent: *Nov. 3, 2015**

(54) VENTILATED CHAIR ASSEMBLY

(71) Applicant: TRAVELING BREEZE LEISURE PRODUCTS LLC, O'Fallon, MO (US)

(72) Inventors: Gregory Alan Squires, St. Peters, MO (US); Steven Lee Garner, O'Fallon, MO (US)

(73) Assignee: Traveling Breeze Leisure Products LLC, O'Fallon, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/268,797

(22) Filed: May 2, 2014

(65) Prior Publication Data

US 2014/0368003 A1 Dec. 18, 2014

Related U.S. Application Data

(63) Continuation-in-part of application No. 13/663,626, filed on Oct. 30, 2012, now Pat. No. 8,801,091.

(60) Provisional application No. 61/553,320, filed on Oct. 31, 2011, provisional application No. 61/876,002, filed on Sep. 10, 2013, provisional application No. 61/954,003, filed on Mar. 17, 2014.

(51) Int. Cl.

| | |
|---|---|
| ***A47C 7/74*** | (2006.01) |
| ***A47C 4/00*** | (2006.01) |
| ***A47C 4/28*** | (2006.01) |
| ***A47C 4/20*** | (2006.01) |

(52) U.S. Cl.
CPC . *A47C 7/744* (2013.01); *A47C 4/20* (2013.01); *A47C 7/746* (2013.01)

(58) Field of Classification Search
CPC ..... A47C 7/74; A47C 4/28
USPC ..... 297/45, 180.13, 180.14
See application file for complete search history.

(56) References Cited

U.S. PATENT DOCUMENTS

| | | | |
|---|---|---|---|
| 3,295,886 | A | 1/1967 | Goldmerstein |
| 3,624,814 | A | 11/1971 | Borichevsky |
| 4,141,585 | A | 2/1979 | Blackman |
| 4,825,488 | A | 5/1989 | Bedford |
| 4,946,220 | A | 8/1990 | Wyon et al. |
| 5,160,517 | A | 11/1992 | Hicks et al. |
| 5,301,457 | A | 4/1994 | Seely |
| 5,370,439 | A | 12/1994 | Lowe et al. |
| 5,382,075 | A | 1/1995 | Shih |
| 5,403,065 | A | 4/1995 | Callerio |
| 5,692,952 | A | 12/1997 | Chih-Hung |
| 5,921,858 | A | 7/1999 | Kawai et al. |
| 6,644,735 | B2 | 11/2003 | Bargheer et al. |
| 6,786,273 | B2 | 9/2004 | Ichigaya |
| 6,976,734 | B2 | 12/2005 | Stoewe |
| 7,059,671 | B1 | 6/2006 | Coggins |
| 7,070,231 | B1 | 7/2006 | Wong |
| 7,213,876 | B2 | 5/2007 | Stoewe |
| 7,396,075 | B2 | 7/2008 | Ohkuma et al. |
| 7,475,938 | B2 | 1/2009 | Stoewe et al. |

(Continued)

*Primary Examiner* — Rodney B White

(57) ABSTRACT

A chair assembly comprising a backrest, a fan assembly, and an airflow guide associated with the backrest in a manner such that airflow emitted from the fan assembly exits the chair assembly through the backrest. The assembly in various embodiments is, for example, a collapsible lawn chair, a quad chair, a bleacher chair, or an accessory for a wheelchair.

26 Claims, 38 Drawing Sheets

(56) References Cited

U.S. PATENT DOCUMENTS

| | | | | |
|---|---|---|---|---|
| 7,688,582 | B2 | 3/2010 | Fukazu et al. | |
| 7,866,743 | B1 | 1/2011 | Russell et al. | |
| 7,878,585 | B2 | 2/2011 | Salisbury | |
| 8,123,290 | B1 | 2/2012 | Aiken et al. | |
| 8,272,685 | B2 | 9/2012 | Lucas et al. | |
| 8,297,695 | B1 | 10/2012 | Aiken et al. | |
| 8,801,091 | B2 * | 8/2014 | Squires et al. | 297/180.14 |
| 2002/0057005 | A1 | 5/2002 | Bargheer et al. | |
| 2004/0075311 | A1 | 4/2004 | Linder | |
| 2006/0087160 | A1 | 4/2006 | Dong et al. | |
| 2008/0290702 | A1 | 11/2008 | Shin | |
| 2010/0164256 | A1 | 7/2010 | Salisbury | |
| 2011/0260509 | A1 | 10/2011 | Siu | |
| 2013/0049410 | A1 | 2/2013 | Stafford et al. | |
| 2013/0076083 | A1 | 3/2013 | Davidson et al. | |
| 2013/0106150 | A1 | 5/2013 | Squires et al. | |
| 2013/0328359 | A1 | 12/2013 | Antonov et al. | |

* cited by examiner

VENTILATED CHAIR ASSEMBLY

REFERENCE TO RELATED APPLICATIONS

This application is a continuation-in-part application based on application Ser. No. 13/663,626 filed Oct. 30, 2012, and claims priority to provisional application 61/553,320 filed Oct. 31, 2011. This application also claims priority to provisional application 61/876,002 filed Sep. 10, 2013 and provisional application 61/954,003 filed Mar. 17, 2014, the entire disclosures of which are incorporated by reference.

FIELD OF THE INVENTION

The present invention generally relates to chair assemblies, and more particularly, to chair assemblies equipped with systems to promote comfort of the user.

BACKGROUND

A typical chair tends to include a seat and a backrest. Some chairs may include other features such as armrests and/or wheels. While chairs have been in existence for centuries, they can be uncomfortable in some situations. For instance, a chair can become uncomfortable if a user sits on it for an extended period of time. As another example, a user may find sitting in a chair uncomfortable when the chair is located in a warm environment (e.g., outdoors during the summer). Some people would likely find it desirable to have a chair that enhances comfort for a user.

SUMMARY

The present invention is directed to a chair assembly comprising a backrest comprising a bottom, a top opposite the bottom, a front side, and a back side opposite the front side, wherein the backrest includes a material that allows airflow to pass therethrough; a fan assembly attached to the chair assembly at the bottom of the backrest; an airflow guide attached to the back side of the backrest into which airflow from the fan assembly is directed, wherein the airflow guide is associated with the backrest in a manner such that airflow emitted from the fan assembly exits the chair assembly through the backrest, wherein the airflow guide is substantially impermeable to airflow, and wherein a distance between the bottom of the backrest and an opposing portion of a bottom of the airflow guide is greater than a distance between the top of the backrest and an opposing portion of a top of the airflow guide; wherein the fan assembly comprises at least one fan unit, and wherein said at least one fan unit is oriented to blow air through the airflow guide in a direction generally parallel to the backrest.

Chair assemblies described in this Summary section generally include a seat and a backrest. The backrest generally includes a bottom, a top opposite the bottom, a front side, and a back side opposite the front side. Further, the seat generally includes a top side, a bottom side opposite the top side, a front, and a rear opposite the front.

A first aspect of the present invention has a fan assembly attached to the bottom of the backrest. The fan assembly associated with the first aspect of the invention may have both an air intake and an air output. In some embodiments, the air intake may face generally away from the top of the backrest, and the air output may face generally toward the top of the backrest. In some embodiments, this may mean that the fan assembly is positioned such that airflow therefrom may be oriented generally upward toward the top of the backrest. For example, the fan assembly may be positioned such that airflow therefrom may be generally oriented in a direction from by the bottom of the backrest to toward the top of the backrest. In some embodiments, a distance between the air intake and the seat of the chair assembly may be less than a distance between the air output and the seat. In other words, the seat may be closer to the air intake than to the air output.

An airflow guide may be associated with the backrest of the first aspect. While not necessarily the case all the time, it is generally preferred that the airflow guide be substantially impermeable to airflow. In embodiments having an airflow guide, the fan assembly may be found in any appropriate location. For instance, the fan assembly may be located between the airflow guide and the back side of the backrest. The airflow guide may be associated with the backrest in a manner such that a significant amount of, a majority of, or even substantially all airflow emitted from the fan assembly exits the chair assembly through the backrest.

In embodiments of the first aspect having an airflow guide, a distance between the bottom of the backrest and an opposing portion of a bottom of the airflow guide may be greater than a distance between the top of the backrest and an opposing portion of a top of the airflow guide. In some embodiments, the airflow guide may angle at least generally toward the top of the backrest and angle at least generally away from a bottom of the backrest.

A second aspect of the invention includes a fan assembly associated with the backrest and an airflow guide into which airflow from the fan assembly is directed. The airflow guide of this second aspect is associated with the backrest in a manner such that airflow emitted from the fan assembly exits the chair assembly through the backrest. It is generally preferred that the airflow guide of this second aspect be substantially impermeable to airflow. In some embodiments, the backrest and airflow guide of the chair assembly may be positioned relative to one another such that a distance between the bottom of the backrest and an opposing portion of a bottom of the airflow guide is greater than a distance between the top of the backrest and an opposing portion of a top of the airflow guide. In some embodiments, the airflow guide may angle at least generally toward the top of the backrest and at least generally away from the bottom of the backrest.

A fan assembly may be incorporated in a chair assembly of the first and/or second aspect in any of a number of appropriate manners. For instance, the back side of the backrest may be disposed between the fan assembly and the front side of the backrest. Accordingly, the fan assembly may be associated with the back side of the backrest (e.g., and not associated with the front side thereof). In some embodiments, the fan assembly may be attached to the bottom of the backrest at the back side thereof. In embodiments that include a frame, the fan assembly may be attached to a portion of the frame adjacent the bottom of the backrest such that the back side of the backrest is disposed between the fan assembly and the front side of the backrest.

In embodiments of the first and/or second aspects of the invention having an airflow guide, the airflow guide may exhibit any appropriate size and dimensions. For instance, the airflow guide may substantially extend an entire length of the backrest between the top and the bottom thereof. In some embodiments, the airflow guide may substantially extend an entire width of the backrest between a right side and a left side thereof.

In embodiments of the first and/or second aspects of the invention having an airflow guide, the airflow guide may be associated with the backrest in any appropriate manner. For example, the airflow guide may be attached to the top of the backrest. In embodiments that include a frame, the airflow guide may be attached to a portion of the frame located adjacent the top of the backrest. Additionally and/or alternatively, the airflow guide may be attached to a left side and/or a right side of the backrest. In embodiments that include a frame, the airflow guide may be attached to a portion of the frame located adjacent the left side of the backrest and/or a portion of the frame located adjacent the right side of the backrest. In addition to being associated with the backrest, the airflow guide of some embodiments may be attached to the fan assembly.

A third aspect of the invention has a fan assembly attached to the rear of the seat. The fan assembly associated with the third aspect of the invention may be oriented in a number of suitable fashions relative to the seat of the chair assembly. For instance, the fan assembly may include an air intake that faces generally away from the front of the seat and an air output that faces generally toward the front of the seat. As another example, the fan assembly may be positioned such that airflow therefrom is generally oriented in a direction from by the rear of the seat to toward the front of the seat. As yet another example, the fan assembly may be oriented such that a distance between an air intake of the fan assembly and the backrest is less than a distance between an air output of the fan assembly and the backrest. In other words, the air intake may be closer to the backrest than the air output is to the backrest.

In some embodiments of the third aspect, an airflow guide may be associated with the seat in a manner such that the fan assembly is positioned between the airflow guide and the bottom side of the seat. This airflow guide may be substantially impermeable to airflow. In some embodiments, a distance between the rear of the seat and an opposing portion of a rear of the airflow guide may greater than a distance between the front of the seat and an opposing portion of a front of the airflow guide. In some embodiments, the airflow guide may angle at least generally toward the front of the seat and angle at least generally away from a rear of the seat.

A fourth aspect of the invention includes a fan assembly associated with the seat, and an airflow guide associated with the seat in a manner such that airflow emitted from the fan assembly exits the chair assembly through the seat. It is generally preferred that the airflow guide of this fourth aspect be substantially impermeable to airflow. In some embodiments, a distance between the rear of the seat and an opposing portion of a rear of the airflow guide is greater than a distance between the front of the seat and an opposing portion of a front of the airflow guide. In some embodiments, the airflow guide angles at least generally toward the front of the seat and angles at least generally away from a rear of the seat.

The fan assembly may be incorporated in the chair assembly of the third and/or fourth aspect in any of a number of appropriate manners. For instance, the bottom side of the seat may be disposed between the fan assembly and the top side of the seat. Accordingly, the fan assembly may be associated with the bottom side of the seat (e.g., and not associated with the top side thereof). In some embodiments, the fan assembly may be attached to the rear of the seat at the bottom thereof. In embodiments that include a frame, the fan assembly may be attached to a portion of the frame adjacent the rear of the seat such that the rear of the seat is disposed between the fan assembly and the top side of the seat. In addition to be associated with the seat, the airflow guide of some embodiments may be attached to the fan assembly.

A fifth aspect of the invention includes an airflow guide associated with the bottom side of the seat in a manner such that the airflow guide is attached to the bottom side of the seat and/or a portion of the frame adjacent the bottom side of the seat. In addition, a fan assembly is attached to the airflow guide such that the airflow guide is located at least generally between the bottom side of the seat and the fan assembly. It is generally preferred that the airflow guide of this fifth aspect be substantially impermeable to airflow. Further, the airflow guide of this fifth aspect at least generally tapers from near the bottom side of the seat toward the fan assembly. In some embodiments, the fan assembly of the fifth aspect may be characterized as having both an air intake and an air output. In such embodiments, the fan assembly may be oriented such that the air intake faces generally away from the bottom side of the seat, and such that the air output faces generally toward the bottom side of the seat.

In some embodiments of the fifth aspect, the airflow guide may include (e.g., be substantially constructed of) a pliable material. In such embodiments, the fan assembly may be spaced from the bottom side of the seat by a first distance when a support mechanism of the chair assembly is disengaged, and spaced from the bottom side of the seat by a second distance substantially less than the first distance when the support mechanism is engaged. In some embodiments, the airflow guide may be collapsed and folded over itself when a support mechanism of the chair assembly is engaged, and the airflow guide may be extended and unfolded when the support mechanism is disengaged.

Some chair assemblies of the fifth aspect may be movable between an open condition and a closed condition. In the open condition, the fan assembly may be spaced from the bottom side of the seat by a first distance, and, in the closed condition, the fan assembly may be spaced from the bottom side of the seat by a second distance substantially less than the first distance. In some embodiments of the fifth aspect, the closed condition may include the airflow guide being collapsed and folded over itself, and the open condition may include the airflow guide being extended and unfolded.

The airflow guide associated with one or more of the third, fourth, and/or fifth aspects may be associated with the seat in a manner such that a significant amount of, a majority of, or even substantially all airflow emitted from the fan assembly exits the chair assembly through the seat. The airflow guide may exhibit any appropriate size and dimensions. For instance, the airflow guide may substantially extend an entire length of the seat between the front and the rear thereof. The airflow guide may substantially extend an entire width of the seat between a right side and a left side thereof.

In embodiments of the third, fourth, and/or fifth aspect of the invention, the airflow guide may be associated with the seat in any suitable fashion. For instance, the airflow guide may be attached to the front and/or the rear of the seat. Similarly, the airflow guide may be attached to a left side and/or a right side of the seat. Some embodiments of the chair assembly may include a frame. In such embodiments, the airflow guide may be attached to the frame. For instance, the airflow guide may be attached to a portion of the frame located adjacent the front of the seat and/or to a portion of the frame located adjacent the rear of the seat. Additionally or alternatively, the airflow guide may be attached to a portion of the frame located adjacent the left side of the seat and/or a portion of the frame located adjacent the right side of the seat.

Yet a sixth aspect of the present invention is directed to a chair assembly that includes both a backrest assembly and a seat assembly. The backrest assembly of this sixth aspect includes a backrest and a first fan assembly associated with the backrest. Similarly, the seat assembly of this sixth aspect includes a seat and a second fan assembly associated with the seat.

Each of the first and second fan assemblies of the sixth aspect can exhibit any of a number of appropriate designs, can be oriented in any of a number of appropriate fashions, and can be incorporated into the chair assembly in any appropriate manner. For instance, in some embodiments, the first fan assembly may exhibit any design and/or orientation described above in regard to the fan assembly of the first and/or second aspects of the invention. Further, the first fan assembly in some embodiments may be incorporated into the chair assembly of the sixth aspect in any manner described above in regard to the fan assembly of the first and/or second aspects of the invention. Likewise, in some embodiments, the second fan assembly may exhibit any design and/or orientation described above in regard to the fan assembly of the third, fourth, and/or fifth aspects of the invention. Also, the second fan assembly in some embodiments may be incorporated into the chair assembly of the sixth aspect in any manner described above in regard to the fan assembly of the third, fourth, and/or fifth aspects of the invention.

In some embodiments of the sixth aspect, one or both of the seat assembly and the backrest assembly may include an airflow guide. For instance, the chair assembly may have an airflow guide associated with at least one of the backrest or the seat. As such, some embodiments may have a first airflow guide associated with the backrest and a second airflow guide associated with the seat. In the case that there is an airflow guide (first airflow guide) associated with the backrest, that airflow guide can exhibit any of a number of appropriate designs such as, for example, any design described above in regard to an airflow guide associated with the first and/or second aspects of the invention. Further, the first airflow guide in some embodiments may be incorporated into the chair assembly of the sixth aspect in any manner described above in regard to an airflow guide of associated with the first and/or second aspects of the invention. Similarly, in the case that there is an airflow guide (second airflow guide) associated with the seat, that airflow guide can exhibit any of a number of appropriate designs such as, for example, any design described above in regard to an airflow guide associated with the third, fourth, and/or fifth aspects of the invention. Also, the second airflow guide in some embodiments may be incorporated into the chair assembly of the sixth aspect in any manner described above in regard to an airflow guide of associated with the third, fourth, and/or fifth aspects of the invention.

A number of feature refinements and additional features are applicable to each of the first, second, third, fourth, fifth, and sixth aspects of the present invention. These feature refinements and additional features may be used individually or in any combination. The following discussion is applicable to embodiments of the first, second, third, fourth, fifth, and sixth aspects of the present invention.

Some chair assemblies of the present invention may be characterized as being portable and/or collapsible. In this regard, an embodiment of a chair assembly being "portable" may refer to its ability to be moved and/or carried with ease by a user. Further, an embodiment of a chair assembly being "collapsible" may refer to its ability to be moved between an open condition and a closed condition (e.g., where the chair assembly, in the closed condition, is a more compact size, for example, for storage and/or transport thereof). Indeed, some chair assemblies of the invention are movable between the open condition and the closed condition. In some embodiments, a chair assembly being in the open condition may refer to the chair assembly being configured to allow a user to sit on the top side of the seat and place a back of the user against the front of the backrest. Additionally or alternatively, the open condition of a chair assembly may refer to the top side of the seat being at an angle of between about 80 degrees and about 180 degrees (e.g., between about 90 degrees and about 160 degrees) relative to the front of the backrest. With regard to the closed condition, in some embodiments, a chair assembly in the closed condition may be configured such that the top side of the seat at least generally faces and/or is in proximity with the front of the backrest. Additionally or alternatively, the closed condition of a chair assembly may refer to the top side of the seat at least generally facing the front of the backrest and/or being at an angle of between about 0 degrees and about 45 degrees relative to the front of the backrest.

In embodiments of a chair assembly having a frame, the frame may include first and second portions that are pivotally interconnected with one another so that at least one of the seat and backrest can be pivoted toward and away from the other (e.g., to promote transitions between the open condition and the closed condition). Herein, "pivotally interconnected" or the like refers to any type of interconnection that allows a structure to at least generally undergo a pivoting or pivotal-like motion when exposed to an appropriate force, including without limitation any interconnection that allows a structure or a portion thereof to move at least generally about a certain axis. Representative pivotal interconnections include the use of a flexing or elastic deformation of a structure or a portion thereof, as well as the use of relative motion between two or more structures that are typically in interfacing relation during at least a portion of the relative movement (e.g., a hinge connection; a ball and socket connection).

The backrest may be made of any of a number of appropriate materials (e.g., synthetic or natural) such as, for example, a vinyl-coated polyester mesh. It is generally preferred in embodiments having a fan assembly associated with the backrest that the backrest includes (e.g., is substantially constructed of) a material allowing airflow to pass therethrough. For instance, in some embodiments, the backrest may include a material that is substantially porous. Similarly, the seat may be made of any of a number of appropriate materials (e.g., synthetic or natural) such as, for example, a vinyl-coated polyester mesh. It is generally preferred in embodiments having a fan assembly associated with the seat that the seat includes (e.g., is substantially constructed of) a material allowing airflow to pass therethrough. For instance, in some embodiments, the seat may include a material that is substantially porous.

The airflow guide associated with one or more embodiments of any of the aspects of the invention may include (e.g., be substantially constructed of) any appropriate material (e.g., synthetic or natural) such as, but not limited to vinyl polyester, nylon, or a combination thereof. Further, the airflow guide may be substantially rigid in some embodiments and substantially pliable in other embodiments. In some embodiments, it may be preferable to have the airflow guide include a substantially pliable material so that the chair assembly may be lighter in weight and/or easier to store (e.g., in the case that portability and/or collapsibility are desired).

A chair assembly of any of the aspects above may exhibit any appropriate weight. In some embodiments, it may be desirable for the chair assembly not to exceed a certain weight threshold. For instance, in the case where a chair assembly is designed to be portable, it may be preferred that the weight of the chair assembly be such that the chair assembly can be moved and/or carried with ease. As such, the chair assembly may have a maximum weight of no more than about 8 pounds (lbs.) in some embodiments, no more than about 7 lbs. in other embodiments, no more than about 6 lbs. in still other embodiments, and no more than about 5 lbs. in yet other embodiments. In some embodiments, the chair assembly may have a maximum weight of between about 3 lbs. and about 8 lbs. (e.g., between about 5 lbs. and about 7 lbs.). Other embodiments may have chair assemblies exhibiting maximum weights of other appropriate magnitudes and/or ranges.

Significant sound emitted due to operation of a fan assembly associated with one or more aspects of the invention may be undesirable to some users. In this regard, some users may find significant background noise associated with operation of a given fan assembly to be distracting and/or disruptive. As such, a maximum level of sound (e.g., noise) emitted due to operation of a fan assembly may be no greater than about 65 dBA in some embodiments, no greater than about 60 dBA in other embodiments, no greater than about 55 dBA in yet other embodiments, no greater than about 50 dBA in still other embodiments, no greater than about 45 dBA in even other embodiments, and no greater than about 40 dBA in still yet other embodiments. In some embodiments, a maximum level of sound emitted due to operation of a fan assembly may be between about 40 dBA and about 65 dBA, or between about 45 dBA and about 60 dBA. Other embodiments may have fan assemblies exhibiting maximum sound levels of other appropriate magnitudes and/or ranges.

A fan assembly associated with any of the above-mentioned aspects of the invention may provide any of a number of suitable airflow outputs. It may be preferred by some that airflow provided by a given fan assembly be such that a user can feel the same when sitting in a chair assembly of the invention. In some embodiments, the magnitude of desired airflow may have to be balanced against the noise produced by the fan assembly such that the resulting airflow can be maximized while minimizing background noise due to operation of the fan assembly. For instance, a maximum airflow output of the fan assembly may be no more than about 350 cubic feet per minute (CFM) in some embodiments, no more than about 300 CFM in other embodiments, no more than about 250 CFM in still other embodiments, no more than about 200 CFM in yet other embodiments, no more than about 150 CFM in even other embodiments. In some embodiments, the maximum airflow output of the fan assembly may be between about 150 CFM and about 325 CFM, or between about 175 CFM and about 300 CFM. The maximum airflow output of the fan assembly may be no less than about 125 CFM in other embodiments. Still other embodiments may have fan assemblies exhibiting maximum airflow outputs of other appropriate magnitudes and/or ranges. Herein, a "maximum airflow output" of a fan assembly refers to the sum total of the maximum airflow outputs of each of the fan units that are included in the fan assembly.

A fan assembly associated with any of the aspects herein may include one or more fan units (e.g., 1, 2, 3, 4, 5, 6, or more fan units). For instance, some embodiments may have a fan assembly that includes 4 fan units. A maximum level of sound (e.g., noise) emitted due to operation of each fan unit may be no greater than about 60 dBA in some embodiments, no greater than about 50 dBA in other embodiments, no greater than about 45 dBA in still other embodiments, no greater than about 40 dBA in yet other embodiments, no greater than about 35 dBA in even other embodiments, and no greater than about 30 dBA in still yet other embodiments. In some embodiments, a maximum level of sound emitted due to operation of each fan unit may be between about 20 dBA and about 50 dBA, or between about 25 dBA and about 45 dBA. Still other embodiments may have fan units exhibiting maximum sounds levels of other appropriate magnitudes and/or ranges.

As mentioned in the preceding paragraph, a fan assembly associated with any of the aspects herein may include one or more fan units (e.g., 1, 2, 3, 4, 5, 6, or more fan units). A maximum airflow output of each fan unit may be no more than about 70 CFM in some embodiments, no more than about 65 CFM in other embodiments, no more than about 60 CFM in still other embodiments, no more than about 55 CFM in yet other embodiments, no more than about 50 CFM in even other embodiments, and no more than about 45 CFM is still yet other embodiments. In other embodiments, the maximum airflow output of each fan unit may be no more than about 40 CFM, no more than about 35 CFM, no more than about 30 CFM, or even no more than about 25 CFM. In some embodiments, the maximum airflow output of each fan unit may be between about 20 CFM and about 60 CFM, or between about 25 CFM and about 55 CFM. Still other embodiments may have fan units exhibiting maximum airflow outputs of other appropriate magnitudes and/or ranges.

In the case that a fan assembly associated with any of the aspects of the invention includes a plurality of fan units, each fan unit may have a central axis substantially aligned with a direction of airflow therefrom. In such embodiments, the central axes of at least two (e.g., two, three, four, five, six, or all) of the fan units may be substantially parallel with one another.

A fan assembly associated with any of the above-described aspects may be powered in any appropriate fashion. For instance, a given fan assembly may be powered using AC power from a standard AC electrical outlet. Another fan assembly may utilize power (e.g., DC power) provided by a battery (e.g., disposable or rechargeable battery). Still other fan assemblies may utilize solar power. In some embodiments, a combination of power supplies, such as those listed above, may be utilized to power a given fan assembly.

In the case that a chair assembly described herein includes a plurality of fan assemblies (e.g., first and second fan assemblies), each fan assembly may have its own source of power. In such embodiments, the power source for one fan assembly of a given chair assembly may be same or different than the power source for another fan assembly of that same chair assembly. For example, in some embodiments, a first fan assembly may be powered by a first battery while a second fan assembly of the same chair assembly may be powered by a second battery that is separate and distinct from the first battery. As another example, a first fan assembly may be powered by a battery while a second fan assembly of the same chair assembly may be powered using AC power from a standard AC electrical outlet. In some embodiments having a plurality of fan assemblies, the fan assemblies may share a common power source (e.g., each fan assembly draws power from a common power source).

In the case that a fan assembly associated with any of the aspects above utilizes one or more batteries for power, a given fan assembly may include a battery compartment. This battery compartment may be disposed in any appropriate location relative to other components of the fan assembly. For instance, in some embodiments having a battery compartment and a plurality of fan units, at least one fan unit may be located on one side of the battery compartment, and at least another fan unit may be located on another side of the battery compartment substantially opposite the one side.

Still other aspects of the invention relate to designs and componentry of fan assemblies described herein, such as the fan assemblies mentioned above with regard to any of the first, second, third, fourth, and/or fifth aspects of the invention.

Yet other aspects of the invention relate to designs of airflow guides described herein, such as the airflow guides mentioned above with regard to any of the first, second, third, fourth, and/or fifth aspects of the invention.

BRIEF DESCRIPTION OF THE FIGURES

Various features, aspects, and advantages of the present invention will become better understood when the following detailed description is read with reference to the accompanying figures in which like characters represent like parts throughout the figures.

DETAILED DESCRIPTION OF THE ILLUSTRATED EMBODIMENTS

Figure 1:
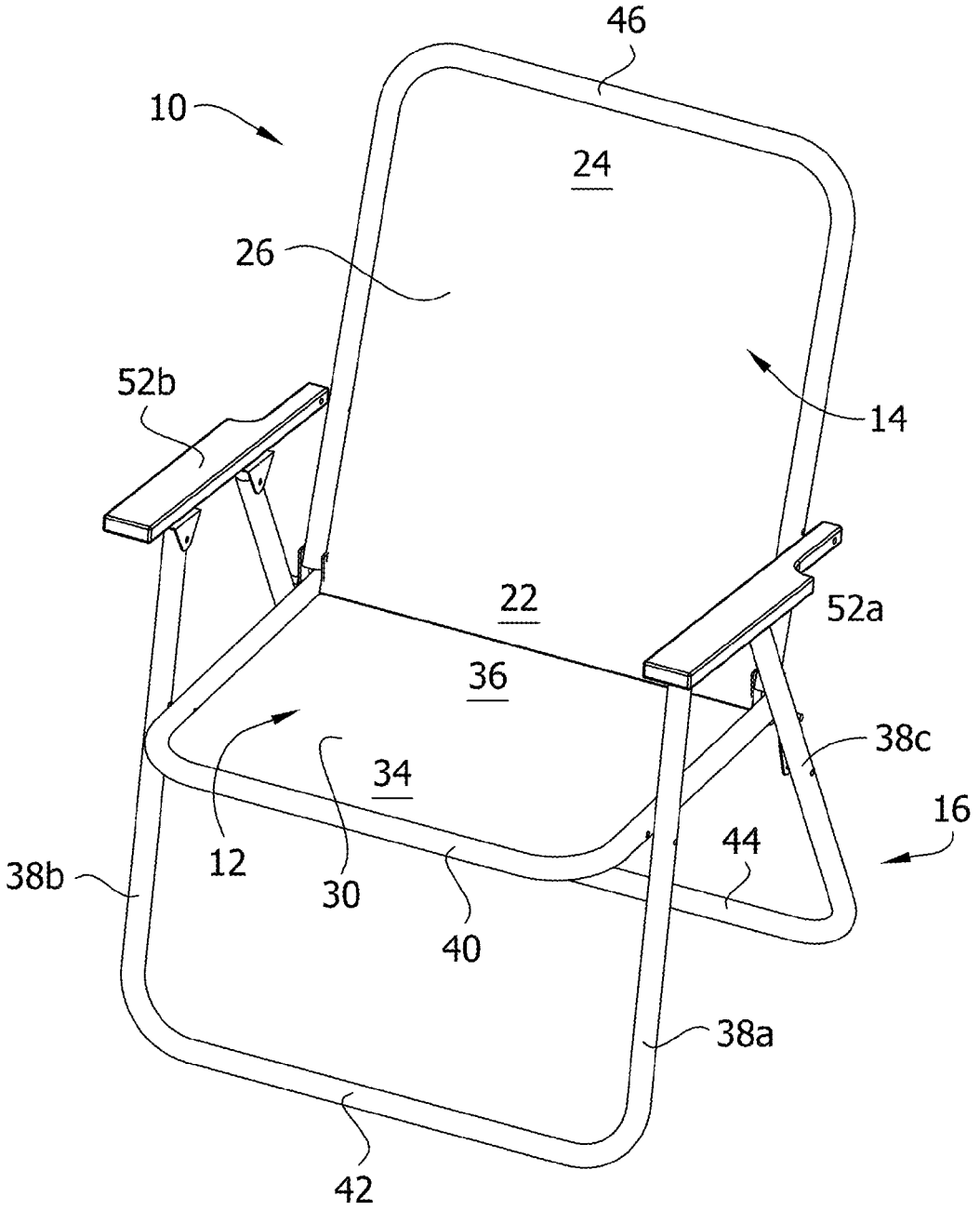
FIGS. 1-3 are perspective views of a chair assembly.

FIGS. 1-6 illustrate one embodiment of a chair assembly 10 having a seat 12, a backrest 14, a frame 16, a fan assembly 18, and an airflow guide 20. The backrest 14 includes a bottom 22, a top 24 opposite the bottom 22, a front side 26, and a back side 28 opposite the front side 26. Further, the seat 12 includes a top side 30, a bottom side 32 opposite the top side 30, a front 34, and a rear 36 opposite the front 34, Each of the seat 12 and the backrest 14 may be made of any of a number of appropriate materials (e.g., synthetic or natural) such as, for example, a vinyl-coated polyester mesh (e.g., a Textilene® material manufactured by Twitchell Corp. of Dothan, Ala.). In some embodiments, the seat 12 and the backrest 14 may be made from the same material(s). In other embodiments, the seat 12 may be made from a first material, and the backrest 14 may be made of a second material different from the first material. Since the fan assembly 18 is associated with (e.g., directly and/or indirectly attached to) the backrest 14 of the chair assembly 10, it is generally preferred that the backrest 14 include (e.g., be substantially constructed of) a material that allows airflow to pass therethrough. For instance, the backrest 14 may include a material that is substantially porous (including, but not limited to, weaves, screens, and meshes). The seat 12 may or may not include a material that allows airflow to pass therethrough (e.g. is substantially porous).

The seat 12 and the backrest 14 can be attached to the frame 16 in any appropriate manner such as by welds, adhesives, and/or mechanical fasteners (e.g., nails, screws, bolts, rivets, staples, and the like). In the illustrated embodiment, the frame 16 includes four legs 38*a-d*, each of which is pivotally interconnected with a seat portion 40 of the frame 16 (e.g., directly as shown with regard to the interconnection between the seat portion 40 and each front leg 38*a*, 38*b*, and indirectly as shown with regard to the interconnection between the seat portion 40 and each rear leg 38*c*, 38*d* employing mechanical supports 48 and a pivot rod 50 to provide the interconnection). The front legs 38*a*, 38*b* are interconnected (in this case, integral) with one another by way of a front cross bar 42. Further, the rear legs 38*c*, 38*d* are interconnected (in this case, integral) with one another by way of a rear cross bar 44. While the front and rear cross bars 42, 44 are shown as being positioned to interface with a support surface (e.g., the ground) in the illustrated embodiment, other embodiments may have front and/or rear cross bars located in other positions on the frame. Still other embodiments may not include one or both of the front and rear cross bars. In such embodiments, front leg 38*a* may not be connected to front leg 38*b*, and/or rear leg 38*c* may not be connected to rear leg 38*d*. In other embodiments, the frame 16 may exhibit any of a number of other appropriate designs.

Figure 5:
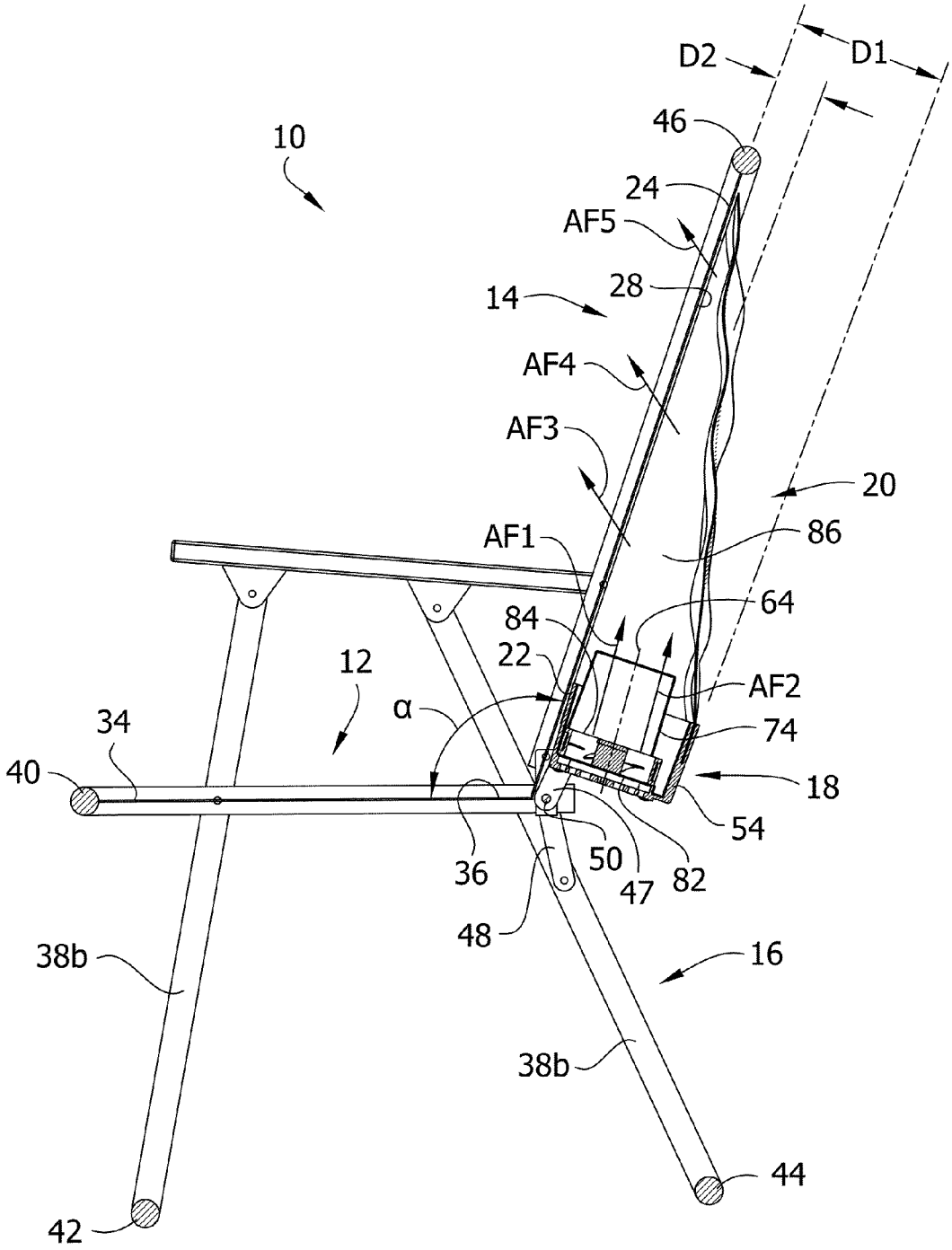
FIG. 5 is a cross-section of the chair assembly of FIGS. 1-4 taken along line D-D shown in FIG. 4.
Figure 6:
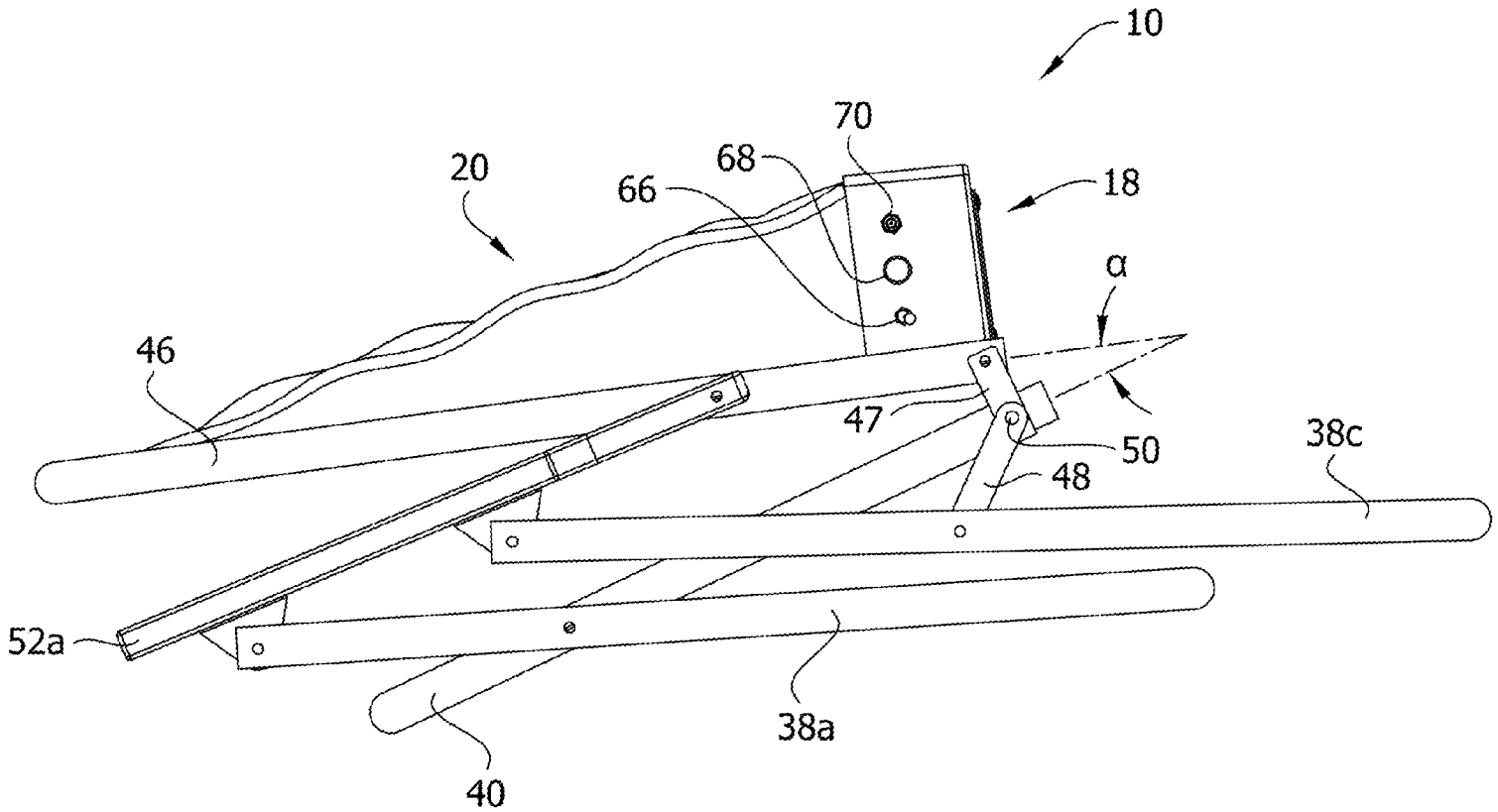
FIG. 6 is a side elevation of the chair assembly of FIGS. 1-5 shown in a closed condition.
Figure 7:
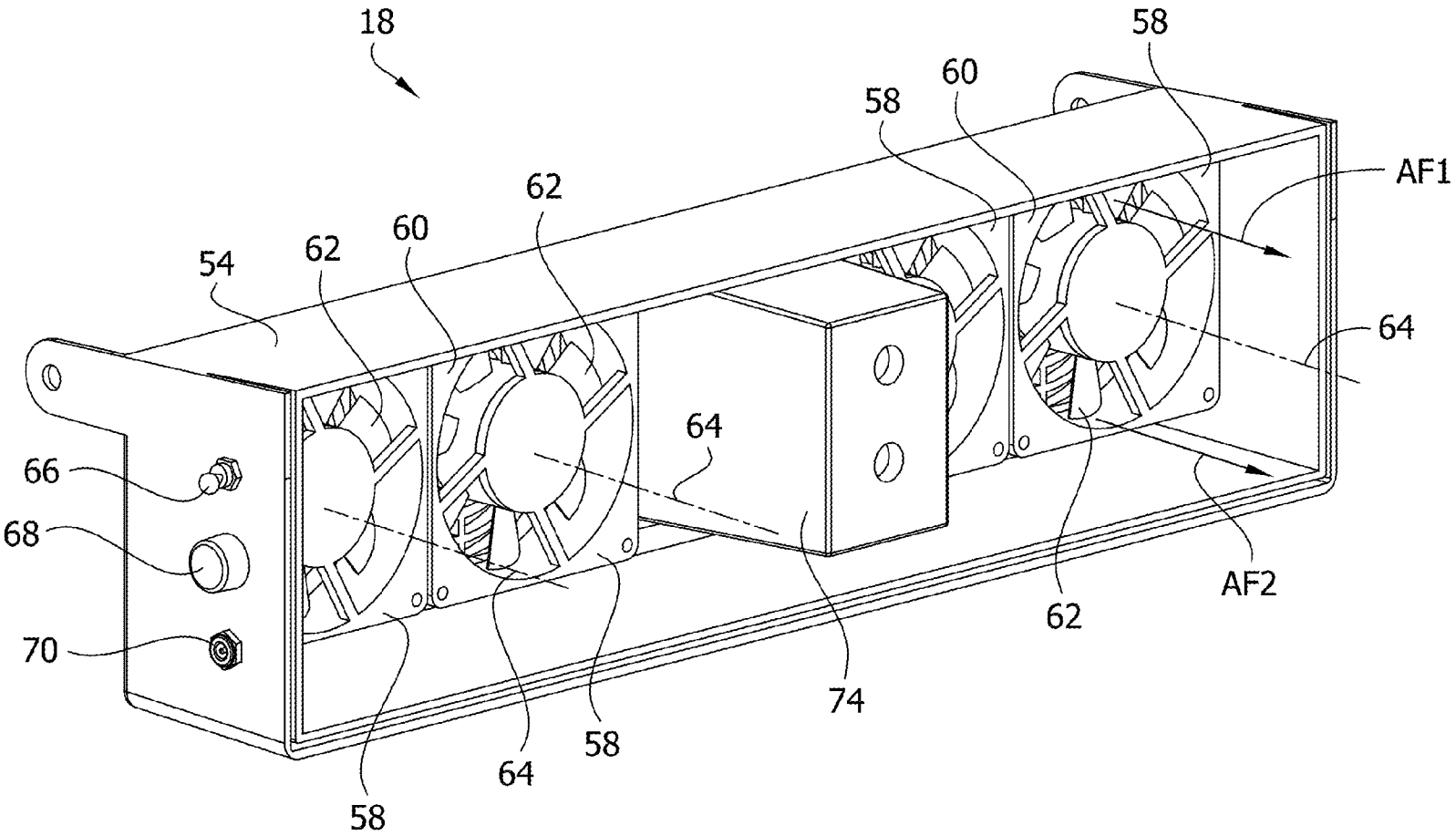
FIG. 7 is a perspective view of a fan assembly.

The frame 16 of the chair assembly 10 also includes a backrest portion 46. As shown in FIGS. 1-6, the seat 12 is attached to the seat portion 40 of the frame 16, and the backrest 14 is attached to the backrest portion 46 of the frame 16. As can be seen in FIGS. 2, 3, 5, and 6, the backrest portion 46 of the frame 16 is pivotally interconnected with the seat portion 40 of the frame 16 using the pivot rod 50 of the frame 16 that extends through the seat portion 40 as well as the mechanical supports 47 that are attached to the backrest portion 46 of the frame 16. In this manner, it may be said that the seat 12 and the backrest 14 are pivotally interconnected (via the frame 16) with one another. Accordingly, due to the pivotal interconnection between the seat portion 40 of the frame 16 and the backrest portion 46 of the frame, it may be said that at least one of the seat 12 and backrest 14 can be pivoted toward and away from the other (e.g., to promote transitions between an open condition of the chair assembly 10 such as shown in FIGS. 1-5 and a closed condition of the chair assembly 10 such as shown in FIG. 6). Other embodiments of the chair assembly 10 may exhibit other appropriate frame designs allowing at least one of the seat 12 and backrest 14 to be pivoted toward and away from the other. Still other embodiments may include frames that do not allow for a pivoting relationship between the seat 12 and the backrest 14. Further, the frame 16 and it various components can be made of any of a number of appropriate materials including, but not limited to, plastics, wood, and metals (e.g., steel, aluminum).

Also attached to the frame 16 of the chair assembly 10 are armrests 52*a*, 52*b*. More specifically, these armrests 52*a*, 52*b* are pivotally interconnected with the legs 38*a-d* of the frame 16. As shown in FIGS. 1-6, armrest 52*a* is pivotally interconnected to front leg 38*a* and rear leg 38*c*. Likewise, armrest 52*b* is pivotally interconnected to front leg 38*b* and rear leg 38*d*. These pivotal interconnections, at least in part, enable the chair assembly 10 to be transitioned between an open condition (e.g., FIG. 1) and a closed condition (e.g., FIG. 6). The armrests 52*a*, 52*b* may be made of any appropriate materials (e.g., wood, plastic, metal) and exhibit any appropriate designs and/or configurations. For example, while not shown in the illustrated embodiment, one or both of the armrests 52*a*, 52*b* may include features such as a cup holder (e.g., for holding beverage containers) and/or other recesses to accommodate other articles (e.g., cellular telephone, smart phone, mp3 player, or the like). Some embodiments of the chair assembly 10 may include armrests that are fixedly attached to and not pivotally interconnected with the frame 16. Other embodiments may include armrests being attached to different portions of a frame of a chair assembly. Still other embodiments may not include armrests.

The fan assembly 18 of the chair assembly 10 is shown as being associated with the bottom 22 of the backrest 14 such that the fan assembly 18 is attached to the bottom 22 of the backrest 14 and/or a portion of a frame 16 of the chair assembly 10 adjacent the bottom 22 of the backrest 14. More specifically, the fan assembly 18 is attached to the bottom 22 of the backrest 14 at the back side 28 thereof. This attachment can be accomplished in any appropriate manner (e.g., e.g., using welds, adhesives, and/or mechanical fasteners). Further, the fan assembly 18 is also attached to the frame 16 of the chair assembly 10 by way of the pivot rod 50 extending through at least a portion of a housing 54 of the fan assembly 18.

Each fan unit 58 of the fan assembly 18 has both an air intake 82 and an air output 84 such that air enters a given fan unit 58 via the air intake 82 and exits the fan unit 58 via the air output 84. This enables air to flow through the fan assembly 18 in the general manner indicated by arrows AF1 and AF2 of FIGS. 5 and 8. In particular, the fan assembly 18 is shown has having four air intakes 56 and four corresponding air outputs 58. As shown best in FIG. 5, each air intake 82 generally faces away from the top 24 of the backrest 14 (e.g., generally toward the ground when the chair assembly 10 is supported thereon in an open condition), and the air output 84 generally faces toward the top 24 of the backrest 14 (e.g., generally away from the ground when the chair assembly 10 is supported thereon in an open condition). As such, the fan assembly 18 is positioned such that airflow therefrom (e.g., arrows AF1 and AF2) is oriented generally upward toward the top 24 of the backrest 14. Another characterization may be that the fan assembly 18 is positioned such that airflow therefrom is generally oriented in a direction from by the bottom 22 of the backrest 14 to toward the top 24 of the backrest 14. Accordingly, and as is shown in FIG. 5, a distance between the air intake 82 and the seat 12 (e.g., the rear 36 thereof) may be less than a distance between the air output 84 and the seat 12 (i.e., the seat 12 is closer to the air intake 82 than it is to the air output 84). One of the benefits of the location and orientation of the fan assembly 18 relative to the backrest 14 is that a user having long hair will most likely not have his/her hair pulled into the air intake 82 of a given fan unit 58, since the fan assembly 18 is located toward the bottom 22 of the backrest 14, and since the air intake 82 is oriented substantially downward (i.e., away from where one's hair would be in contact with the airflow guide 20 of the chair assembly 10).

As shown in FIG. 5, at least a portion of the fan assembly 18 of the chair assembly 10 may be located between the airflow guide 20 and the back side 28 of the backrest 14. This airflow guide 20 of the chair assembly 10 is substantially impermeable to airflow and defines at least a portion of an airflow chamber 86 of the chair assembly 10. Accordingly, substantially all airflow entering the airflow chamber 86 of the chair assembly 10 by way of the fan assembly 18 is required to exit the airflow chamber 86 by passing through the backrest 14 (e.g., as shown by arrows AF3, AF4, AF5). Still referring to FIG. 5, a distance D1 between the bottom 22 of the backrest 14 and an opposing portion of a bottom of the airflow guide 20 is greater than a distance D2 between the top 24 of the backrest 14 and an opposing portion of a top of the airflow guide 20. Accordingly, the airflow guide 20 angles at least generally toward the top 24 of the backrest 14 and angles at least generally away from the bottom 22 of the backrest 14. This angling arrangement of the interior of the airflow guide 20 relative to the back side 28 of the backrest 14 may beneficially enhance the likelihood of desired airflow be detectable along a substantial entirety of the front side 26 the backrest 14.

The airflow guide 20 may be substantially constructed of any appropriate material (e.g., synthetic or natural) such as, but not limited to vinyl polyester, nylon, or a combination thereof. Further, the airflow guide 20 is shown as being substantially pliable in the illustrated embodiment (represented by the waves/undulations in the airflow guide 20). This construction may promote the chair assembly 10 being lightweight and/or easy to store. However, other embodiments may include an airflow guide that is substantially rigid (e.g., constructed of a molded plastic).

Figure 2:
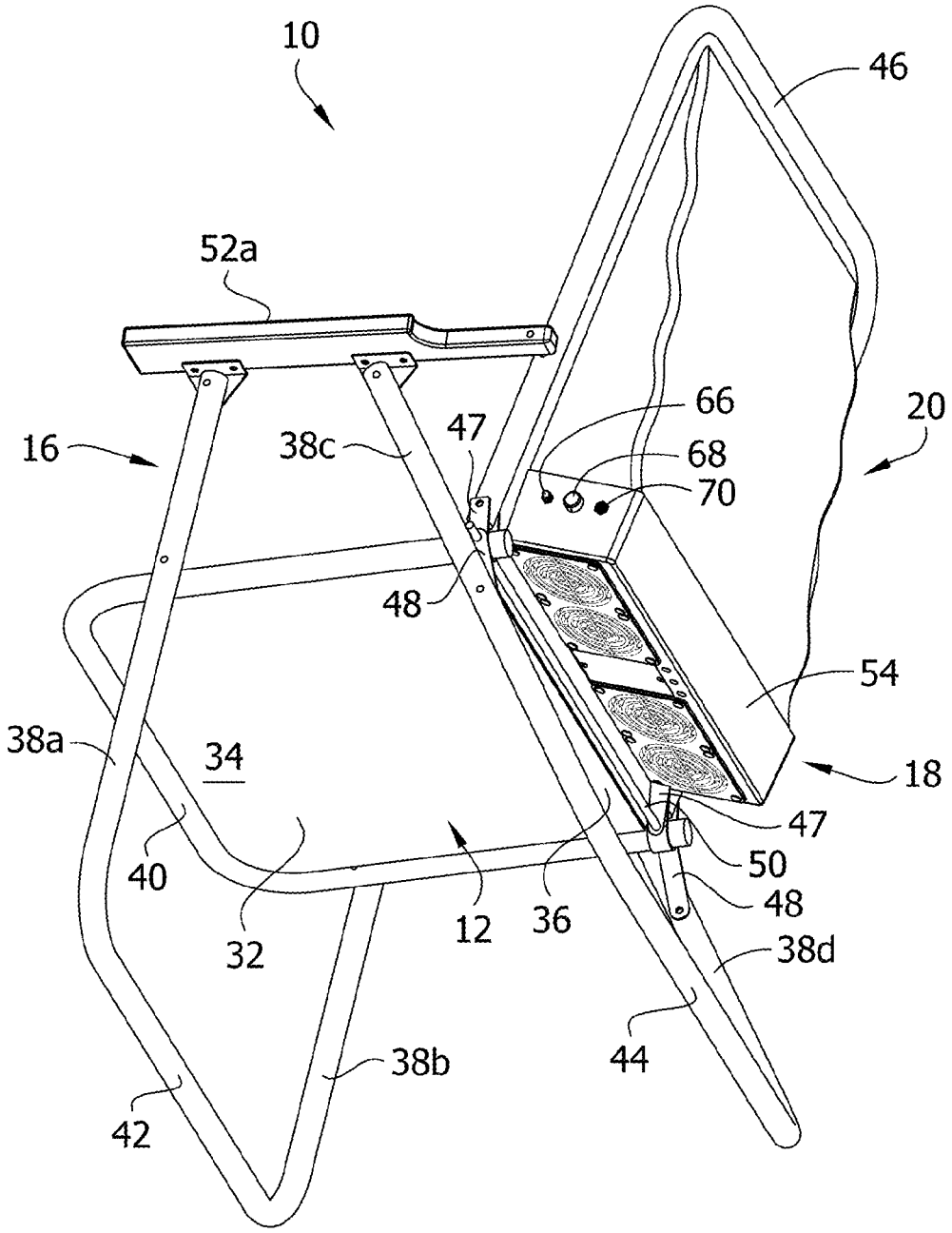
Figure 3:
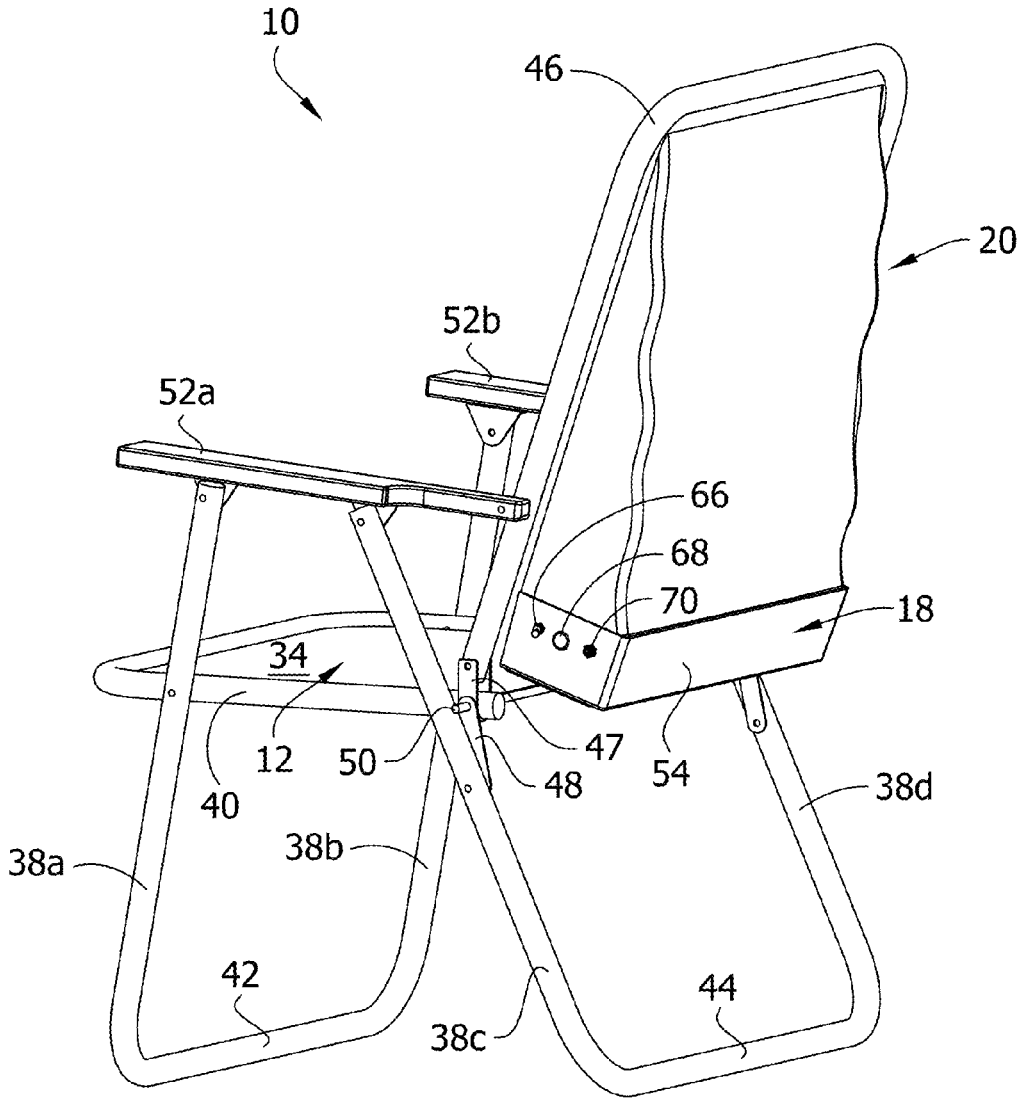
Figure 4:
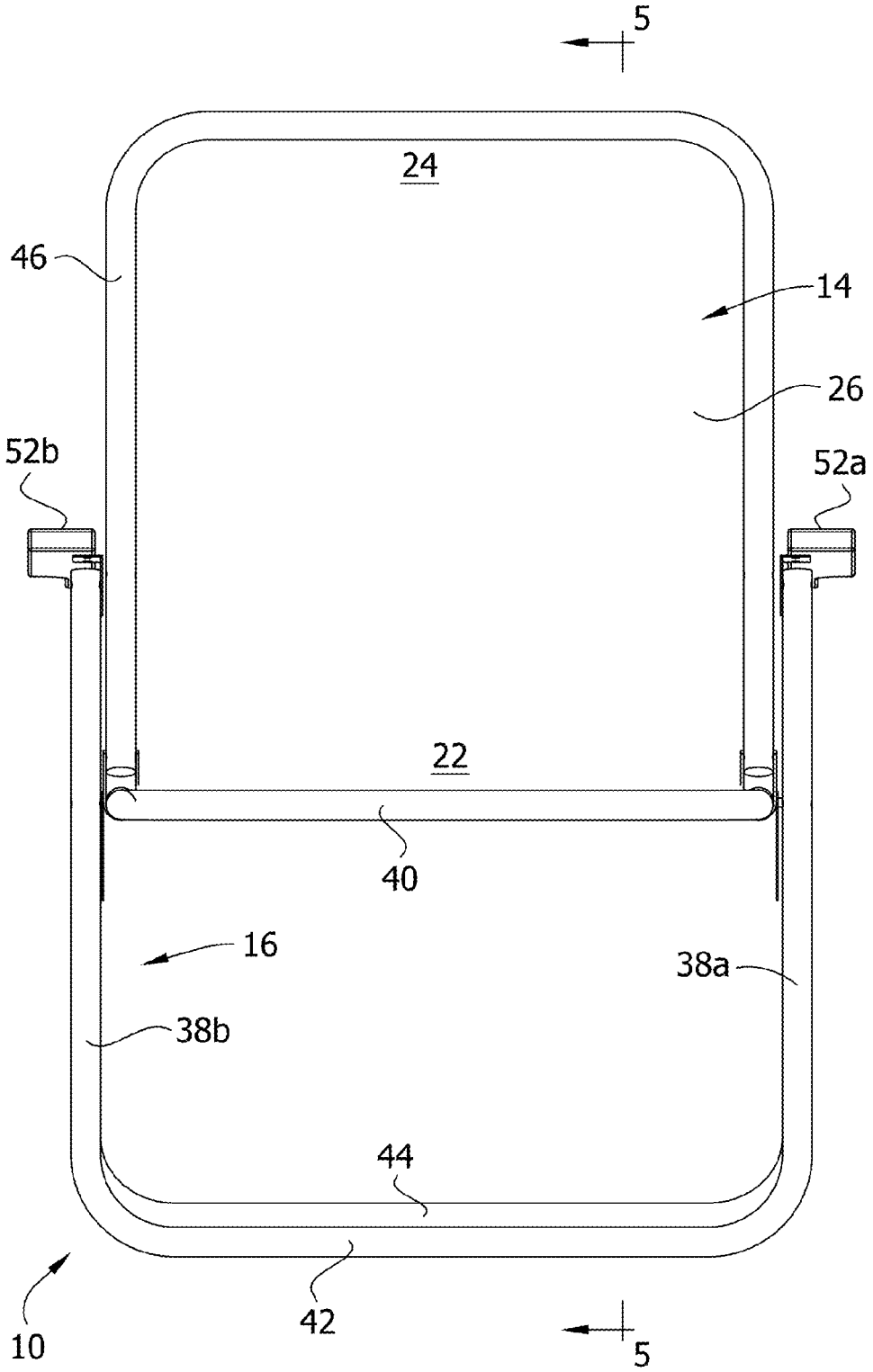
FIG. 4 is a front elevation of the chair assembly of FIGS. 1-3.

The airflow guide 20 may exhibit any appropriate size and dimensions. For instance, the airflow guide 20 may substantially extend an entire length of the backrest 14 between the top 24 and the bottom 22 thereof as shown in FIG. 5. Further, the airflow guide 20 may substantially extend an entire width of the backrest 14 between a right side and a left side thereof, for instance, as shown in FIGS. 2-3. This airflow guide 20 may be associated with the backrest 14 (e.g., the back side 28 thereof) in any appropriate manner (e.g., using adhesive, heat welding, ultrasonic bonds, mechanical fasteners, and/or the like). For example, the airflow guide 20 may be attached to the top 24 of the backrest 14 and/or a part of the backrest portion 46 of the frame 16 located adjacent the top 24 of the backrest 14. Additionally and/or alternatively, the airflow guide 20 may be attached to a left side and/or a right side of the backrest 14 (e.g., the back side 28 thereof), or to a part of the backrest portion 46 of the frame 16 located adjacent the left side of the backrest 14 and/or a part of the backrest portion 46 of the frame 16 located adjacent the right side of the backrest 14. In addition to being associated with the backrest 14, the airflow guide 20 may be attached to the fan assembly 18 in any appropriate mariner (e.g., adhesives, mechanical fasteners, etc.).

Figure 8:
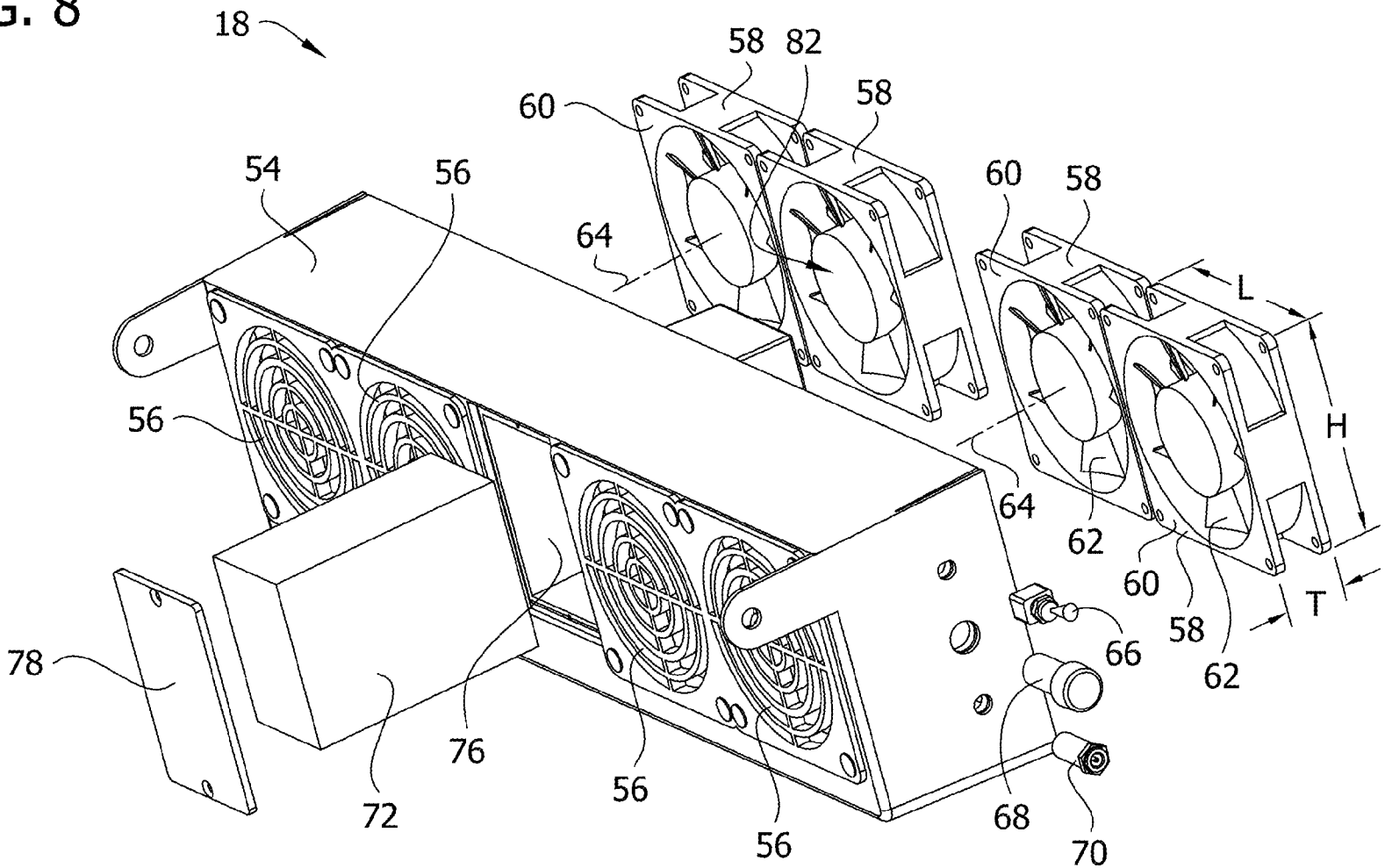
FIGS. 8-9 are exploded views of the fan assembly shown in FIG. 7.
Figure 9:
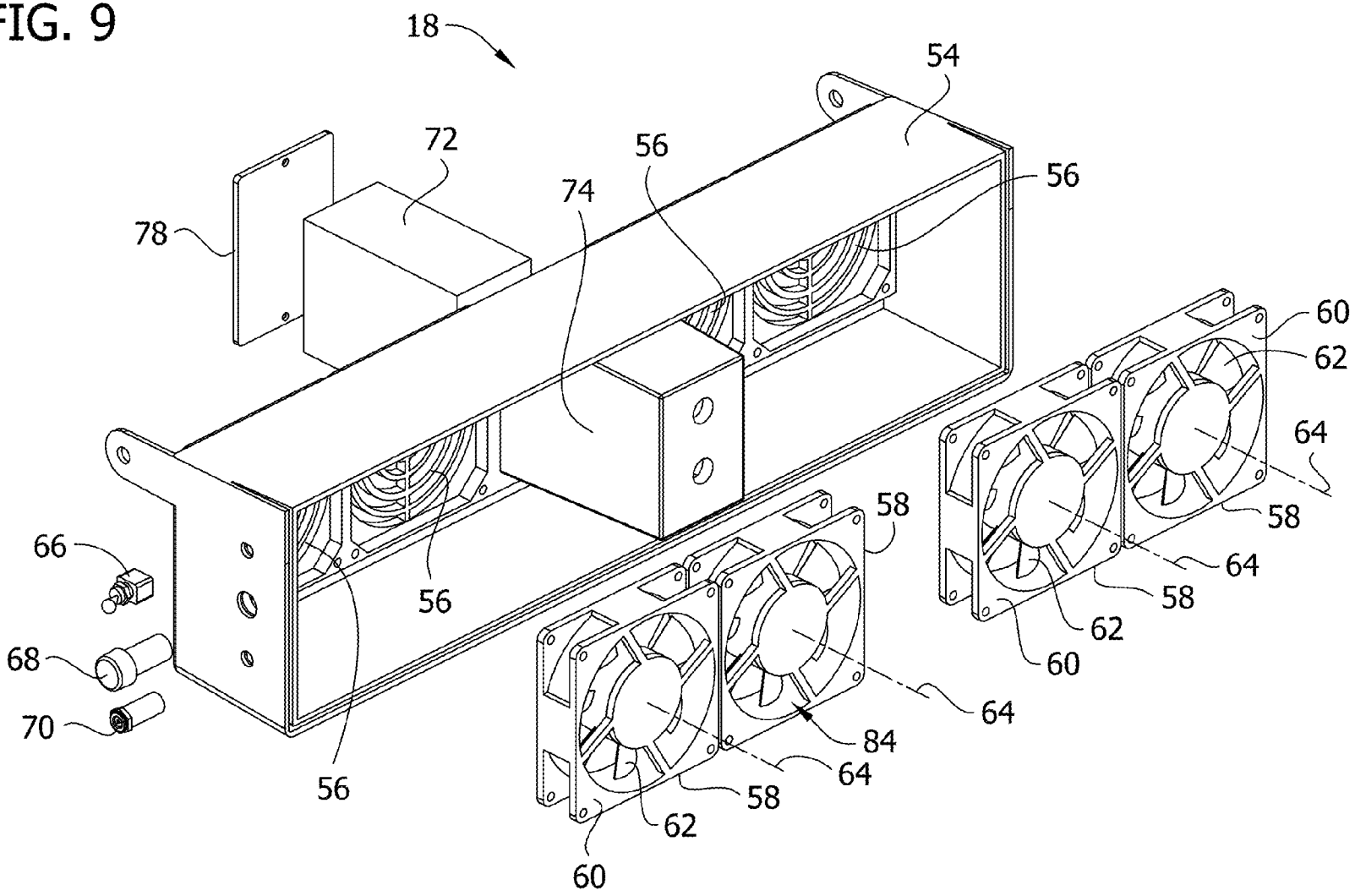
Figure 10:
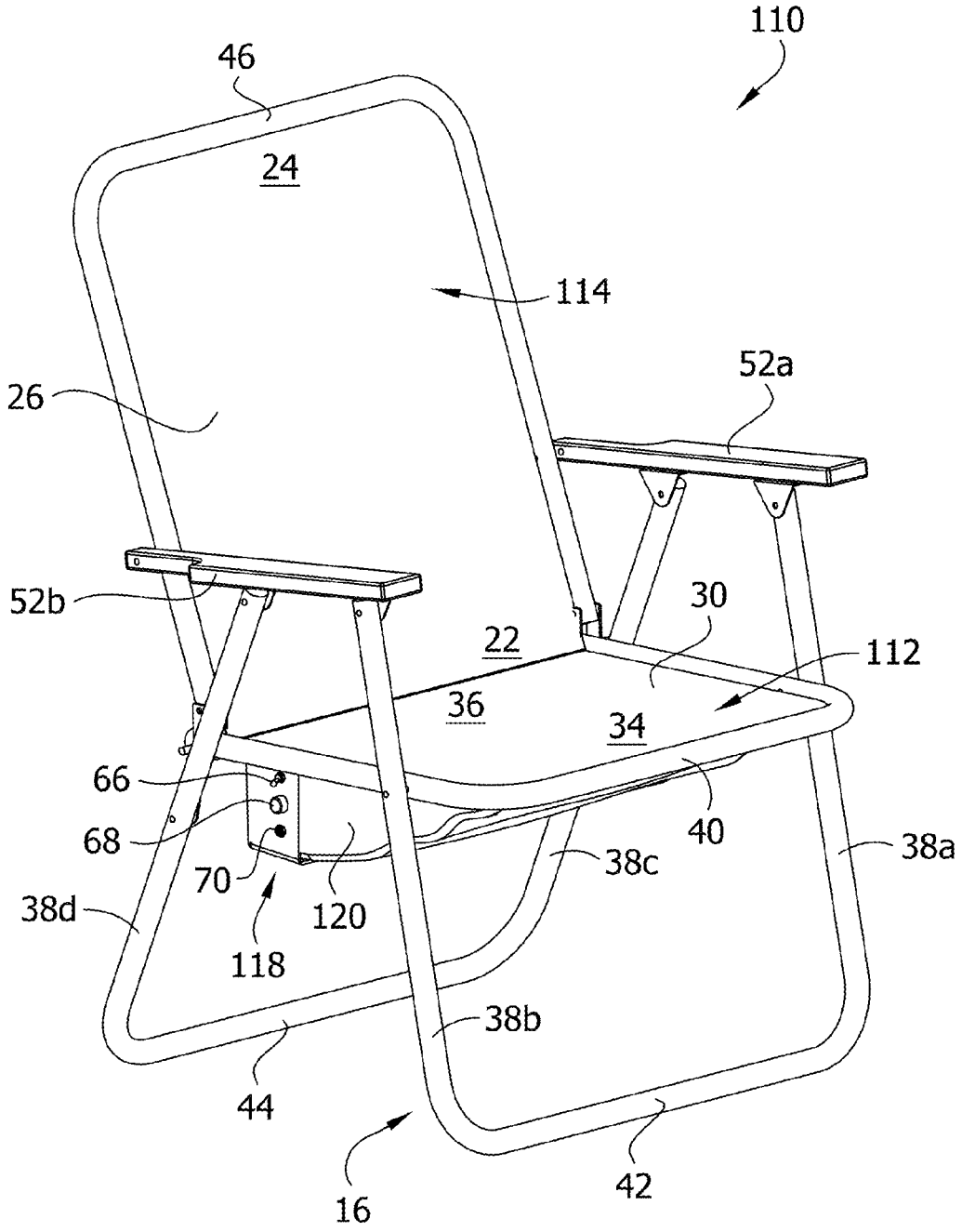
FIGS. 10-11 are perspective views of another chair assembly.
Figure 11:
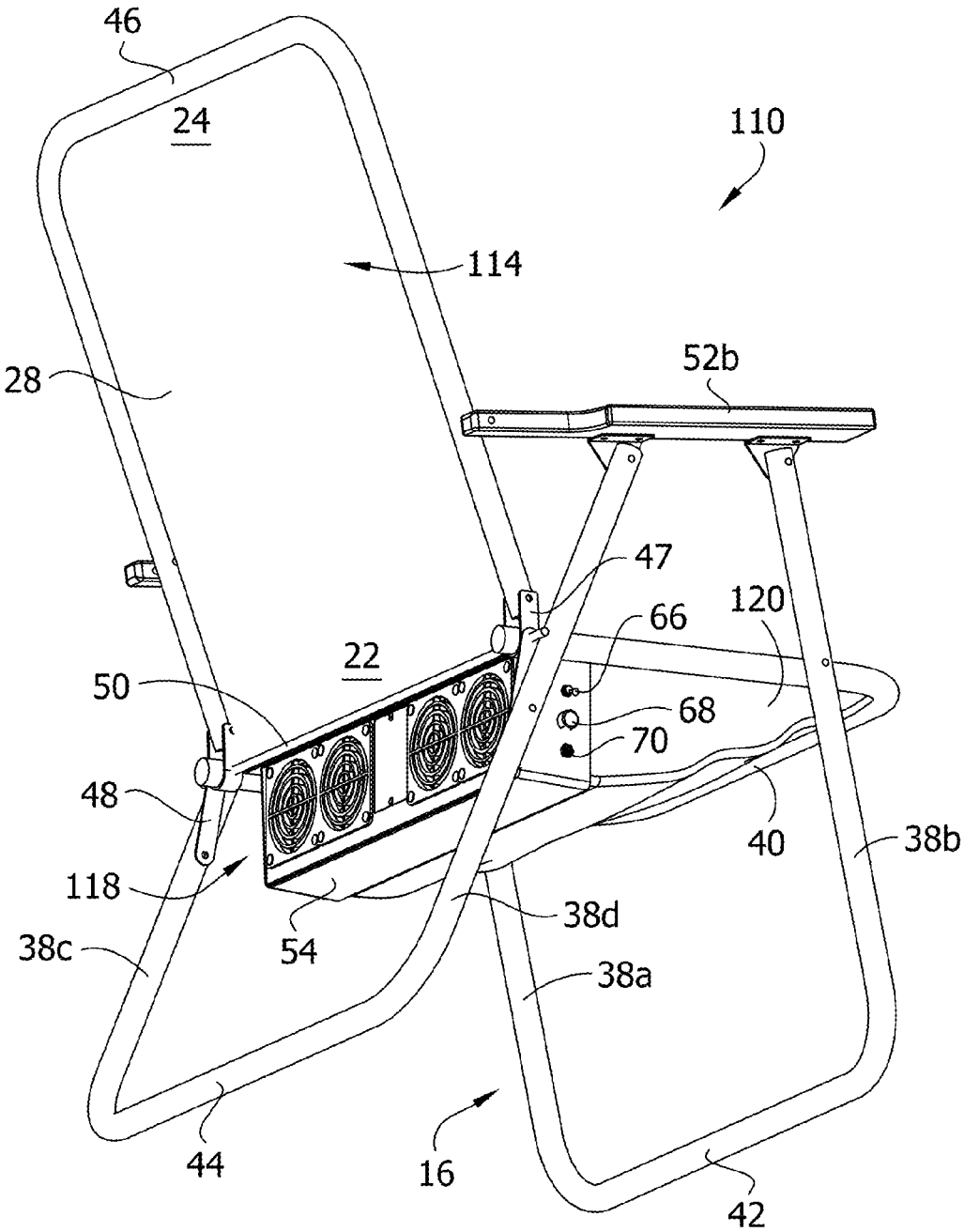

The various component of the fan assembly 18 can be viewed in FIGS. 8-10. The housing 54 of the fan assembly 18 includes a plurality of vents 56 to allow air to enter the housing 54. While the illustrated housing 54 includes four vents 56, fan assemblies (e.g., the housings thereof) associated with other embodiments may include any other appropriate number of vents (e.g., 1, 2, 3, etc.). Further, while each of the vents 56 is shown as a plurality of arcuate slits in the housing 54 of the fan assembly 18, other embodiments may include vents of other appropriate designs/configurations. This housing 54 of the fan assembly 18 may include in its construction any appropriate materials. For instance, a majority of the housing 54 may be constructed of plastic.

The fan assembly 18 is powered using a rechargeable battery 72. As such, the housing 54 of the fan assembly 18 includes a battery compartment 74 designed to house the battery 72. An example of one battery that could be employed by the fan assembly 18 is the PS-1251 FP Rechargeable Sealed Lead Acid Battery (12 Volt 5.4 AH) manufactured by Power-Sonic Corporation of San Diego, Calif. As shown in FIGS. 8-10, at least one fan unit 58 (here, two fan units) is located on one side of the battery compartment 74, and at least another fan unit 58 (here again, two fan units) is located on another side of the battery compartment 74 substantially opposite the one side. Other embodiments may exhibit other appropriate locations for the battery compartment; however, putting an equal number of fan units on each side of the battery compartment, and locating the battery compartment toward a central portion of the housing 54 may provide symmetry and/or balance to the chair assembly 10 that may be found beneficial to some users (e.g., easier to lift and/or carry if weight is distributed more evenly).

The battery compartment 74 of the fan assembly 18 includes a recess 76 designed to accommodating the battery 72 and in which are appropriate contacts (not shown) for conveying power from the battery 72 to each of the fan units 58. The battery compartment 74 also includes a cover 78 that can be attached to the housing 54 of the fan assembly 18 to occlude an opening into the recess 76 of the battery compartment 74, thus inhibiting unintentional dissociation of the battery 72 from inside the battery compartment 74. This cover 78 can be attached to the housing 54 of the fan assembly 18 in any appropriate manner including, but not limited to, use of friction fit, mechanical fasteners, snap fittings, and the like. Other embodiments may exhibit other appropriate designs for the battery compartment 74 and/or its components.

On one side of the housing 54 of the fan assembly 18 are located a power switch 66, a fuse assembly 68, and a charging jack 70. The power switch 66 is shown as being a toggle switch but could be any other appropriate mechanism for turning the power to the fan units on and off. Further, the power switch 66 is preferably disposed on a side of the housing 54 so that a user of the chair assembly 10 can easily reach it while sitting on the chair assembly. That being said, other embodiments may include other appropriate locations for the power switch 66 (e.g., on a side of the housing 54 that includes the vents 56). The fuse assembly 68 generally houses a replaceable fuse (not shown) designed to protect the fan units 58 from exposure to excessive electrical current. An example of an appropriate fuse and fuse assembly that could be used with the fan assembly 18 include model number 03440012X manufactured by Littelfuse Inc., of Chicago, Ill. While the fuse assembly 66 is shown as being located on the same side of the housing 54 as the power switch 66, other embodiments may have a fuse assembly located in any of a number of other appropriate locations on the housing 54. While not necessarily preferred, other embodiments may not include a fuse assembly. Turning to the charging jack 70, an electrical cord (not shown) can be plugged into the jack 70 with the other end of the cord being plugged into a standard AC electrical outlet to charge the battery 72. In some embodiments, the electrical cord may include a AC/DC converter to convert AC power from the electrical outlet to DC power that may then provided to the battery 72 to charge the same.

In use, electrical power is carried from an AC outlet via a cord through the charging jack 70 and delivered to the battery 72 via appropriate circuitry in the housing 54 of the fan assembly 18. Further, moving the power switch 66 from the "off" position to the "on" position causes a circuit between the battery 72 and the fan units 58 to close, thus allowing power from the battery 72 to pass through the fuse assembly 68 and to the various fan units 58. Moving the power switch 66 from the "on" position to the "off" position causes the circuit between the battery 72 and the fan units 58 to open, thus preventing power from the battery 72 from reaching the various fan units 58.

Associated with each vent 56 of the housing 54 of the fan assembly 18 is a corresponding fan unit 58. While the illustrated fan assembly 18 includes four fan units 58, fan assemblies associated with other embodiments may include any other appropriate number of fan units (e.g., 1, 2, 3, etc.). Each of the fan units 58 illustrated in FIGS. 8-10 includes a motor (not shown), a case 60, a propeller 62, and a central axis 64 about which the propeller 62 rotates. The propeller 62 of a given fan unit 58 may be any of a number of appropriate sizes and include any number of appropriate fan blades. When a given fan unit 58 is receiving power from the battery 72 of the fan assembly 18, the motor thereof is energized and causes the propeller to rotate rapidly about the central axis, thus generating airflow through the fan unit 58.

Referring specifically to FIG. 8, the central axis 64 of each fan unit 58 is substantially aligned with a direction of airflow from the fan unit (represented by dashed arrows AF1 and AF2). Further, the central axes 64 of at least two (in this case, all four) of the fan units 58 are substantially parallel with one another. Other embodiments of the fan assembly 18 may include other appropriate fan unit designs/configurations. Examples of appropriate fan units that could be employed in the fan assembly 18 shown in FIGS. 8-10 include, but are not limited to: the Spire Fan 92.times.92.times.25 mm 3 pin #SP0902551M3 manufactured by Spire China Electric Corp., Ltd. of Shenzhen, China; the Mechatrortics 92.times.25 mm High Speed 12 Volt Fan #G9225X12B2-FSR manufactured by Mechatronics, Inc., of Preston, Wash.; the Delta FFB0912SH 92.times.25 mm Super High Speed Fan manufactured by Delta Electronics, Inc. of Samutprakarn, Thailand; and the Delta PFB0912DHE 92.times.38 mm Drastic High Speed Fan also manufactured by Delta Electronics, Inc.

The case 60 of a given fan unit 58 may be any of a number of appropriate sizes. For instance, some fan units tend to be distributed by manufacturers based on standard dimensional sizes of the various cases in which the other fan components are housed. In particular, the cases of many fan units have a length and a height that are substantially equal, and a thickness that tends to be less than each of the length and the width. Since the dimensions of the length and height for the cases of many fan units are generally equal, a fan unit of a given size (e.g., an 80 mm fan, a 92 mm fan, or a 120 mm fan) generally refers to the dimensional height and length of the case for that particular fan unit. FIG. 9 shows that the case 60 of a given fan unit 58 of the fan assembly 18 has a length "L", a height "H", and a thickness "T". In the particular embodiment, each of the length "L" and height "H" of the case 60 of a given fan unit 58 may be between about 75 mm and about 125 mm in some embodiments. For example, each of the length "L" and height "H" of the case 60 may be about 80 mm, about 92 mm, or about 120 mm. In other embodiments, each of the length "L" and height "H" of the case 60 may be between about 75 mm and about 95 mm. The thickness "T" of the case 60 may be any appropriate thickness (e.g., between about 15 mm and about 70 mm). Yet other embodiments may exhibit case dimensions (e.g., fan unit sizes) of other appropriate magnitudes.

FIGS. 10-14 illustrate another embodiment of a chair assembly 110. Where the chair assembly 110 of FIGS. 10-14 has features like that of the chair assembly 10 of FIGS. 1-6, like reference numerals will be utilized to illustrate such features. Further, the corresponding description of those respective features in regard to the chair assembly 10 of FIGS. 1-6 should also apply to the like-numbered features of the chair assembly 110 shown in FIGS. 10-14. For instance, the description of the frame 16 and armrests 52*a*, 52*b* of the chair assembly 10 is equally applicable to the frame 16 and armrests 52*a*, 52*b* of the chair assembly 110. Further, the seat 112 and the backrest 114 of the chair assembly 110 can be attached to the frame 16 in any manner described above with regard to seat 12 and the backrest 14 the chair assembly 10.

With respect the chair assembly 110 of FIGS. 10-14, each of the seat 112 and the backrest 114 may be made of any of the materials described in regard to the seat 12 and backrest 14 of the chair assembly 10 and may be made from the same or different material(s) as each other. However, since a fan assembly 118 is associated with (e.g., directly and/or indirectly attached to) the seat 112 of the chair assembly 110 (instead of the backrest 14 of the chair assembly 10), it is generally preferred that the seat 112 include (e.g., be substantially constructed of) a material that allows airflow to pass therethrough. For instance, the seat 112 may include a material that is substantially porous (including, but not limited to, weaves, screens, and meshes). The backrest 114 may or may not include a material that allows airflow to pass therethrough (e.g., is substantially porous).

The fan assembly 118 of the chair assembly 110 shown in FIGS. 10-14 includes the same componentry as the fan assembly 18 shown in and described with regard to FIGS. 1-9. However, the location and orientation of the fan assembly 118 (relative to the chair assembly 110) differs from that of the fan assembly 18 (relative to the chair assembly 10). In particular, the fan assembly 118 of the chair assembly 110 is associated with the rear 36 of the seat 112 such that the fan assembly 118 is attached to the rear 36 of the seat 112 and/or the seat portion 40 of the frame 16 of the chair assembly 110 adjacent the rear 36 of the seat 112. In this specific embodiment, the fan assembly 118 is attached to the rear 36 of the seat 112 at the bottom side 32 thereof. This attachment can be accomplished in any appropriate manner (e.g., e.g., using welds, adhesives, and/or mechanical fasteners). Further, the fan assembly 118 is also attached to the frame 16 of the chair assembly 110 by way of the pivot rod 50 extending through at least a portion of the housing 54 of the fan assembly 118.

Like the fan assembly 18 of the chair assembly 10, each fan unit of the fan assembly 118 has both an air intake 82 and an air output 84 such that air enters a given fan unit via the air intake 82 and exits the fan unit via the air output 84. This enables air to flow through the fan assembly 118 in the general manner indicated by arrows AF1 and AF2 of FIGS. 8 and 13. Like the fan assembly 18 of the chair assembly 10, the fan assembly 118 of the chair assembly 110 has four air intakes 82 and four corresponding air outputs 84. As shown best in FIG. 13, each air intake 82 generally faces away from the front 34 of the seat 112, and the air output 84 generally faces toward the front 34 of the seat 112. As such, the fan assembly 118 of the chair assembly 110 is positioned such that airflow therefrom (e.g., arrows AF1 and AF2) is oriented generally frontward toward the front 34 of the seat 112. Another characterization may be that the fan assembly 118 is positioned such that airflow therefrom is generally oriented in a direction from by the rear 36 of the seat 112 to toward the front 34 of the seat 112. Accordingly, and as is shown in FIG. 13, a distance between the air intake 82 and the backrest 114 (e.g., the bottom 22 thereof) may be less than a distance between the air output 84 and the backrest 114 (i.e., the backrest 114 is closer to the air intake 82 than it is to the air output 84).

Figure 13:
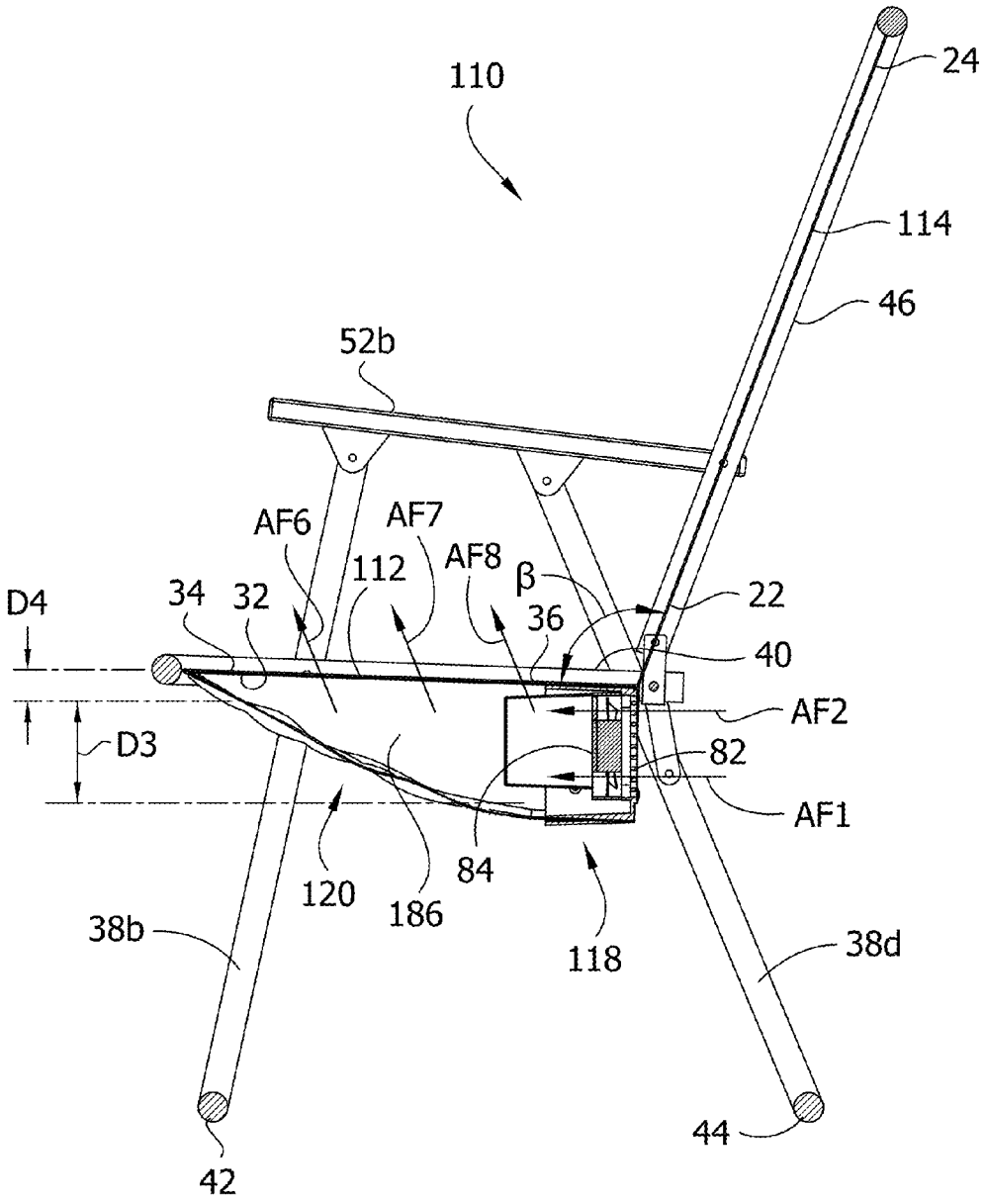
FIG. 13 is a cross-section of the chair assembly of FIGS. 10-12 taken along line E-E shown in FIG. 12.
Figure 14:
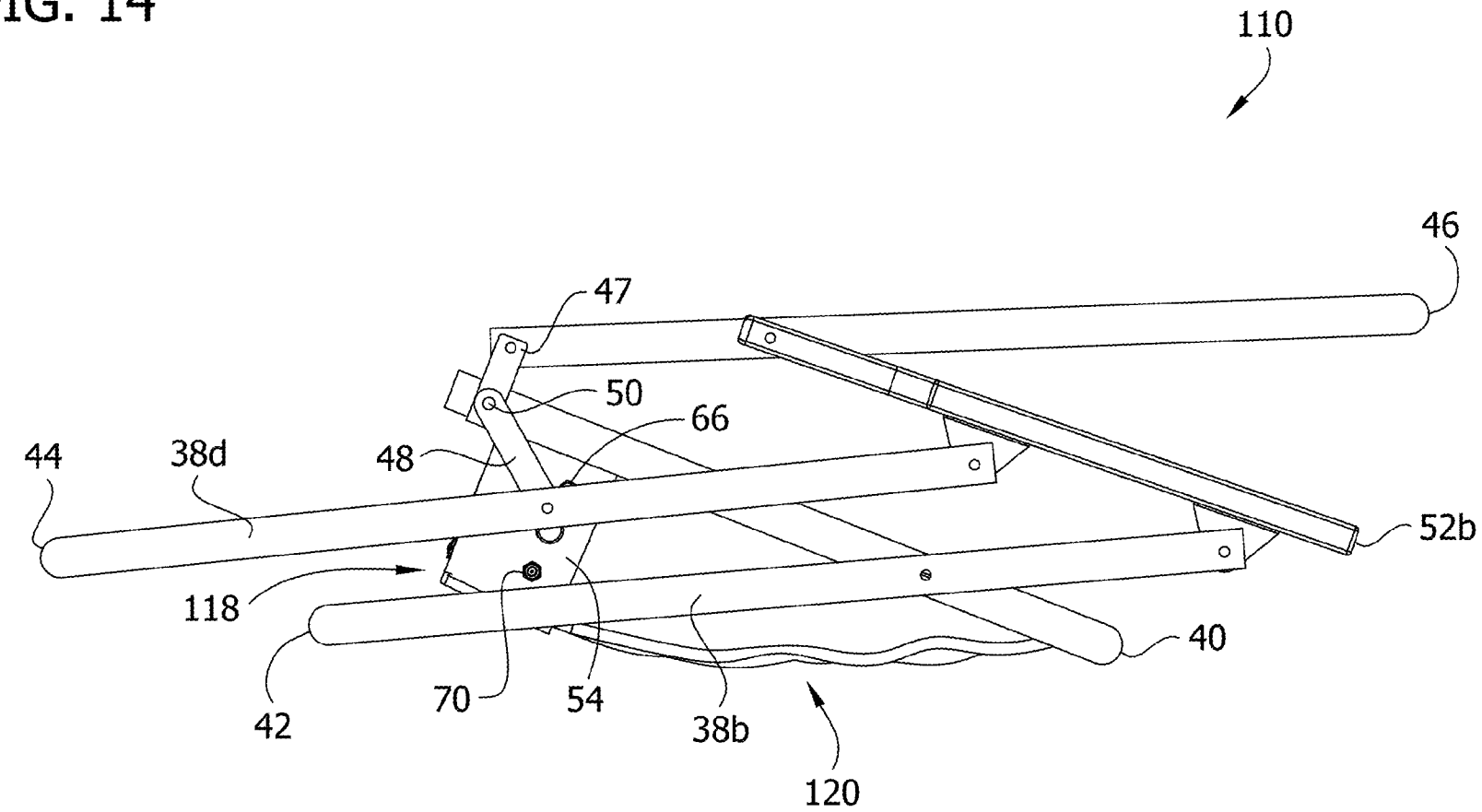
FIG. 14 is a side elevation of the chair assembly of FIGS. 10-13 in a closed condition.
Figure 15:
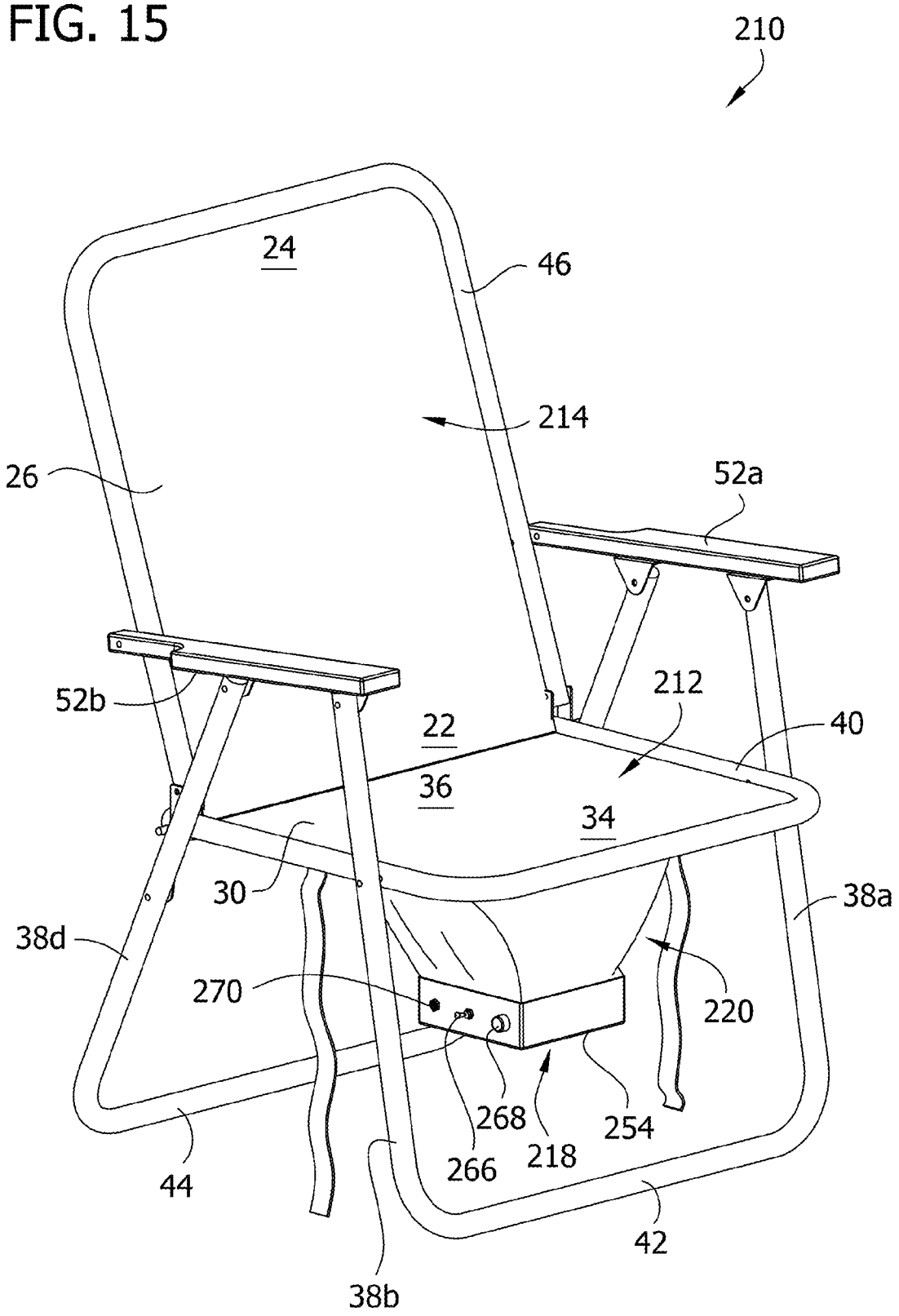
FIGS. 15-16 are perspective views of yet another chair assembly.
Figure 16:
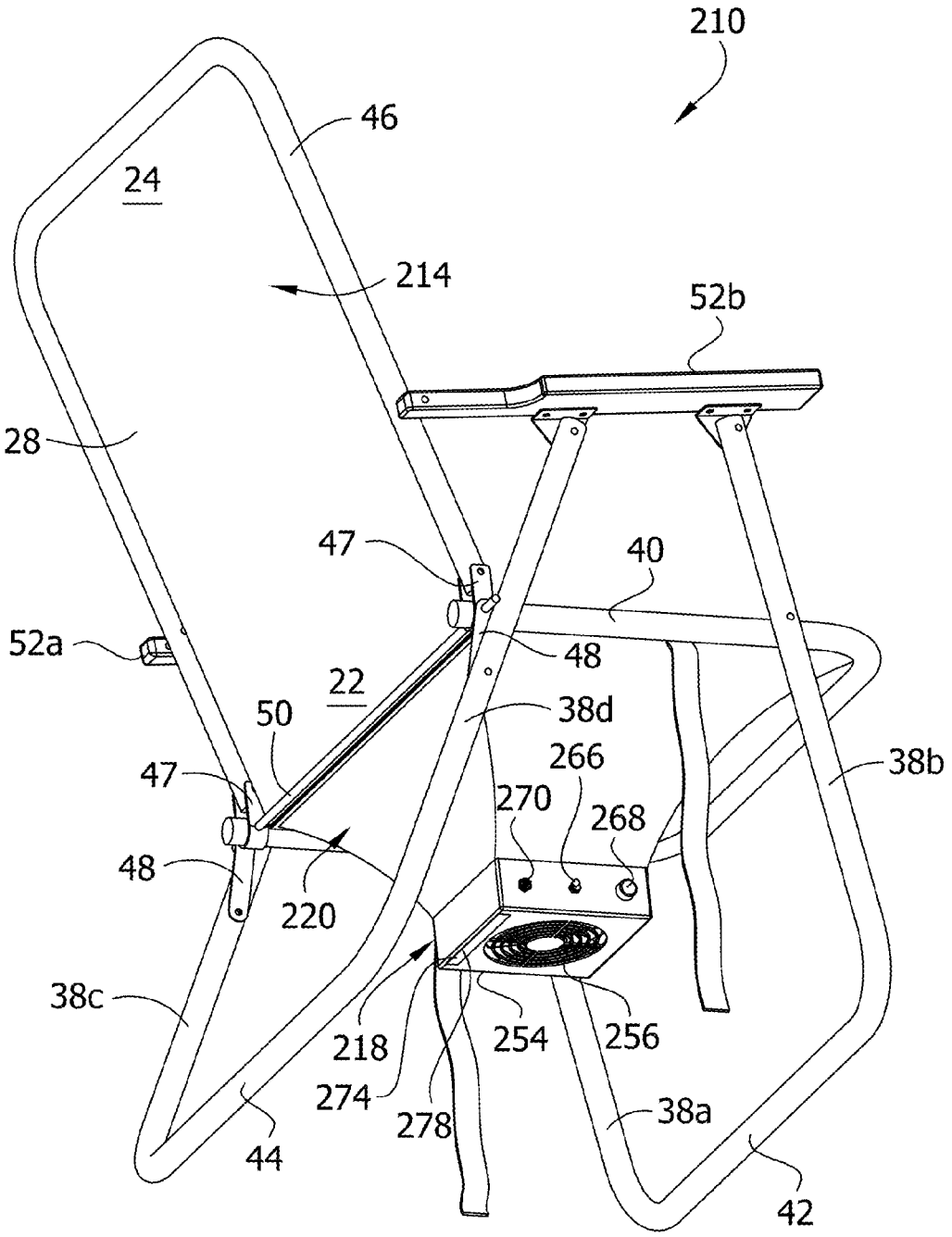
Figure 17:
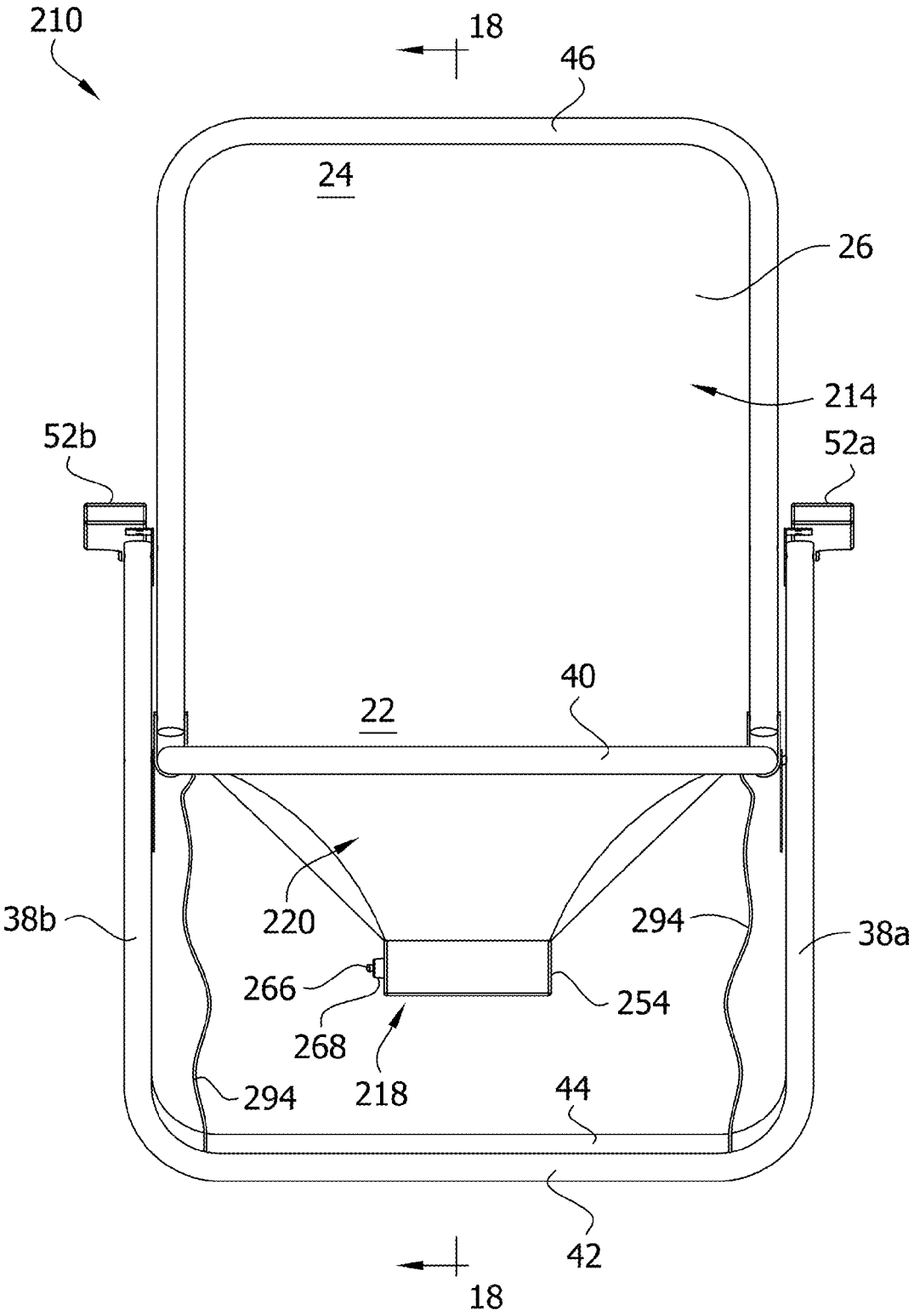
FIG. 17 is front elevation of the chair assembly of FIGS. 15-16.

As shown in FIG. 13, at least a portion of the fan assembly 118 of the chair assembly 110 may be located between an airflow guide 120 of the chair assembly 110 and the bottom side 32 of the seat 112. This airflow guide 120 of the chair assembly 110 is substantially impermeable to airflow and defines at least a portion of an airflow chamber 186 of the chair assembly 110. Accordingly, substantially all airflow entering the airflow chamber 186 of the chair assembly 110 by way of the fan assembly 118 is required to exit the airflow chamber 186 by passing through the seat 112 (e.g., as shown by arrows AF6, AF7, AF8). Still referring to FIG. 13, a distance D3 between the rear 36 of the seat 112 and an opposing portion of a rear of the airflow guide 120 is greater than a distance D4 between the front 34 of the seat 112 and an opposing portion of a front of the airflow guide 120. Accordingly, the airflow guide 120 angles at least generally toward the front 34 of the seat 112 and angles at least generally away from the rear 36 of the seat 112. This angling arrangement of the interior of the airflow guide 120 relative to the bottom side 32 of the seat 112 may beneficially enhance the likelihood of desired airflow be detectable along a substantial entirety of the top side 30 the seat 112.

The airflow guide 120 of the chair assembly 110 may be substantially constructed of any appropriate material such as any material discussed in regard to the airflow guide 20 of the chair assembly 10. Further, the airflow guide 120 is shown as being substantially pliable in the illustrated embodiment (represented by the waves/undulations in the airflow guide 120). This construction may promote the chair assembly 110 being lightweight and/or easy to store. However, other embodiments may include an airflow guide that is substantially rigid (e.g., constructed of a molded plastic).

Figure 12:
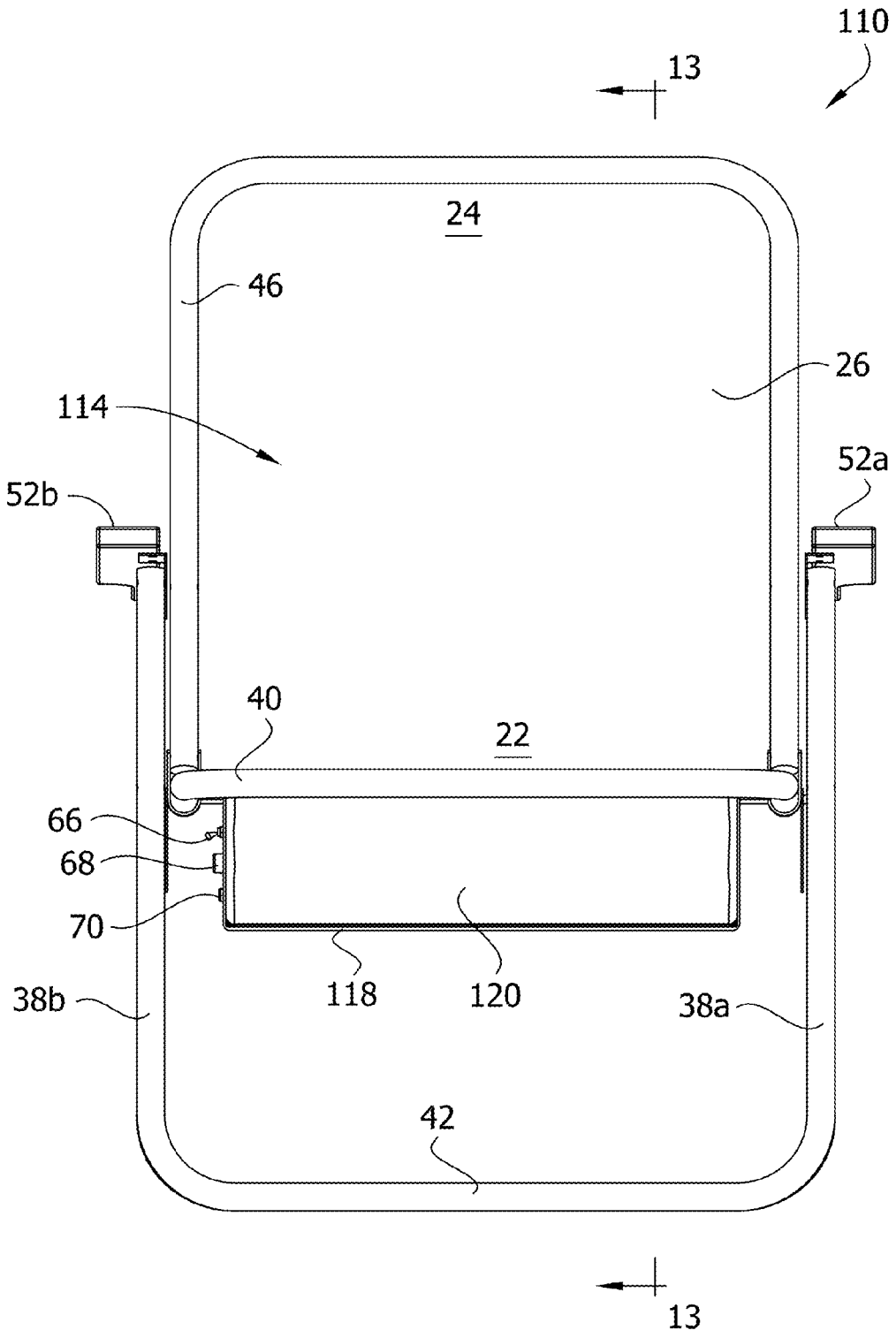
FIG. 12 is front elevation of the chair assembly of FIGS. 10-11.

The airflow guide 120 may exhibit any appropriate size and dimensions. For instance, the airflow guide 120 may substantially extend an entire length of the seat 112 between the front 34 and the rear 36 thereof as shown in FIG. 13. In some embodiments, the airflow guide 120 may substantially extend an entire width of the seat 112 between a right side and a left side thereof as shown in FIG. 12. Further, the airflow guide 120 may be associated with the seat 112 in any appropriate manner (e.g., using adhesive, heat welding, ultrasonic bonds, mechanical fasteners, and/or the like). For example, the airflow guide 120 may be attached to the front 34 of the seat 112 (e.g., the bottom side 32 thereof) and/or a part of the seat portion 40 of the frame 16 located adjacent the front 34 of the seat 112. Additionally and/or alternatively, the airflow guide 120 may be attached to a left side and/or a right side of the seat 112 (e.g., the bottom side 32 thereof), or to a part of the seat portion 40 of the frame 16 located adjacent the left side of the seat 112 and/or a part of the seat portion 40 of the frame 16 located adjacent the right side of the seat 112. In addition to be associated with the seat 112, the airflow guide 120 may be attached to the fan assembly 118 in any appropriate manner.

Significant sound emitted due to operation of a fan assembly (e.g., 18 and/or 118) may be undesirable to some users. In this regard, some users may find significant background noise associated with operation of a given fan assembly to be distracting and/or disruptive. As such, a maximum level of sound (e.g., noise) emitted due to operation of a fan assembly of a given chair assembly may be no greater than about 65 dBA in some embodiments, no greater than about 60 dBA in other embodiments, no greater than about 55 dBA in yet other embodiments, and no greater than about 50 dBA in still other embodiments. In some embodiments, a maximum level of sound emitted due to operation of a fan assembly may be between about 40 dBA and about 65 dBA, or between about 45 dBA and about 60 dBA. Other embodiments may have fan assemblies exhibiting maximum sound levels of other appropriate magnitudes and/or ranges.

By way of example, sound measurement testing was conducted using one embodiment of the chair assembly 10 having a fan assembly 18 equipped with four JMC 902614-4 73CFM fan units and a Power Sonic PS-1227 2.9 Ah battery. The sound measurements were acquired using a 3M Quest Technologies Model 2200 S/N: KOK050010 (SPL Setting; Fast Response; A Weighting; Background Level: <30 dBA). Table 1 below summarizes the data that was acquired in the sound measurement testing when an individual was seated on the seat 12 with his back against the backrest 14 of the chair assembly 10. Table 2 below summarizes the data that was acquired in the sound measurement testing when no one was seated in the chair assembly 10.

TABLE 1

| | With Person Seated | | | | |
|---|---|---|---|---|---|
| | At Ear Level | 3 Ft in front of chair | 6 Ft in front of chair | 3 Ft behind chair | 6 Ft behind chair |
| dBA | 58.5 | 49 | 48.3 | 51.2 | 49.3 |

TABLE 2

| | Open Chair | | | | |
|---|---|---|---|---|---|
| | At Ear Level | 3 Ft in front of chair | 6 Ft in front of chair | 3 Ft behind chair | 6 Ft behind chair |
| dBA | 60 | 55.2 | 52.2 | 50.1 | 48.6 |

Referring to both the chair assemblies 10 and 110, a maximum level of sound (e.g., noise) emitted due to operation of each individual fan unit 58 of a given fan assembly may be no greater than about 60 dBA in some embodiments, no greater than about 50 dBA in other embodiments, no greater than about 45 dBA in still other embodiments, no greater than about 40 dBA in yet other embodiments, no greater than about 35 dBA in even other embodiments, and no greater than about 30 dBA in still yet other embodiments. In some embodiments, a maximum level of sound emitted due to operation of each fan unit 58 may be between about 20 dBA and about 50 dBA, or between about 25 dBA and about 45 dBA. Still other embodiments may have fan units 58 exhibiting maximum sounds levels of other appropriate magnitudes and/or ranges.

A fan assembly (e.g., 18 or 118) of a given chair assembly (e.g., 10 or 110) may provide any of a number of suitable airflow outputs. It may be preferred by some that airflow provided by a given fan assembly be such that a user can feel the same (e.g., realize a desired cooling effect) when sitting in a chair assembly. In some embodiments, the magnitude of desired airflow may have to be balanced against the noise produced by the fan assembly such that the resulting airflow can be maximized while minimizing background noise due to operation of the fan assembly. For instance, a maximum airflow output of a given fan assembly may be no more than about 350 cubic feet per minute (CFM) in some embodiments, no more than about 300 CFM in other embodiments, no more than about 250 CFM in still other embodiments, no more than about 200 CFM in yet other embodiments, no more than about 150 CFM in even other embodiments. In some embodiments, the maximum airflow output of a given fan assembly may be between about 150 CFM and about 325 CFM, or between about 175 CFM and about 300 CFM. The maximum airflow output of a given fan assembly may be no less than about 125 CFM in other embodiments. Still other embodiments may have fan assemblies exhibiting maximum airflow outputs of other appropriate magnitudes and/or ranges.

Again, referring to both the chair assemblies 10 and 110, a maximum airflow output of each fan unit 58 of a given fan assembly may be no more than about 70 CFM in some embodiments, no more than about 65 CFM in other embodiments, no more than about 60 CFM in still other embodiments, no more than about 55 CFM in yet other embodiments, no more than about 50 CFM in even other embodiments, and no more than about 45 CFM is still yet other embodiments. In other embodiments, the maximum airflow output of each fan unit 58 may be no more than about 40 CFM, no more than about 35 CFM, no more than about 30 CFM, or even no more than about 25 CFM. In some embodiments, the maximum airflow output of each fan unit 58 may be between about 20 CFM and about 60 CFM, or between about 25 CFM and about 55 CFM. Still other embodiments may have fan units 58 exhibiting maximum airflow outputs of other appropriate magnitudes and/or ranges.

FIGS. 15-19 illustrate yet another embodiment of a chair assembly 210. Where the chair assembly 210 of FIGS. 15-19 has features like that of the chair assembly 10 of FIGS. 1-6 and/or the chair assembly 110 of FIGS. 10-14, like reference numerals will be utilized to illustrate such features. Further, the corresponding description of those respective features in regard to the chair assembly 10 of FIGS. 1-6 and/or the chair assembly 110 of FIGS. 10-14 should also apply to the like-numbered features of the chair assembly 210 shown in FIGS. 15-19. For instance, the description of the frame 16 and armrests 52*a*, 52*b* of the chair assembly 10 is equally applicable to the frame 16 and armrests 52*a*, 52*b* of the chair assembly 210. Further, the seat 212 and the backrest 214 of the chair assembly 210 can be attached to the frame 16 in any manner described above with regard to seat 12 and the backrest 14 the chair assembly 10.

With respect the chair assembly 210 of FIGS. 15-19, each of the seat 212 and the backrest 214 may be made of any of the materials described in regard to the seat 12 and backrest 14 of the chair assembly 10 and may be made from the same or different material(s) as each other. However, since a fan assembly 218 is associated with (e.g., directly and/or indirectly attached to) the seat 212 of the chair assembly 210 (instead of the backrest 14 of the chair assembly 10), it is generally preferred that the seat 212 include (e.g., be substantially constructed of) a material that allows airflow to pass therethrough. For instance, the seat 212 may include a material that is substantially porous (including, but not limited to, weaves, screens, and meshes). The backrest 214 may or may not include a material that allows airflow to pass therethrough (e.g., is substantially porous).

In contrast to the fan assemblies 18 and 118 shown in previous embodiments, the fan assembly 218 of the chair assembly 210 includes a single, solitary fan unit 258. An example of one fan unit that could be employed by the fan assembly 218 is the EverCool EC12025M12C120 mm 73 CFM. Other embodiments may include other appropriate quantities or types of fan units (e.g., 2, 3, 4, or 5). The fan unit 258 of the fan assembly 218 has both an air intake 282 and an air output 284 such that air enters the fan unit 258 via the air intake 282 and exits the fan unit 258 via the air output 284. This enables air to flow through the fan assembly 218 in the general manner indicated by arrows AF9 and AF10 of FIG. 18. This fan assembly 218 is oriented such that an air intake 282 of the fan unit 258 faces generally away from the bottom side 32 of the seat 212, and such that an air output 284 of the fan unit 258 faces generally toward the bottom side 32 of the seat 212. As such, the fan assembly 218 is positioned such that airflow therefrom (e.g., arrows AF9 and AF10) is oriented generally upward toward bottom side 32 of the seat 212. Another characterization may be that the fan assembly 218 is positioned such that airflow therefrom is generally oriented in a direction from below the seat 212, toward the bottom side 32 of the seat 212, and through the seat 212.

A housing 254 of the fan assembly 218 includes a vent 256 that is adjacent the fan unit 258 to allow air to enter the housing 254. While the illustrated fan assembly 218 includes a single, solitary vent 256, fan assemblies associated with other embodiments may include any other appropriate number of vents (e.g., 2, 3, 4, etc.). Further, while the vent 256 is shown as a plurality of arcuate slits in the housing 254 of the fan assembly 218, other embodiments may include vents of other appropriate designs/configurations.

The fan assembly 218 is powered using a rechargeable battery 272. As such, the housing 254 of the fan assembly 218 includes a battery compartment 274 designed to house the battery 272. An example of one battery that could be employed by the fan assembly 218 is the Power Sonic PS1227 2.9Ah. The battery compartment 274 includes a recess designed to accommodating the battery 272 and in which are appropriate contacts (not shown) for conveying power from the battery 272 to the fan unit 258. The battery compartment 274 also includes a cover 278 that can be attached to the housing 254 of the fan assembly 218 to occlude an opening into the recess of the battery compartment 274, thus inhibiting unintentional dissociation of the battery 272 from inside the battery compartment 274. This cover 278 can be attached to the housing 254 of the fan assembly 218 in any appropriate manner including, but not limited to, use of friction fit, mechanical fasteners, snap fittings, and the like. Other embodiments may exhibit other appropriate designs for the battery compartment 274 and/or its components.

On one side of the housing 254 of the fan assembly 218 are located a power switch 266, a fuse assembly 268, and a charging jack 270. The power switch 266 is shown as being a toggle switch but could be any other appropriate mechanism for turning the power to the fan unit 258 on and off. Further, the power switch 266 is preferably disposed on a side of the housing 254 so that a user of the chair assembly 210 can easily reach it while sitting on the chair assembly. That being said, other embodiments may include other appropriate locations for the power switch 266 (e.g., on a side of the housing 254 that includes the vent 256). The fuse assembly 268 generally houses a replaceable fuse (not shown) designed to protect the fan unit 258 from exposure to excessive electrical current. An example of an appropriate fuse and fuse assembly that could be used with the fan assembly 218 includes model 03440012X manufactured by Littelfuse Inc. of Chicago, Ill. While the fuse assembly 266 is shown as being located on the same side of the housing 254 as the power switch 266, other embodiments may have a fuse assembly located in any of a number of appropriate locations on the housing 254. While not necessarily preferred, other embodiments may not include a fuse assembly. Turning to the charging jack 270, a battery charger (not shown) designed to deliver the appropriate charge can be plugged into the jack 270 and receive power from a standard AC electrical outlet (e.g., using an appropriate plug-in and cord of the charger) to charge the battery 272.

In use, electrical power is carried from an AC outlet via a cord through the charging jack 270 and delivered to the battery 272 via appropriate circuitry in the housing 254 of the fan assembly 218. Further, moving the power switch 266 from the "off" position to the "on" position causes a circuit between the battery 272 and the fan unit 258 to close, thus allowing power from the battery 272 to pass through the fuse assembly 268 and to the fan unit 258. Moving the power switch 266 from the "on" position to the "off position, causes the circuit between the battery 272 and the fan unit 258 to open, thus preventing power from the battery 272 to reach the various fan units 258.

Figure 18:
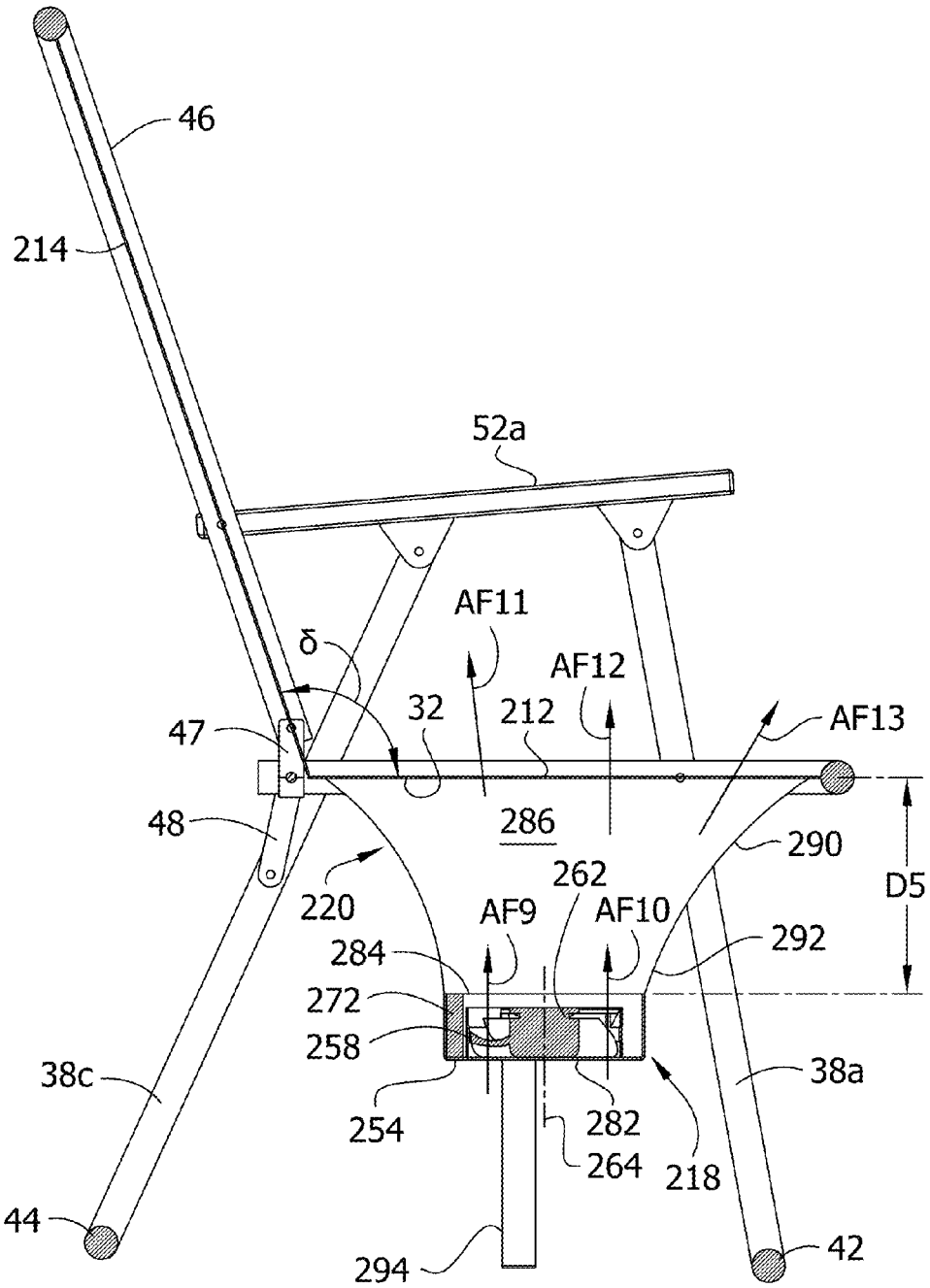
FIG. 18 is a cross-section of the chair assembly of FIGS. 15-17 taken along line F-F shown in FIG. 17.

The fan unit 258 includes a motor (not shown), a case (not shown), a propeller 262, and a central axis 264 about which the propeller 262 rotates. The propeller 262 of the fan unit 258 may be any of a number of appropriate sizes and include any number of appropriate fan blades. Referring specifically to FIG. 18, the central axis 264 of the fan unit 258 is substantially aligned with a direction of airflow from the fan unit (represented by dashed arrows AF9 and AF10). Other embodiments of the fan assembly 218 may include other appropriate fan unit designs/configurations.

The case of the fan unit 258 may be any of a number of appropriate sizes. For instance, some fan units tend to be distributed by manufacturers based on standard dimensional sizes of the various cases in which the other fan components are housed. In particular, the cases of many fan units have a length and a height that are substantially equal, and a thickness that tends to be less than each of the length and the width. Since the dimensions of the length and height for the cases of many fan units are generally equal, a fan unit of a given size (e.g., an 80 mm fan, a 92 mm fan, or a 120 mm fan) generally refers to the dimensional height and length of the case for that particular fan unit. The fan unit 258 may be a 92 mm fan in some embodiments, a 120 mm fan in other embodiments, or an even bigger fan in yet other embodiments.

The chair assembly 210 of FIGS. 15-19 includes an airflow guide 220 associated with the bottom side 32 of the seat 212 in a manner such that a top portion 290 the airflow guide 220 is attached to the bottom side 32 of the seat 212 and/or the seat portion 40 of the frame 16 adjacent the bottom side 32 of the seat 212. In addition, a bottom portion 292 the airflow guide 220 is attached to the fan assembly 218 (e.g., the housing 254 thereof) such that the airflow guide 220 is located at least generally between the bottom side 32 of the seat 212 and the fan assembly 218. Further, the airflow guide 220 at least generally tapers from near the bottom side 32 of the seat 212 toward the fan assembly 218 (e.g., in a generally frustoconical and/or frustopyramidal fashion).

Figure 19:
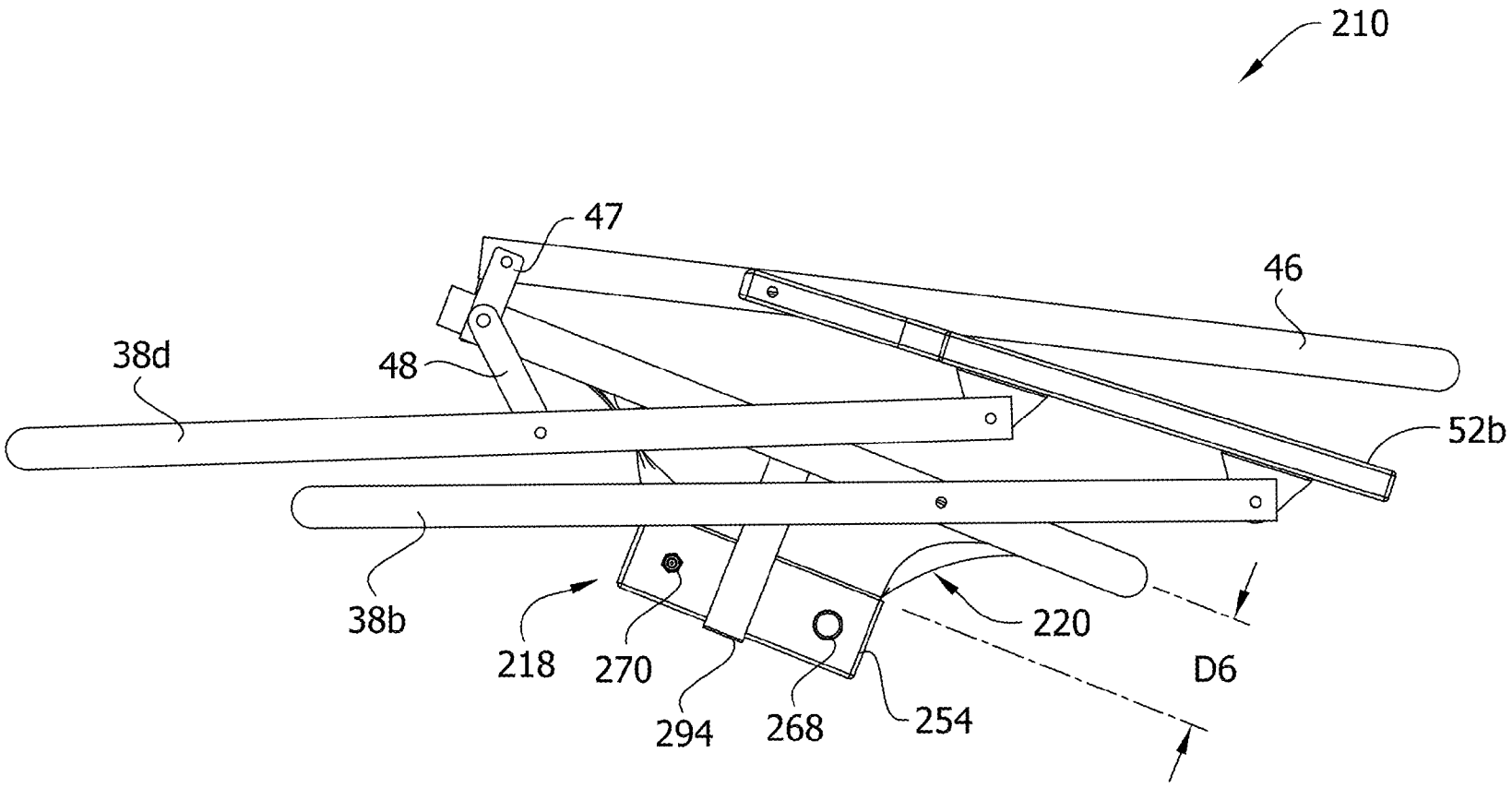
FIG. 19 is a side elevation of the chair assembly of FIGS. 15-18 in a closed condition.

The airflow guide 220 is substantially constructed of a pliable material that is substantially impermeable to airflow (e.g., coated fabric or closed weave fabric of natural or synthetic materials). Thus, it is generally preferred that substantially all airflow entering the airflow chamber 286 of the chair assembly 210 by way of the fan assembly 218 be required to exit the airflow chamber 286 by passing through the seat 212 (e.g., as shown by arrows AF11, AF12, AF13). This pliability of the airflow guide 220 enables the fan assembly 218 to be spaced from the bottom side 32 of the seat 212 by a first distance D5 (FIG. 18) when a support mechanism 294 of the chair assembly 210 is disengaged, and spaced from the bottom side 32 of the seat 212 by a second distance D6 (FIG. 19) substantially less than the first distance D5 when the support mechanism 294 is engaged. As shown in FIG. 19, the airflow guide 220 is collapsed and folded over itself when the support mechanism 294 of the chair assembly 210 is engaged. In contrast, the airflow guide 220 is extended and unfolded when the support mechanism 294 is disengaged. This support mechanism is shown as including a plurality of straps that can be removably fastened together in any appropriate fashion (e.g., tie them together, using hook-and-loop material, a buckle, a snap, a button, a clip, a clamp, or the like).

The chair assemblies 10, 110, and 210 may be characterized as being portable (e.g., capable of being moved and/or carried with ease by a user). In addition, the chair assemblies 10, 110, and 210 may be characterized as being collapsible (e.g., capable of being moved between an open condition and a closed condition). As shown in FIG. 19, the chair assembly 212, in the closed condition, may be characterized as being a more compact size (relative to the open condition), for example, for storage and/or transport thereof. Indeed, some chair assemblies of the invention are movable between the open condition and the closed condition. In some embodiments, a chair assembly being in the open condition may refer to the chair assembly being configured to allow a user to sit on the top side 30 of the seat and place a back of the user against the front 26 of the backrest. Additionally or alternatively, the open condition of a chair assembly may refer to the top side 30 of the seat being at an angle (".alpha." of FIG. 5, ".beta." of FIG. 13, and ".delta." of FIG. 18) of between about 80 degrees and about 150 degrees relative to the front 26 of the backrest. With regard to the closed condition, in some embodiments, a chair assembly in the closed condition may be configured such that the top side 30 of the seat at least generally faces and/or is in proximity with the front 26 of the backrest. Additionally or alternatively, the closed condition of a chair assembly may refer to the top side 30 of the seat being at an angle (".alpha." of FIG. 6, ".beta." of FIG. 14, and ".delta." of FIG. 19) of between about 0 degrees and about 45 degrees relative to the front 26 of the backrest.

The chair assembly 210 may be said to be movable between an open condition (shown in FIGS. 15-18) and a closed condition (shown in FIG. 19). In the open condition, a user may sit on the top side 30 of the seat 212 and contact the front side 26 of the backrest 214 with the user's back. Further, the fan assembly 218 of the chair assembly 210 may be spaced from the bottom side 32 of the seat 212 by the first distance D5 (e.g., due to disengagement of the support mechanism 294) when the chair assembly 210 is in the open condition. In contrast, the fan assembly 218 may be spaced from the bottom side 32 of the seat 212 by the second distance D6 (which is substantially less than the first distance D5) when the chair assembly 210 is in the closed condition shown in FIG. 19. Accordingly, the closed condition of the chair assembly 210 may include the airflow guide 220 being collapsed and folded over itself (as shown in FIG. 19), and the open condition may include the airflow guide 220 being extended and unfolded (as shown in FIGS. 15-18).

A chair assembly (e.g., 10, 110, 210) may exhibit any appropriate weight. In some embodiments, it may be desirable for the chair assembly not to exceed a certain weight threshold. For instance, in the case where a chair assembly is designed to be portable, the weight of the chair assembly may be such that the chair assembly can be moved and/or carried with ease. As such, the chair assembly may have a maximum weight of no more than about 8 pounds (lbs.) in some embodiments, no more than about 7 lbs. in other embodiments, no more than about 6 lbs. in still other embodiments, and no more than about 5 lbs. in yet other embodiments. In some embodiments, the chair assembly may have a maximum weight of between about 3 lbs. and about 8 lbs. (e.g., between about 5 lbs. and about 7 lbs.). Other embodiments may have chair assemblies exhibiting maximum weights of other appropriate magnitudes and/or ranges.

In the case that a chair assembly (e.g., 10, 110, 210) of the invention is designed to be portable, the chair assembly may be equipped with one or more components designed to facilitate carrying and/or transport of the chair assembly. For instance, a chair assembly may include a handle specifically designed to enable a user to lift and/or carry the same thereby (e.g., when the chair assembly is in the closed condition). As another example, a chair assembly may be equipped with a shoulder strap or the like specifically designed to enable a user to support the weight of the chair assembly using one's shoulder(s) (e,g., when the chair assembly is in the closed condition).

Other embodiments of chair assemblies may include combinations of the features shown with regard to the chair assemblies 10, 110, and 210. For instance, one "hybrid" or "combined" embodiment may include (in addition to the frame 16) the backrest 14, fan assembly 18, and airflow guide 20 of the chair assembly 10, and (instead of the seat 12) also include the seat 112, fan assembly 118, and airflow guide 120 of the chair assembly 110. Another "hybrid" or "combined" embodiment may include (in addition to the frame 16) the backrest 14, fan assembly 18, and airflow guide 20 of the chair assembly 10, and (instead of the seat 12) also include the seat 212, fan assembly 218, and airflow guide 220 of the chair assembly 210. As such, each of these "hybrid" or "combined" embodiments would have a first fan assembly associated the seat and a second fan assembly associated with the backrest.

While the chair assemblies shown in the figures herein may be characterized by some as folding chairs, lawn chairs, deck chairs, and/or patio chairs, principles of the invention described herein are also applicable to any chair assembly such as, but not limited to, those listed above as well as, for example, chase lounge chairs, office chairs, wheel chairs, infant strollers, automobile seats, aircraft seats, and portable stadium chairs (e.g., designed to be supported by and/or releasably attached to bleachers).

Figure 21:
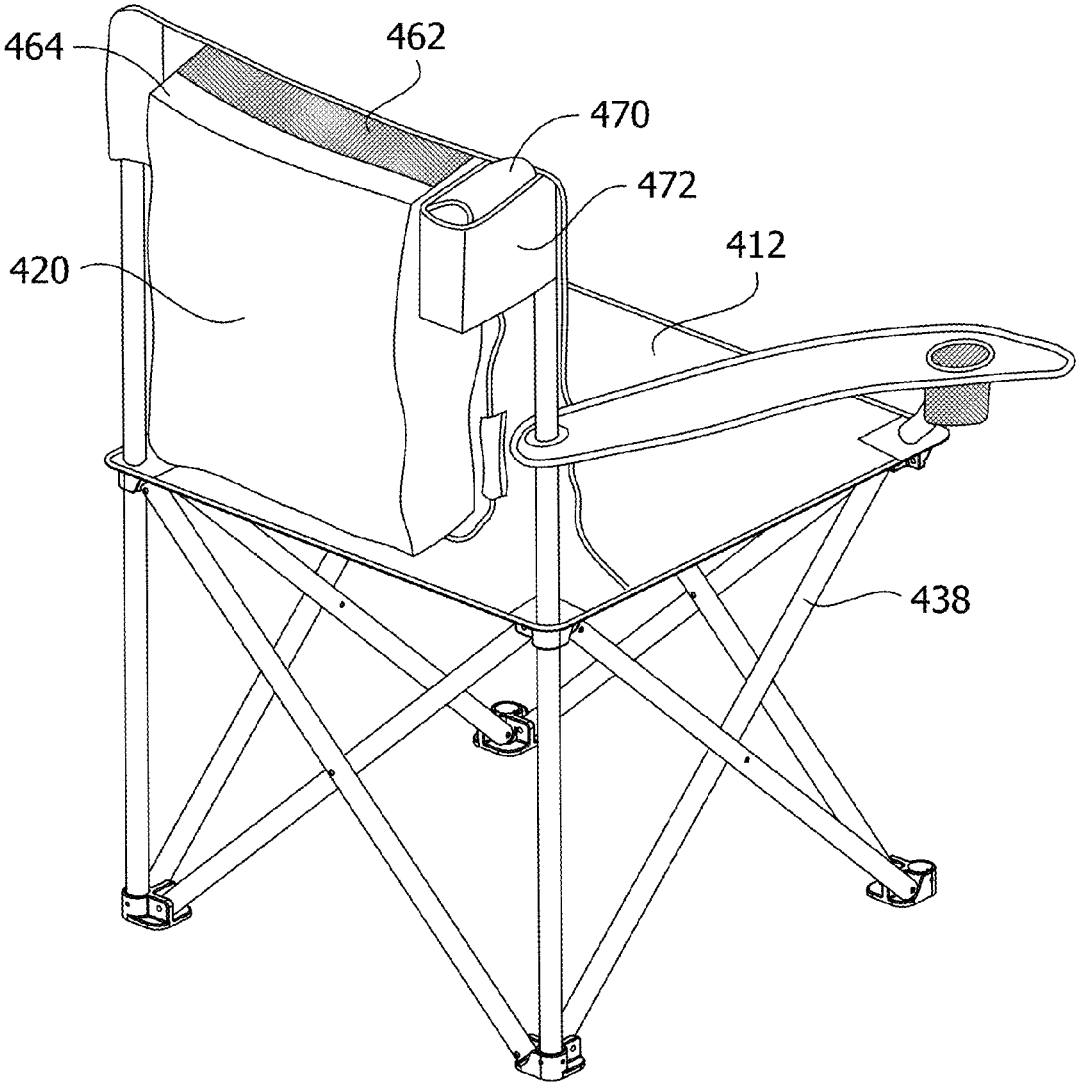
FIG. 21 is a rear perspective of the assembly of FIG. 20.
Figure 22:
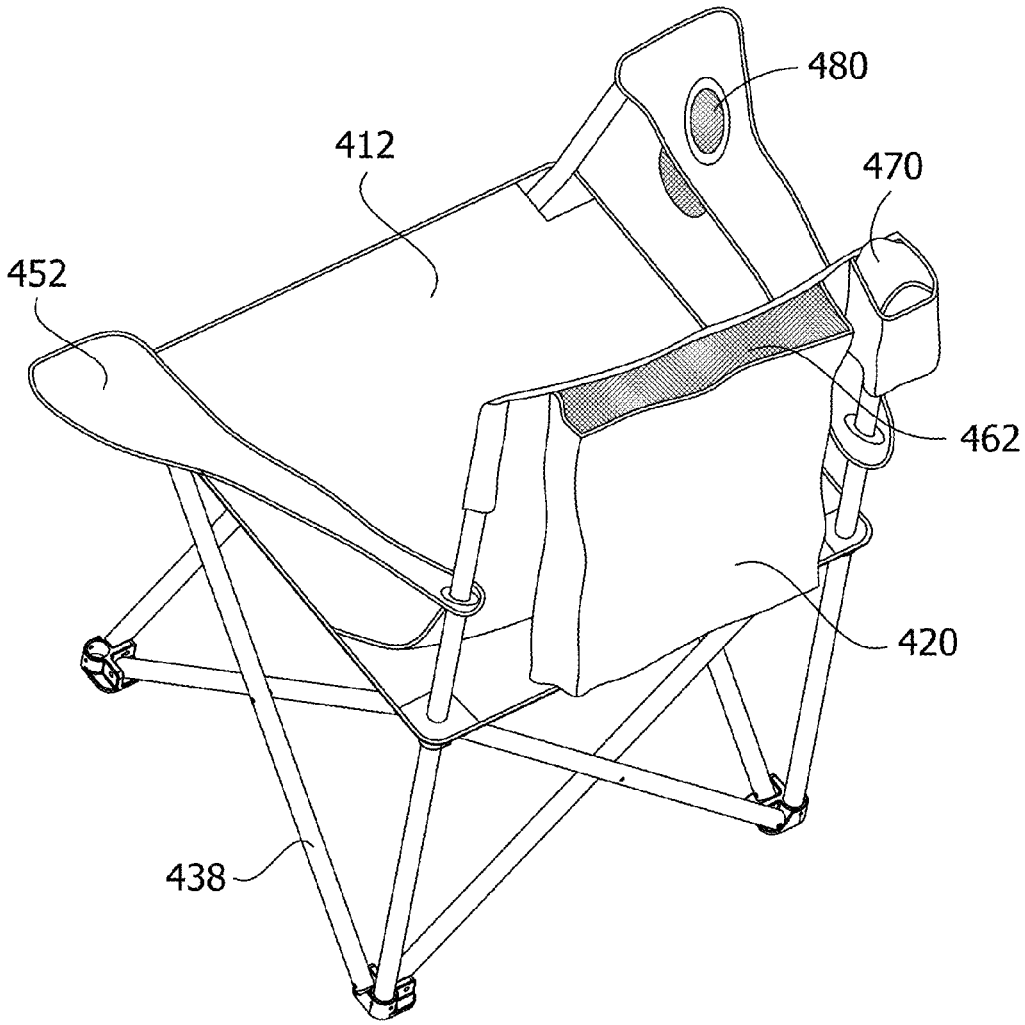
FIG. 22 is a rear perspective of the assembly of FIG. 20.
Figure 23:
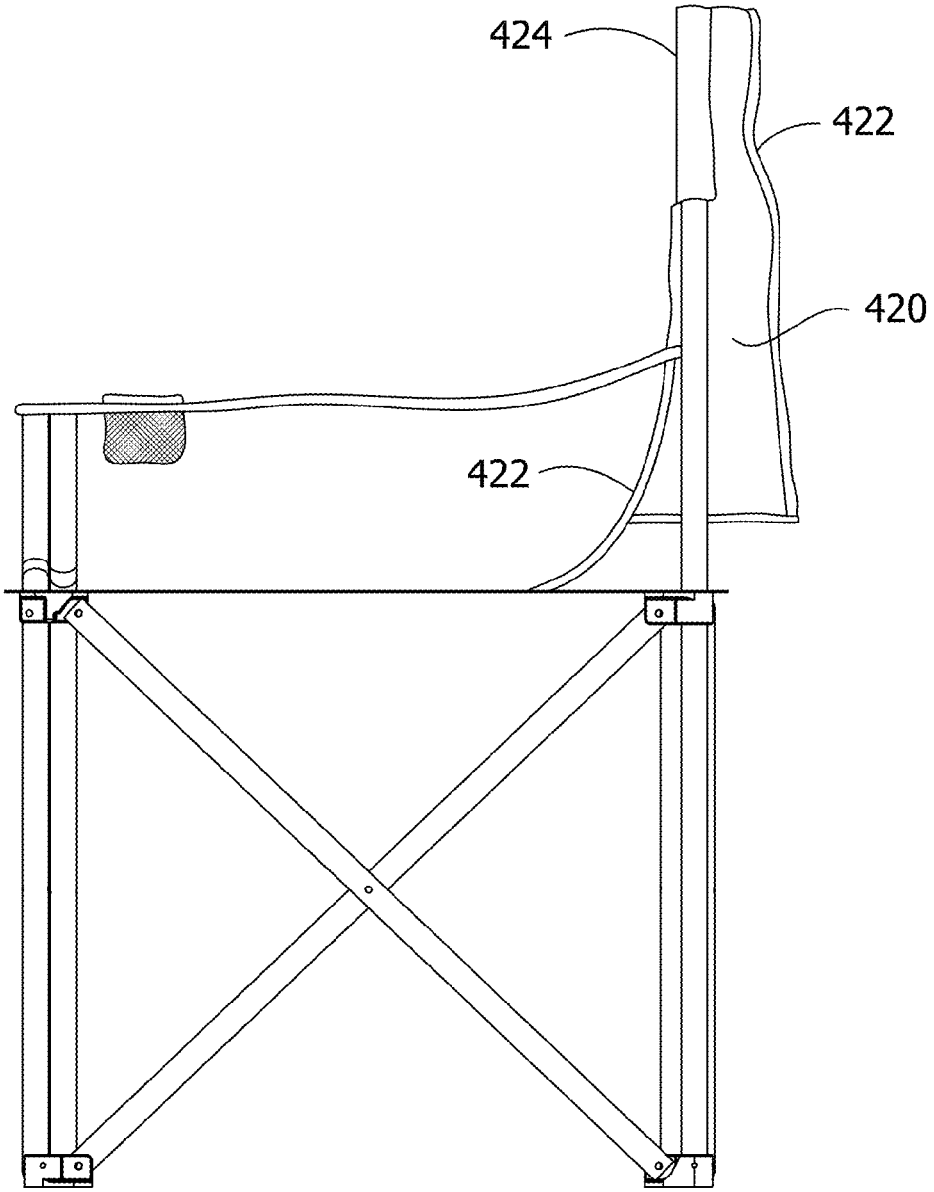
FIG. 23 is a side elevation of the assembly of FIG. 20.
Figure 24:
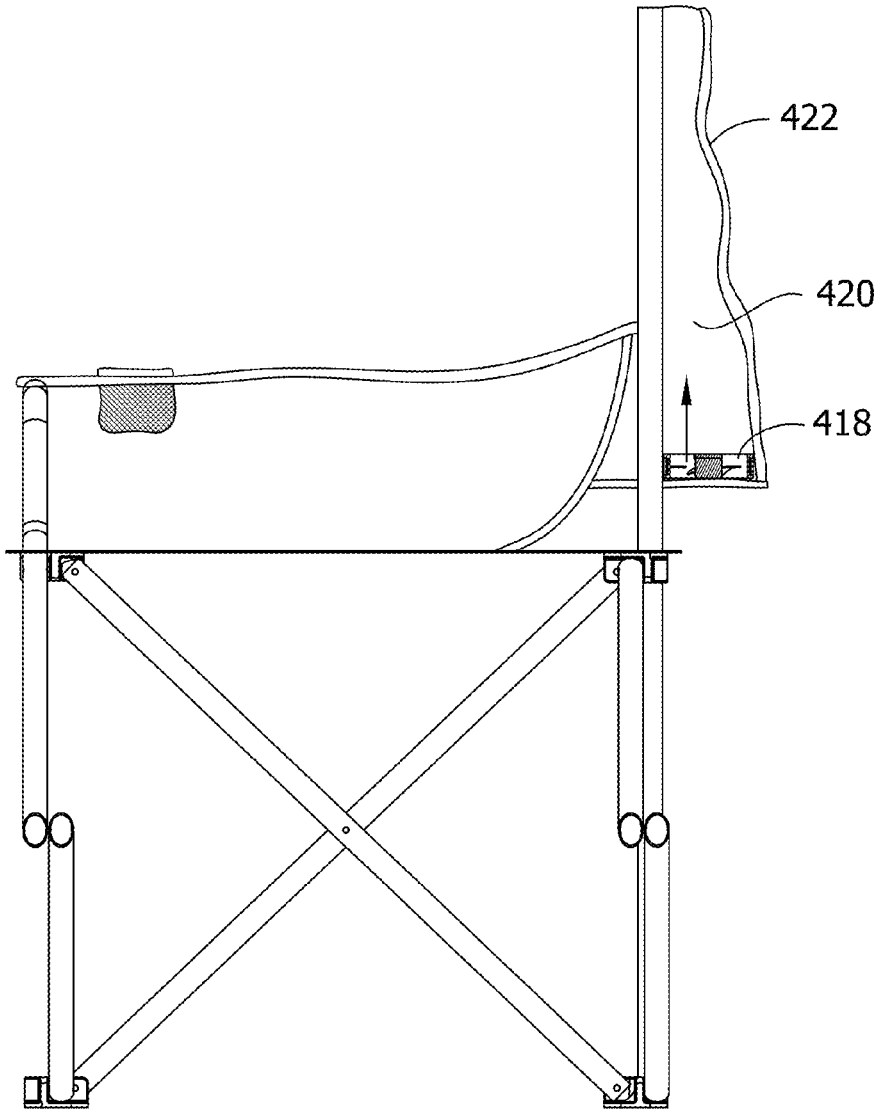
FIG. 24 is a cross-section of the assembly of FIG. 20.
Figure 25:
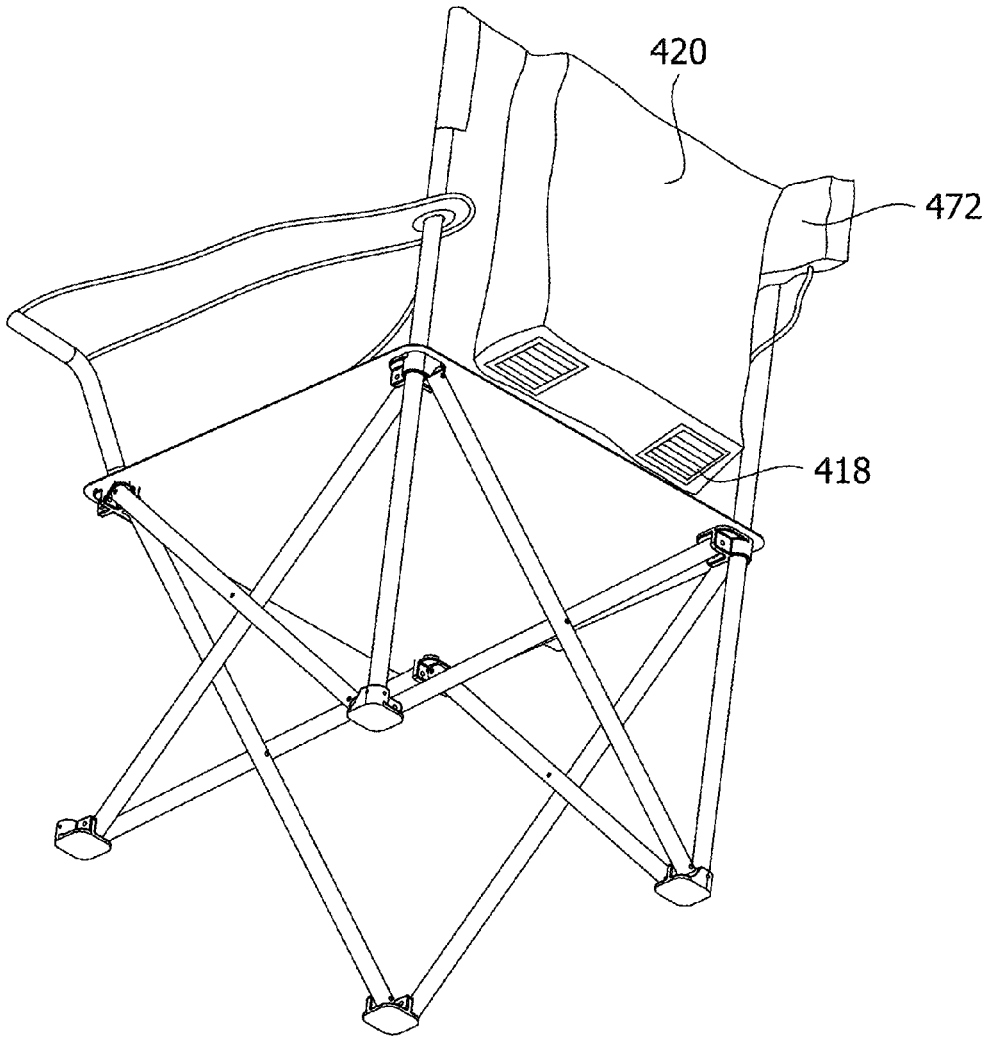
FIG. 25 is a bottom perspective of the assembly of FIG. 20.

FIGS. 20-35 illustrate some of these other chair assembly configurations. FIGS. 20-29 illustrate the invention in the context of collapsible chair in the so-called quad chair or camping chair configuration. The chair assembly here has a backrest 414 comprising a bottom 422, a top 424 opposite the bottom, a front side, and a back side opposite the front side. The backrest includes a material 460 that allows airflow to pass therethrough. There is a fan assembly 418 attached to the chair assembly at the bottom 422 of the backrest 414. An airflow guide 420 is attached to the back side of the backrest into which airflow from the fan assembly is directed. The airflow guide 420 is associated with the backrest 414 in a manner such that airflow emitted from the fan assembly exits the chair assembly through the backrest. The airflow guide is substantially impermeable to airflow. As can be seen in FIG. 23, a distance between the bottom 422 of the backrest and an opposing portion of a bottom of the airflow guide is greater than a distance between the top 424 of the backrest and an opposing portion of a top of the airflow guide. The airflow guide 420 angles at least generally toward the top of the backrest and angles at least generally away from the bottom of the backrest. As seen in FIG. 24, the fan assembly comprises at least one fan unit which is oriented to blow air through the airflow guide in a direction generally parallel to the backrest. In particular, the fan unit is oriented to blow air through the airflow guide in the direction generally parallel to the backrest and upward toward the top of the backrest.

These same elements and this same chair assembly illustrated in the context of a quad chair in FIGS. 20-29 can be seen in the embodiment of FIGS. 1-5, where the chair assembly has a backrest 14 comprising a bottom 22, a top 24 opposite the bottom, a front side, and a back side opposite the front side. The backrest includes a material that allows airflow to pass therethrough. There is a fan assembly 18 attached to the chair assembly at the bottom 22 of the backrest 14. An airflow guide 20 is attached to the back side of the backrest into which airflow from the fan assembly is directed. The airflow guide 20 is associated with the backrest 14 in a manner such that airflow emitted from the fan assembly exits the chair assembly through the backrest. The airflow guide is substantially impermeable to airflow. As can be seen in FIGS. 2 and 5, for example, a distance between the bottom 22 of the backrest and an opposing portion of a bottom of the airflow guide is greater than a distance between the top 24 of the backrest and an opposing portion of a top of the airflow guide. As seen in FIG. 5, the fan assembly comprises at least one fan unit which is oriented to blow air through the airflow guide in a direction generally parallel to the backrest. In particular, the fan unit is oriented to blow air through the airflow guide in the direction generally parallel to the backrest and upward toward the top of the backrest.

Figure 26:
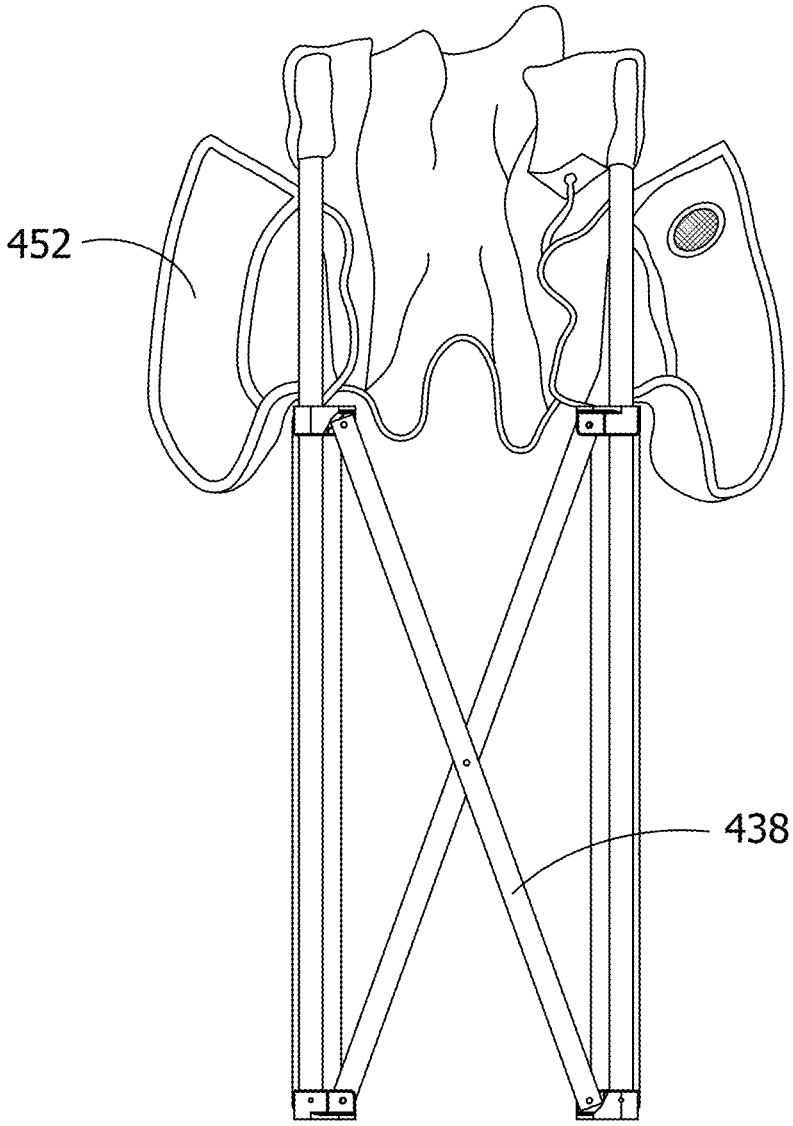
FIG. 26 is a view of the assembly of FIG. 20 in partially collapsed conformation.
Figure 27:
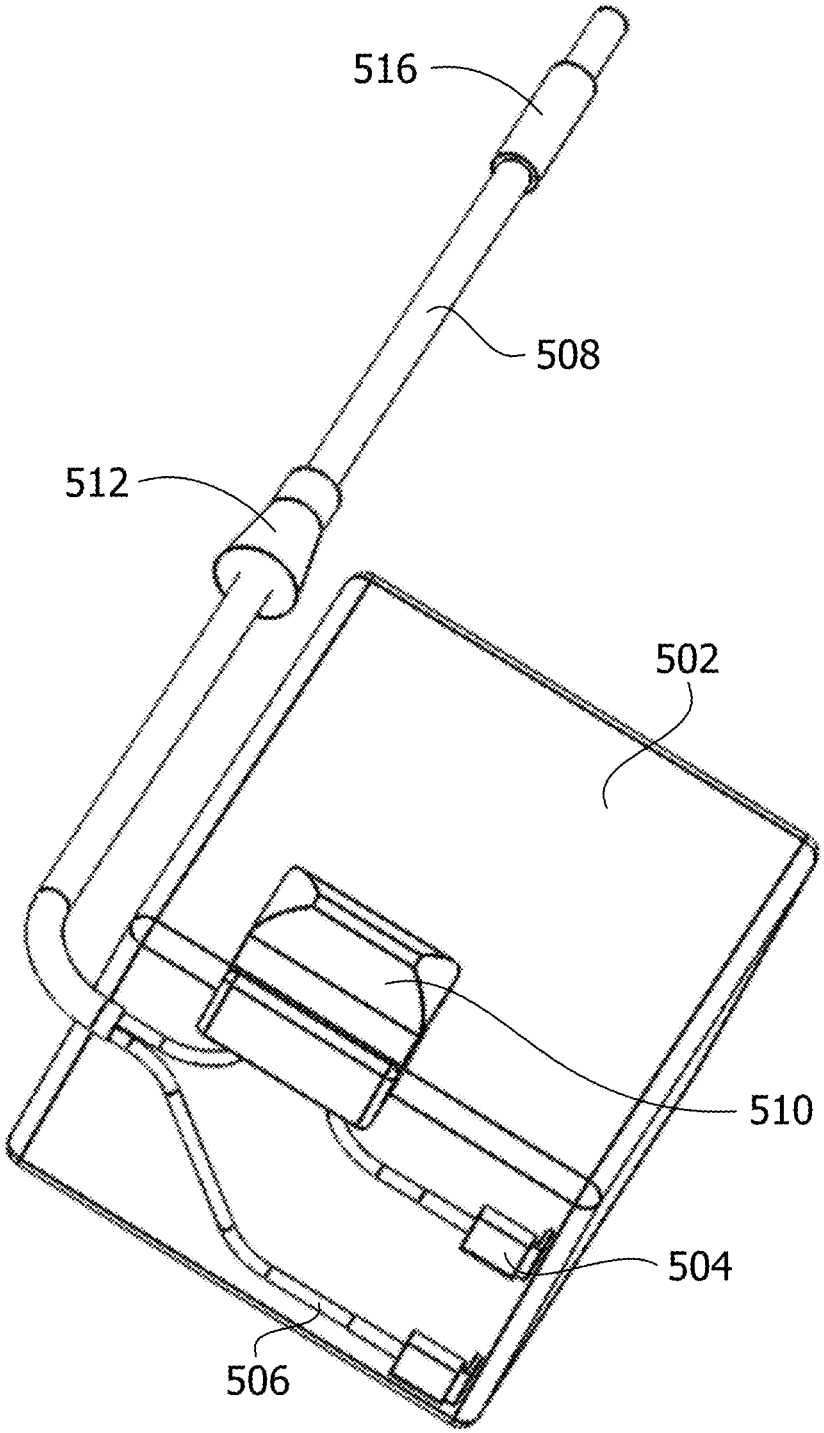
FIG. 27 is a schematic illustration of a power supply for use with the chair assembly.
Figure 28:
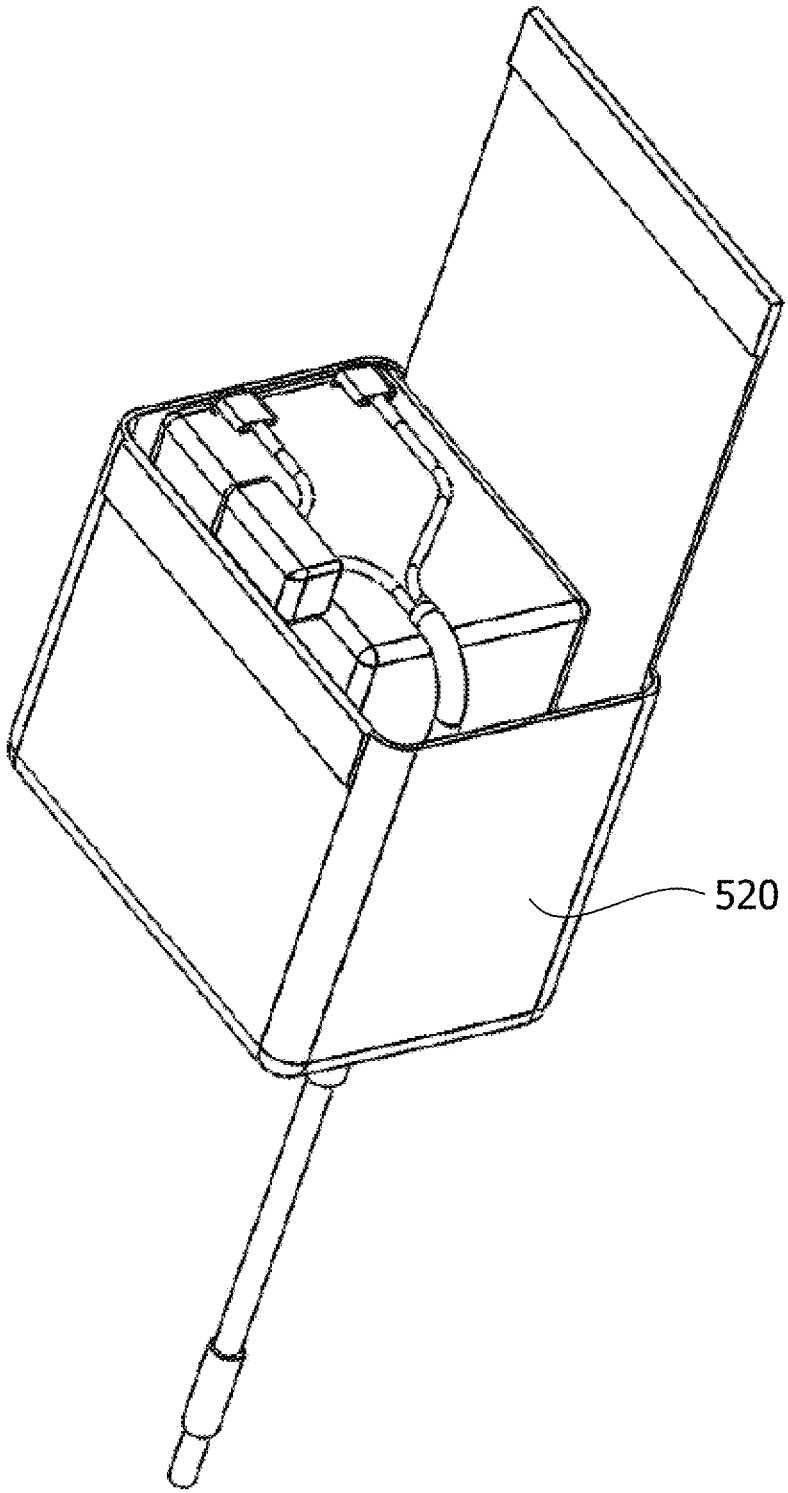
FIG. 28 is a schematic illustration of the power supply of FIG. 27 in a housing.
Figure 29:
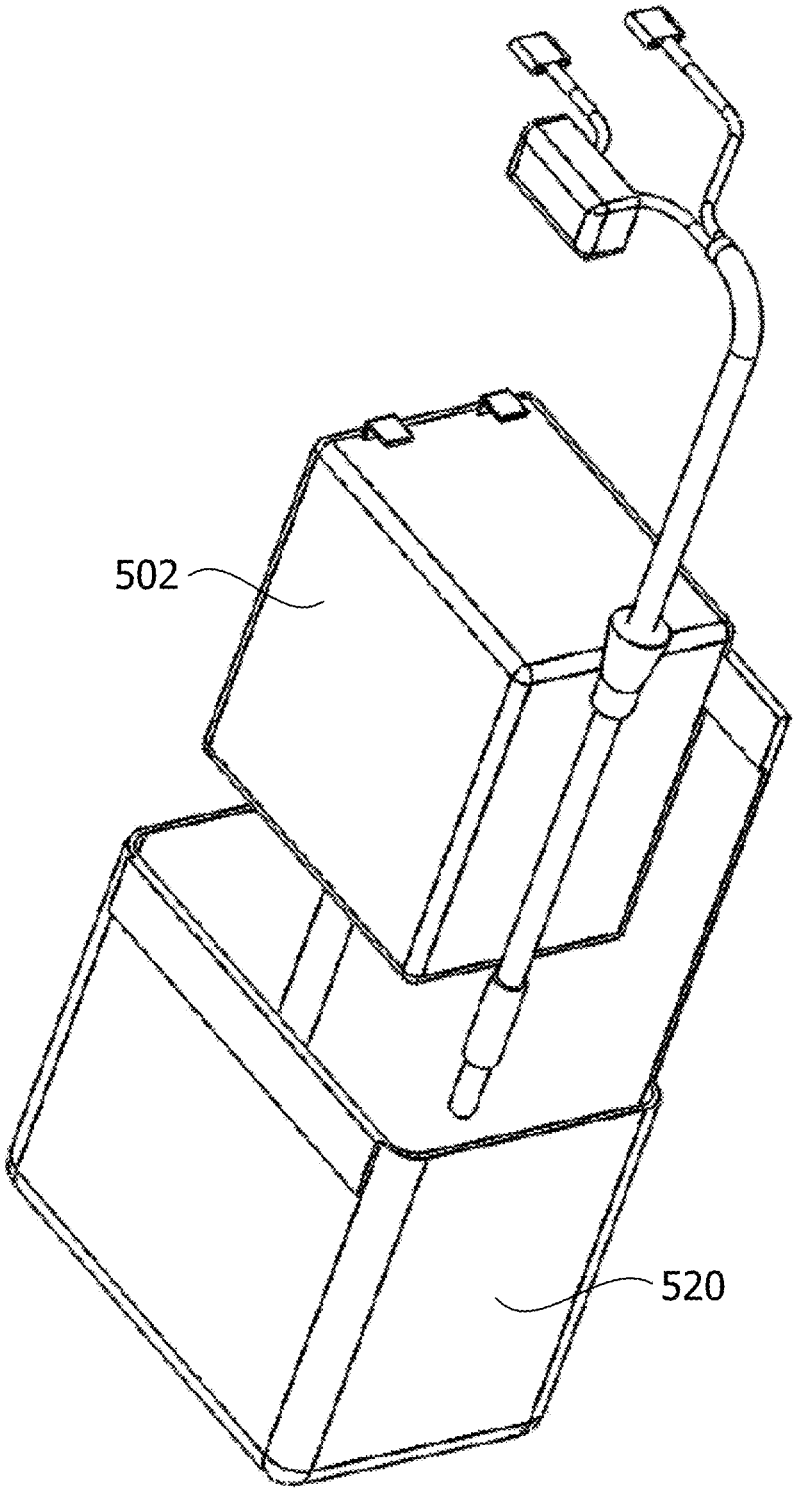
FIG. 29 is an exploded view of the power supply.
Figure 30:
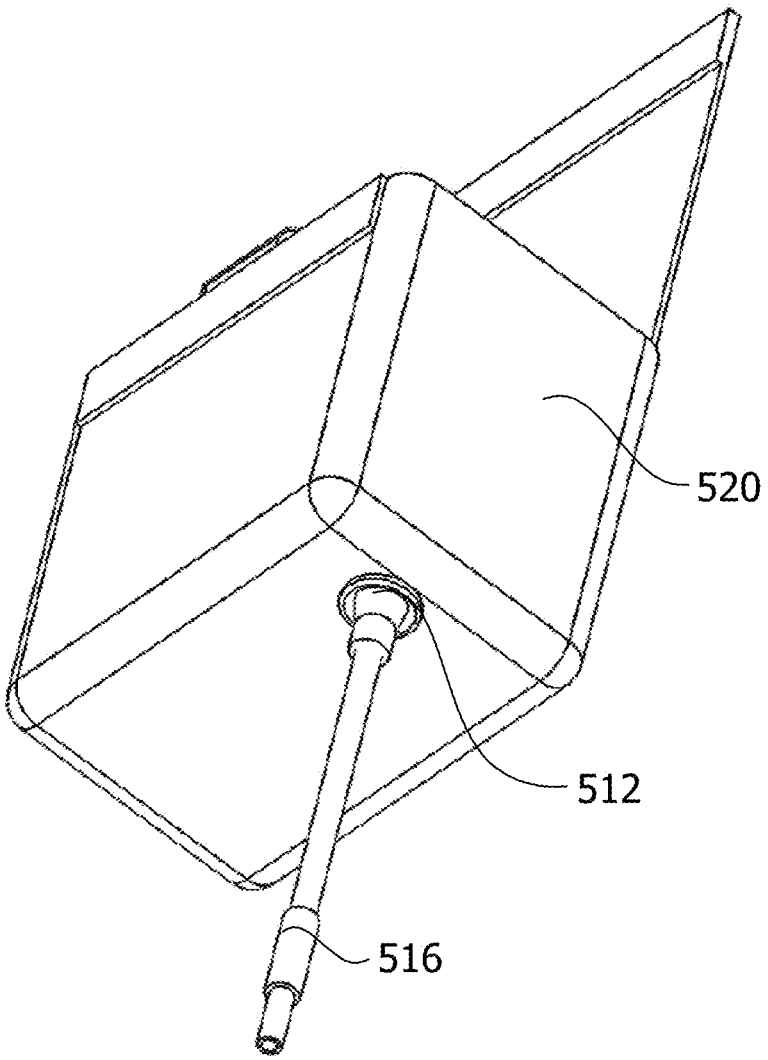
FIG. 30 is a bottom perspective of the power supply.

Returning to the quad chair configuration of FIGS. 20-29, this assembly further has a seat 412 and rigid posts 438 in a quad chair configuration which posts are slidable with respect to each other between a) an open position (FIG. 20) and b) a collapsed position for storage with all rigid posts of the chair in general longitudinal arrangement. FIG. 26 shows the chair assembly in an intermediate position between fully open and fully collapsed. There is a battery pocket 472 which is soft and flexible and has a foldover fabric lid 472. This pocket is designed to hold a battery such as 502 which is part of an overall power supply that also includes fuse 510, leads 506, lead line 508, and fittings 512 and 516 as shown in FIG. 27. In one embodiment, the power supply is adapted to be carried by housing 520 shown in FIGS. 29 and 30.

Figure 20:
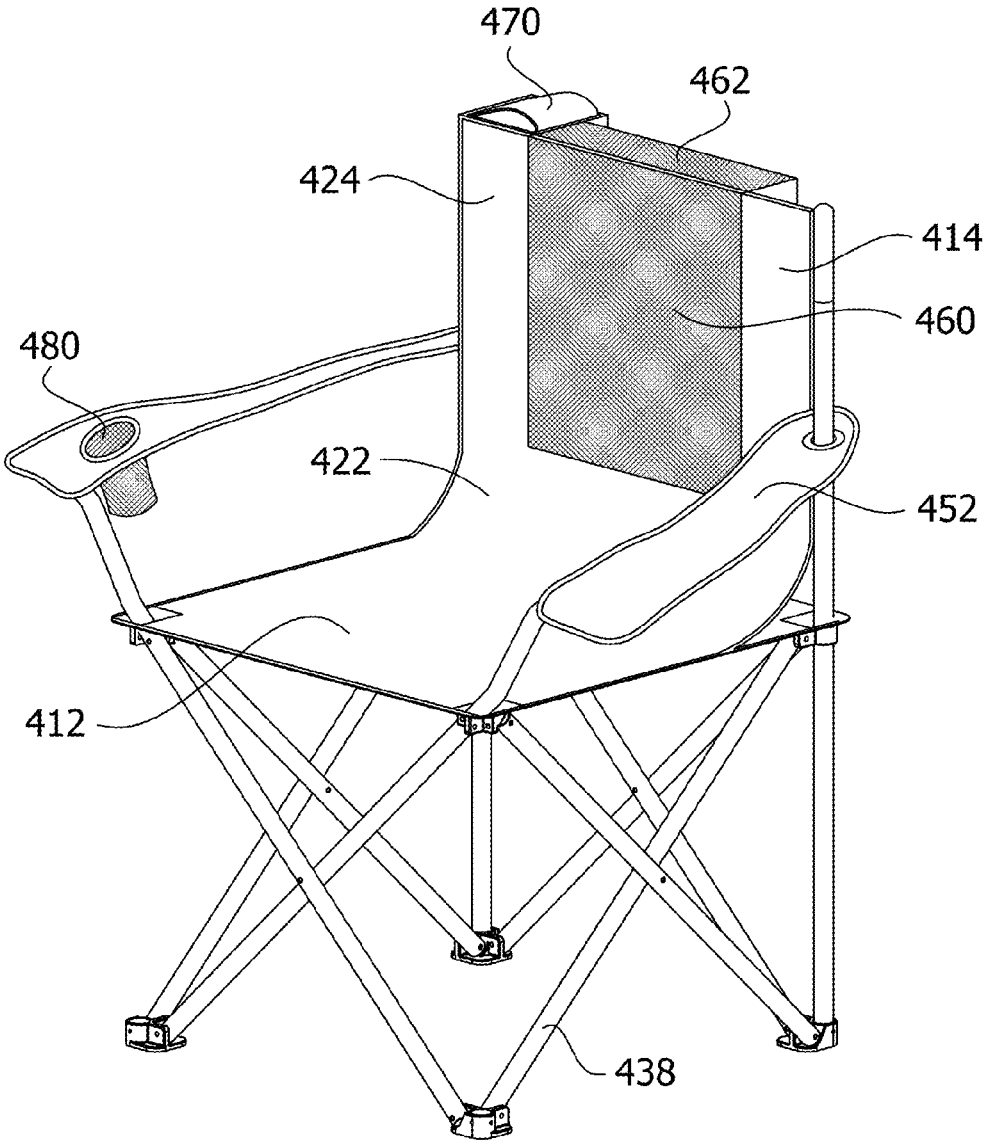
FIG. 20 is a front perspective an alternative chair assembly configuration of the invention having a quad chair configuration.

The chair assembly further includes a cup-holder 480 and armrests 452. As is seen in FIGS. 20-22, at the top of the backrest where the backrest meets the airflow guide, there is a generally flat, upwardly facing ventilation section 462 which is permeable to airflow. The purpose of this section is to provide cooling to the upper shoulders, head and neck of a person sitting in the chair.

Figure 36A:
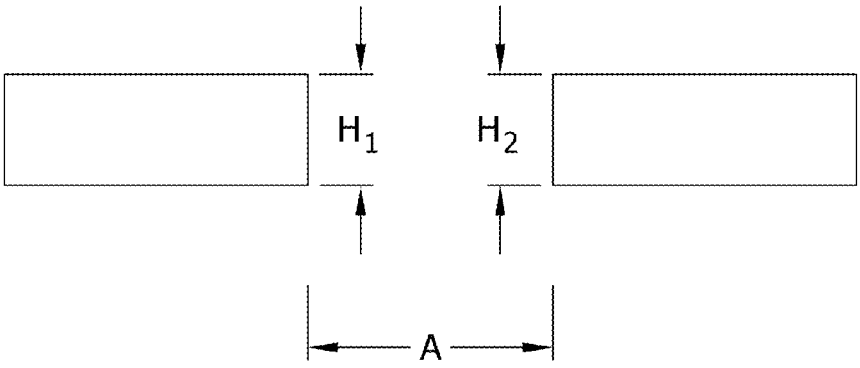
FIGS. 36A, 36B, and 36C are schematic illustrations of the relationship of the fan housings in a quad chair embodiment of the invention as in FIG. 20.
Figure 36B:
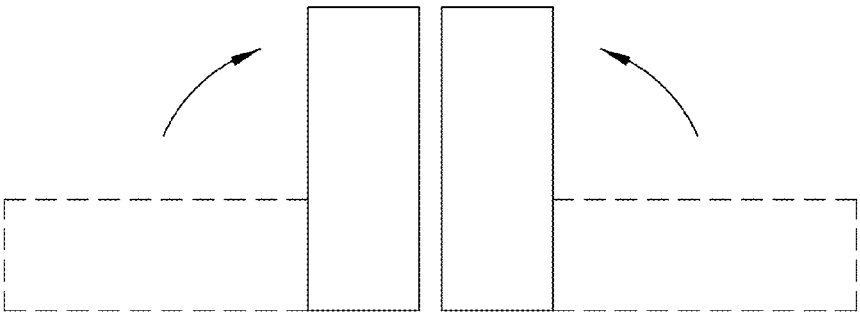
Figure 36C:
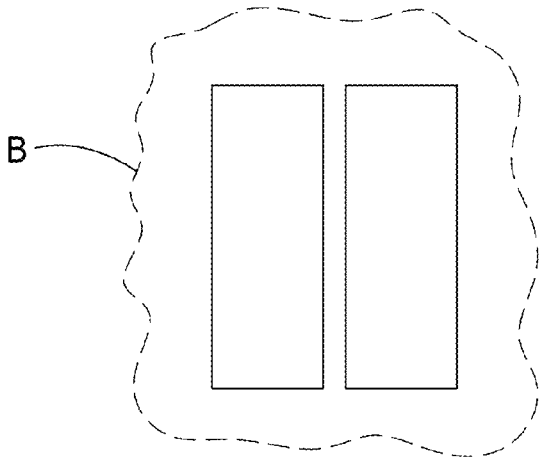
Figure 37:
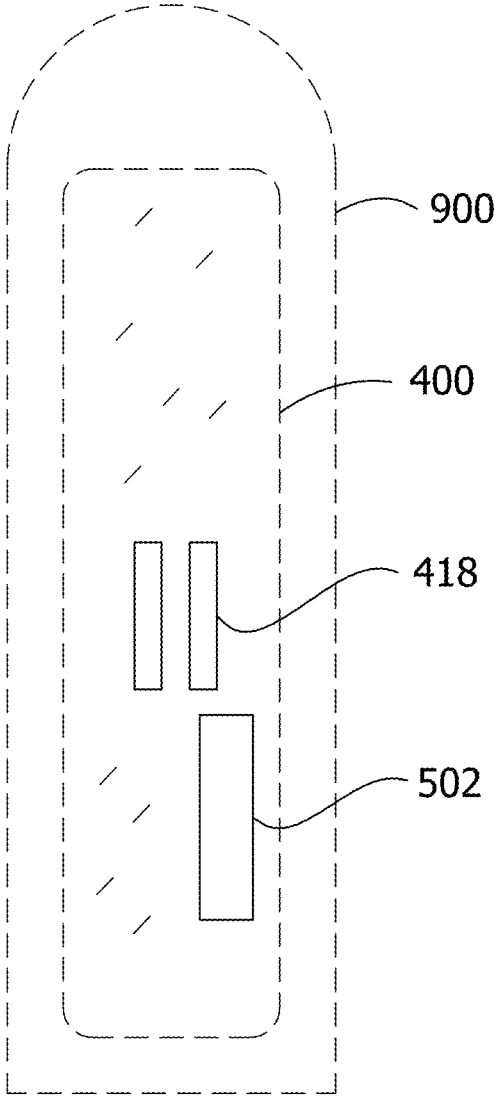
FIG. 37 is a schematic illustration of an embodiment of a quad chair embodiment of the invention collapsed and stored in a chair bag.

The chair assembly in this preferred embodiment has a fan assembly comprising two fan units 418 having fan housings of the same type as housings 54 of the above-described embodiment. When the chair is in the open position in FIG. 25, the two fan housings are side-by-side with an airstream axis of each fan being perpendicular to the seat and generally parallel with the backrest, as illustrated in FIG. 5 in connection with the first-described embodiment. In the collapsed position, the two fan housings are face-to-face with their airstream axes being generally co-axial. These fan units are separated from each other by a distance A shown in FIG. 36A. This distance A is greater than the sum of the heights H1 and H2 of both fans. Because A is greater than H1 plus H2, the fans are free to rotate about 90 degrees as shown in the second view in FIG. 36B and collapse face-to-face against each other when the chair is collapsed and folded up for placement into its storage bag. If the fans were not separated by this distance, they would not collapse up against each other. This is important because it allows the fans to line up generally vertically along the central axis of the entire chair-in-bag assembly when assembled in the storage bag shown in phantom in the third view of FIG. 36C. On the other hand, the distance A is not to be so large that the fans when facing each other in vertical storage alignment are not relatively snug. In one preferred embodiment, therefore, the ratio of the distance A to the sum of the fan heights H1+H2 is at least about 1.05, such as at least about 1.10. In certain preferred embodiments, the ratio is no greater than about 1.7, such as no greater than about 1.5. Certain preferred ranges for ratio of the distance A between the fans to the sum of the fan heights H1+H2 are between about 1.05 and about 1.7, such as between about 1.1 and about 1.5, or between about 1.1 and about 1.3. This arrangement facilitates folding the chair assembly 400, fans 418, and battery pack efficiently within a chair bag 900 as shown in FIG. 37. This figure shows that the chair when collapsed has a generally elongate, vertical alignment to fit within a slender chair bag as shown. The fans are designed to collapse as shown and assume a generally vertical alignment conveniently within the storage bag. The battery bag and battery pack are also designed to assume this vertical alignment in storage.

Figure 38:
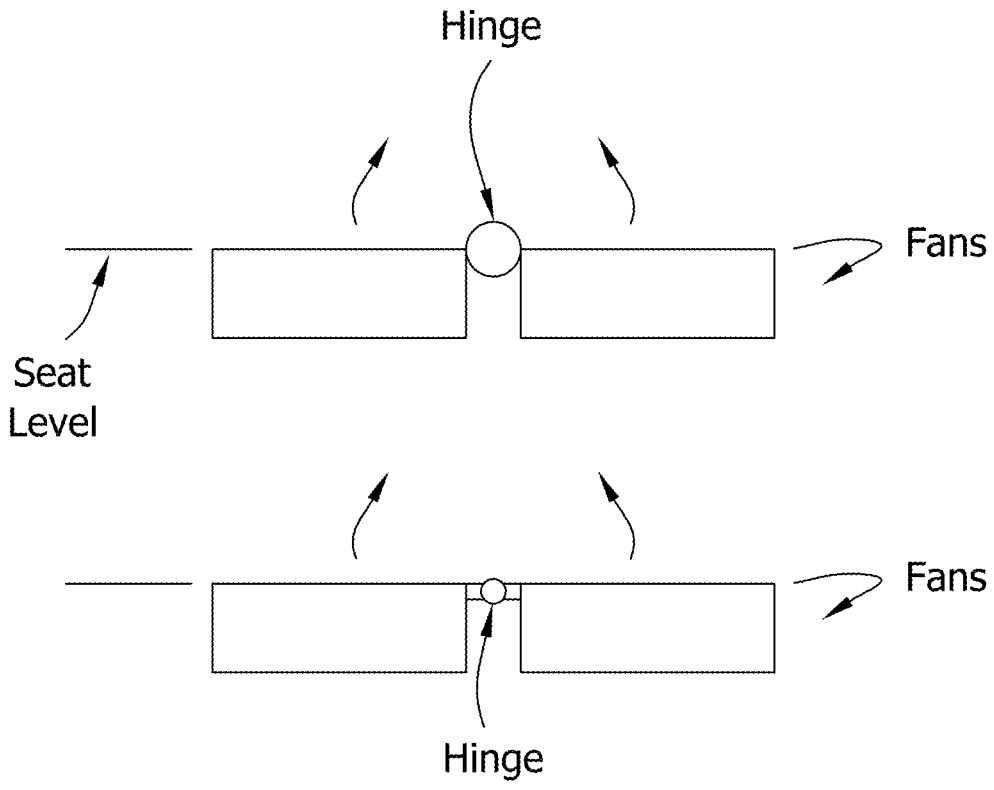
FIG. 38 is a schematic illustration of the relationship of the fan housings in an alternative quad chair embodiment of the invention as in FIG. 20.

The fan assembly may take an alternative configuration. For example, the fan assembly may comprise two fans in hinged relationship as shown in FIG. 38 such that they can be folded up vertically in face-to-face relationship. There may be a hinge in the traditional sense of a piece of metal or plastic hardware joining two fan housings; or it may be a spacing of cloth or reinforced cloth or the like that functions as a hinge, for example.

In these preferred embodiments, the collapsible chair, when in the chair open position, has its two fan housings side-by-side with the airstream axis of each fan being perpendicular to the seat and generally parallel with the backrest. The fan assembly is co-planar with the seat when the chair is in its open position. In the collapsed position of the chair, the two fan housings are face-to-face with their airstream axes being co-axial. In other embodiments of the invention there is only one fan, or three, four, or more fans.

As can be seen in FIGS. 23 and 24 the portion of the chair which extends off the back of the chair and includes the air guide and the fans are elevated such that the bottom of this segment is in a plane above the plane of the seat. The fans are in a plane which is generally parallel to the plane of the seat, and is elevated by at least about 0.5 inches, or at least about 1 inch, above the plane of the seat. The fans are in a plane, preferably, which is elevated above the plane of the seat, but by less than about 6 inches, such as less than about 5, 4, 3, or 2 inches. With this feature, there is less stress on the fans, as the movement of the seat when a person sits in the chair, moves in the chair, and gets out of the chair does not directly move the fans. The fans are therefore stabilized in a flexible house section above the seat. Accordingly, in one embodiment, the fan assembly is in a plane elevated with respect to the seat when the chair is in its open position. Alternatively, the fan assembly may be co-planar with the seat when the chair is in its open position.

These fans in a preferred embodiment have a height (H1 and H2) between about 0.5 inches and about 3 inches, and are between about 1.5 inches and about 6.5 inches apart (A). In one preferred embodiment, the fans are about 1 inch tall, about 3.5 by 3.5 inches square, and are about 4.5 inches apart. This provides plenty of space A for the fans to fold up as shown in FIG. 36 when the chair is collapsed, without the fans interfering with each other. The fans are optionally fitted with LED lights or other decorative lights which illuminate the back portion of the chair. For example, there may be four lights on each fan, each attached to a corner of a fan and pointing upwardly.

Figure 31:
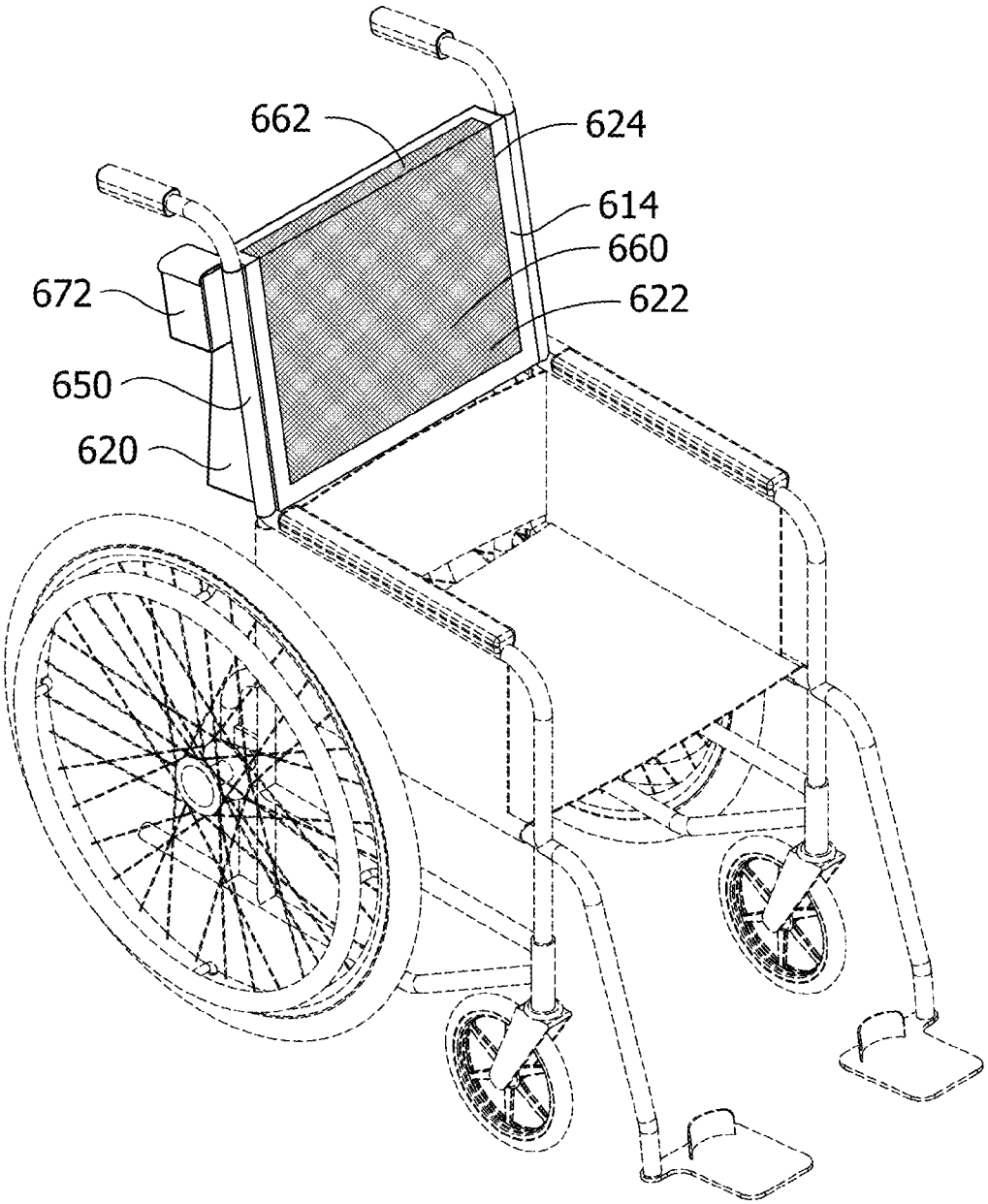
FIG. 31 is a front perspective view of the chair assembly of the invention in its alternative conformation where it is adapted for connection to a wheel chair or is a wheel chair.
Figure 32:
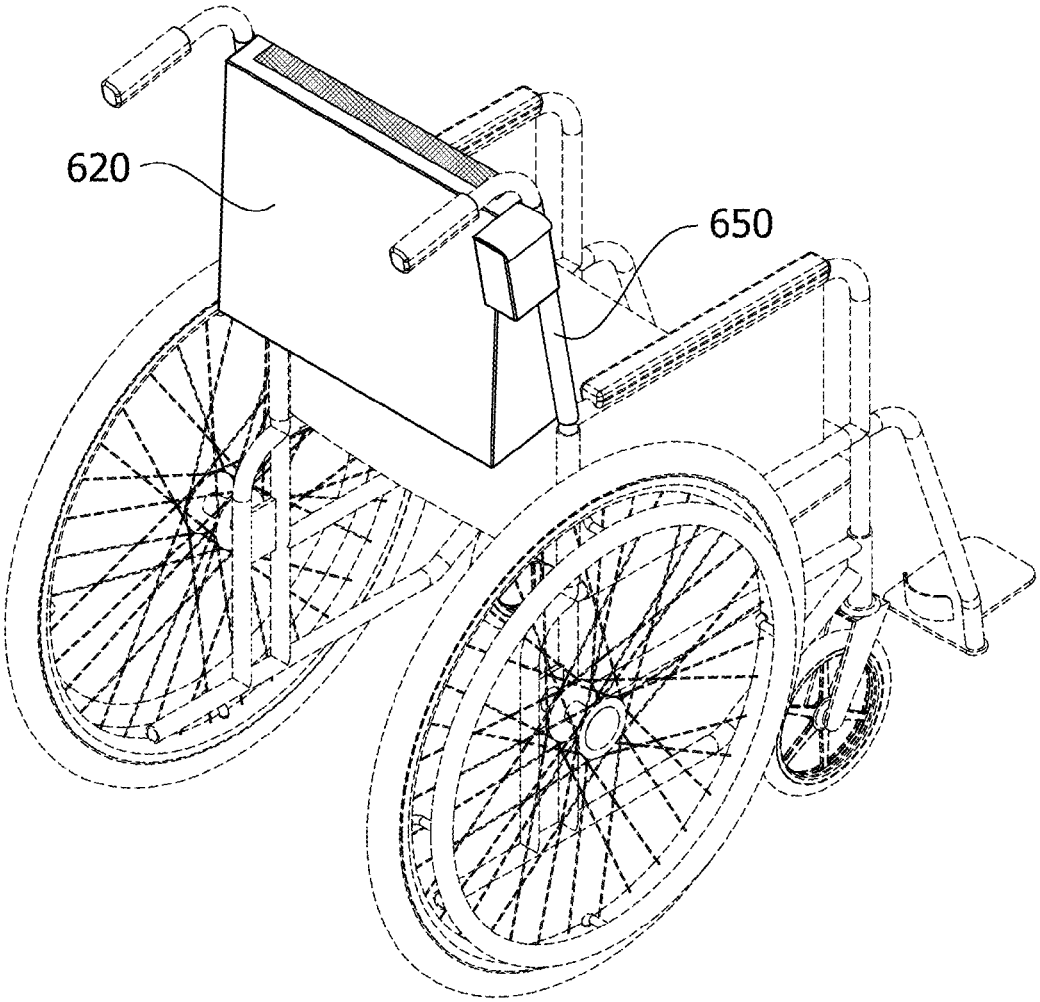
FIG. 32 is a rear perspective view of the chair assembly of the invention in its alternative conformation where it is adapted for connection to a wheel chair or is a wheel chair.

A further embodiment of the chair assembly is shown in FIGS. 31 and 32 wherein the assembly is a wheel chair or is an assembly adapted to attach to a back of a wheelchair. This embodiment includes all the same elements as described above in connection with the embodiment of FIGS. 1-5. That is, the chair assembly of FIGS. 31 and 32 has a backrest 614 comprising a bottom 622, a top 624 opposite the bottom, a front side, and a back side opposite the front side. The backrest includes a material 660 that allows airflow to pass therethrough. There is a fan assembly attached to the chair assembly at the bottom 622 of the backrest 614 just as in FIGS. 20-25. An airflow guide 620 is attached to the back side of the backrest into which airflow from the fan assembly is directed. The airflow guide 620 is associated with the backrest 614 in a manner such that airflow emitted from the fan assembly exits the chair assembly through the backrest. The airflow guide is substantially impermeable to airflow. As can be seen in FIG. 32, for example, a distance between the bottom of the backrest and an opposing portion of a bottom of the airflow guide is greater than a distance between the top of the backrest and an opposing portion of a top of the airflow guide. The airflow guide 620 angles at least generally toward the top of the backrest and angles at least generally away from the bottom of the backrest. The fan assembly in this wheel chair version is not illustrated in detail because like the assembly in FIGS. 5 and 24, it comprises at least one fan unit which is oriented to blow air through the airflow guide in a direction generally parallel to the backrest. In particular, the fan unit is oriented to blow air through the airflow guide in the direction generally parallel to the backrest and upward toward the top of the backrest, as indicated by the arrow in FIG. 24. At the top of the backrest in FIGS. 31 and 32 where the backrest meets the airflow guide, there is a generally flat, upwardly facing ventilation section 662 which is permeable to airflow. The purpose of this section is to provide cooling to the upper shoulders, head and neck of a person sitting in the chair.

FIGS. 31 and 32 show there is a first sleeve 650 along a right side of the backrest and a second sleeve along a left side of the backrest for attaching the backrest to frame members of a wheelchair.

Figure 33:
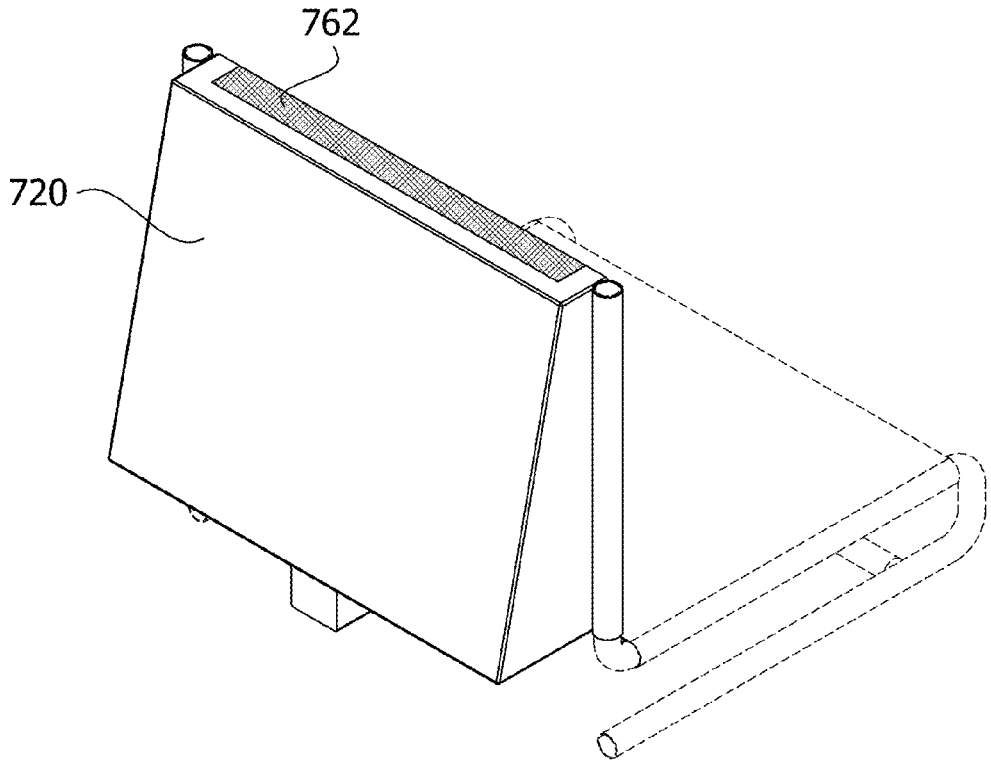
FIG. 33 is a rear perspective view of the chair assembly of the invention in its alternative conformation where it is a stadium chair.
Figure 34:
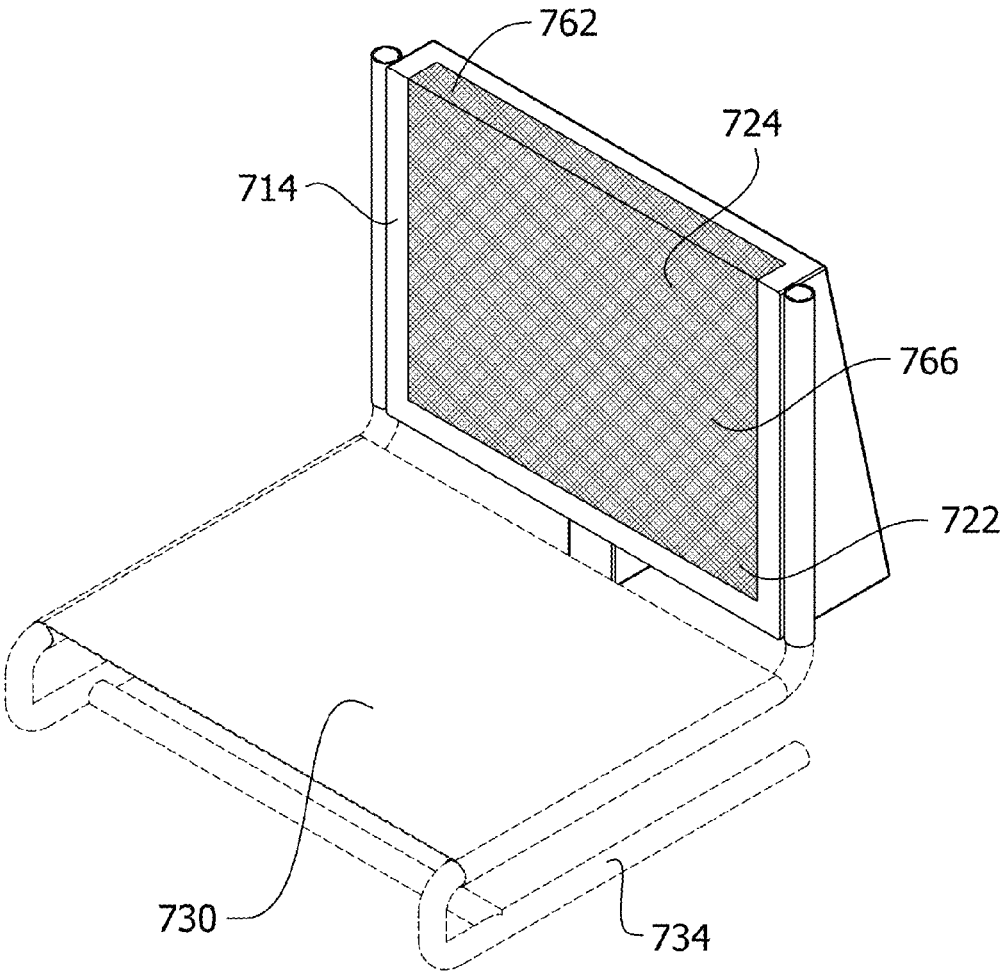
FIG. 34 is a front perspective view of the chair assembly of the invention in its alternative conformation where it is a stadium chair.
Figure 35:
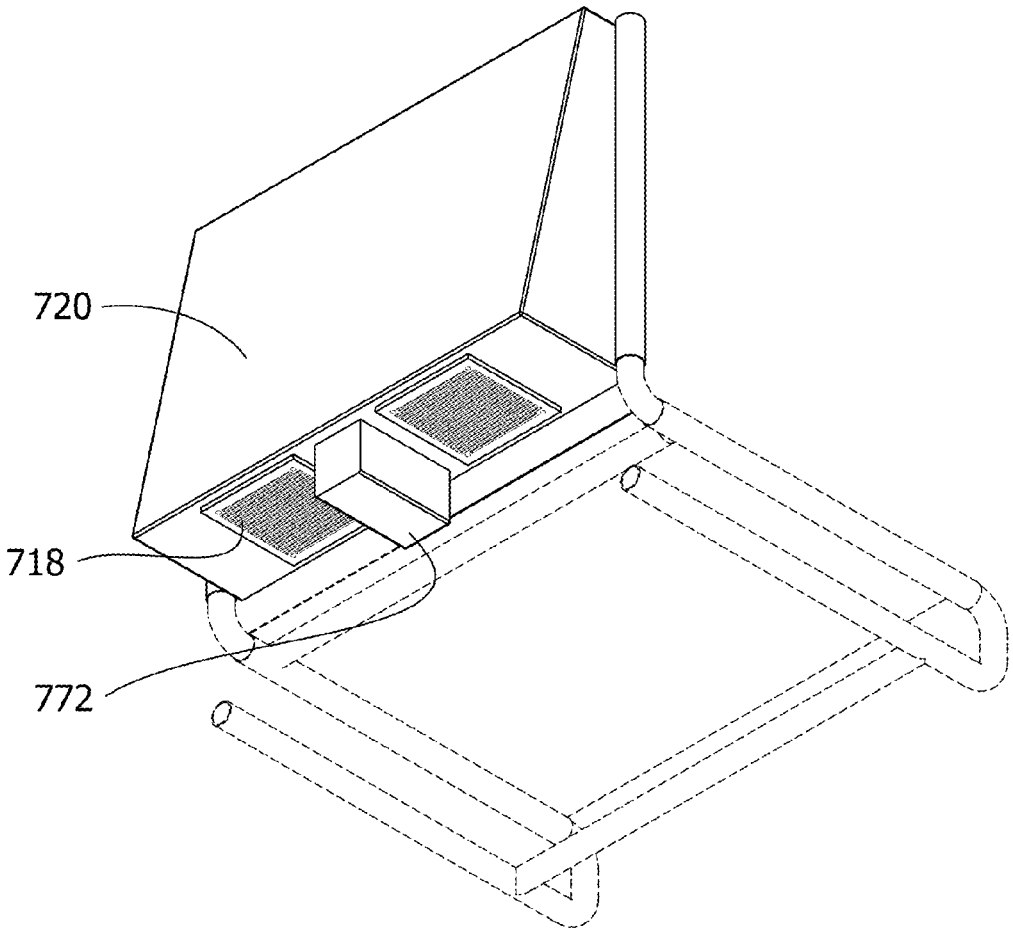
FIG. 35 is a front perspective view of the chair assembly of the invention in its alternative conformation where it is a stadium chair.

FIGS. 33-35 illustrate an embodiment where the chair assembly has a stadium chair configuration. As with the embodiments of FIGS. 5, 20, and 31, the chair assembly has a backrest 714 comprising a bottom 722, a top 724 opposite the bottom, a front side, and a back side opposite the front side. The backrest includes a material 766 that allows airflow to pass therethrough. There is a fan assembly 718 attached to the chair assembly at the bottom 722 of the backrest 714. An airflow guide 720 is attached to the back side of the backrest into which airflow from the fan assembly is directed. The airflow guide 720 is associated with the backrest 714 in a manner such that airflow emitted from the fan assembly exits the chair assembly through the backrest. The airflow guide is substantially impermeable to airflow. As can be seen in FIGS. 34-35, a distance between the bottom 722 of the backrest and an opposing portion of a bottom of the airflow guide is greater than a distance between the top 724 of the backrest and an opposing portion of a top of the airflow guide. The airflow guide 720 angles at least generally toward the top of the backrest and angles at least generally away from the bottom of the backrest. As seen in FIG. 35, the fan assembly comprises at least one fan unit which is oriented to blow air through the airflow guide in a direction generally parallel to the backrest. In particular, the fan unit is oriented to blow air through the airflow guide in the direction generally parallel to the backrest and upward toward the top of the backrest. This chair assembly further comprises a seat 730 and a rigid frame including an open hook 734 for securing the chair assembly to a bleacher seat. At the top of the backrest in FIGS. 33 and 34 where the backrest meets the airflow guide, there is a generally flat, upwardly facing ventilation section 762 which is permeable to airflow. The purpose of this section is to provide cooling to the upper shoulders, head and neck of a person sitting in the chair.

When introducing elements of the present invention (e.g., illustrated embodiments(s) thereof), the articles "a", "an", "the" and "said" are intended to mean that there are one or more of the elements. Accordingly, any feature that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a chair assembly includes "a fan assembly" by itself does not mean that the chair assembly includes only a single fan assembly). Moreover, any failure to use phrases such as "at least one" also does not limit the corresponding feature to the singular (e.g., indicating that a chair assembly includes "a fan assembly" alone does not mean that the chair assembly includes only a single fan assembly). Finally, use of the phrase "at least generally" or the like in relation to a particular feature encompasses the corresponding characteristic and insubstantial variations thereof (e.g., indicating that an air flow chamber is at least generally tapered encompasses the air flow chamber being tapered as well as insubstantial variations thereof). The terms "comprising," "including," "having," and variations thereof are intended to be inclusive and mean that there may be additional elements other than the listed elements. Further, all numerical ranges disclosed herein are intended to be inclusive. For example, a range of "between 40 dBA and 65 dBA" or "40-65 dBA" is meant to include 40 dBA, 65 dBA, and all values in between.

The foregoing has been presented for purposes of illustration and description, and is not intended to limit the invention to the form disclosed herein. Consequently, variations and modifications commensurate with the above teachings, and skill and knowledge of the relevant art, are within the scope of the present invention. The embodiments described hereinabove are intended to enable others skilled in the art to understand the invention in such or other embodiments and with various modifications required by the particular application(s) or use(s) of the present invention. It is intended that the appended claims be construed to include alternative embodiments to the extent permitted by the prior art.

The invention claimed is:

1. A chair assembly comprising:

a backrest comprising a bottom, a top opposite the bottom, a front side, and a back side opposite the front side, wherein the backrest includes a material that allows airflow to pass therethrough;

a fan assembly attached to the chair assembly at the bottom of the backrest;

an airflow guide attached to the back side of the backrest into which airflow from the fan assembly is directed, wherein the airflow guide is associated with the backrest in a manner such that airflow emitted from the fan assembly exits the chair assembly through the backrest, wherein the airflow guide is substantially impermeable to airflow, and wherein a distance between the bottom of the backrest and an opposing portion of a bottom of the airflow guide is greater than a distance between the top of the backrest and an opposing portion of a top of the airflow guide;

wherein the fan assembly comprises at least one fan unit, and wherein said at least one fan unit is oriented to blow air through the airflow guide in a direction generally parallel to the backrest.

2. The chair assembly of claim 1 wherein said at least one fan unit is oriented to blow air through the airflow guide in the direction generally parallel to the backrest and upward toward the top of the backrest.

3. The chair assembly of claim 2 further comprising a seat and rigid posts in a quad chair configuration which posts are slidable with respect to each other between a) an open position and b) a collapsed position for storage with all rigid posts of the chair in general longitudinal arrangement.

4. The chair assembly of claim 3, wherein the fan assembly is co-planar with the seat when the chair is in its open position.

5. The chair assembly of claim 3 wherein the fan assembly is in a plane elevated with respect to the seat when the chair is in its open position.

6. The chair assembly of claim 3 further comprising an upwardly facing ventilation section which is permeable to airflow at the top of the backrest between the and the airflow guide to provide cooling to the upper shoulders, head and neck of a person using the chair assembly.

7. The chair assembly of claim 3 wherein the fan assembly comprises two fan units having fan housings, wherein in the chair open position, the two fan housings are side-by-side with an airstream axis of each fan being perpendicular to the seat and generally parallel with the backrest; and in the collapsed position, the two fan housings are face-to-face with their airstream axes being generally co-axial.

8. The chair assembly of claim 2 wherein the assembly is adapted to attach to a back of a wheelchair.

9. The chair assembly of claim 2 wherein the assembly comprises a first sleeve along a right side of the backrest and a second sleeve along a left side of the backrest for attaching the backrest to frame members of a wheelchair.

10. The chair assembly of claim 2 wherein the chair assembly further comprises a seat and a rigid frame including an open hook for securing the chair assembly to a bleacher seat.

11. The chair assembly of claim 2 further comprising a collapsible frame.

12. The chair assembly of claim 2 further comprising an upwardly facing ventilation section which is permeable to airflow at the top of the backrest between the and the airflow guide to provide cooling to the upper shoulders, head and neck of a person using the chair assembly.

13. The chair assembly of claim 1 further comprising a seat and rigid posts in a quad chair configuration which posts are slidable with respect to each other between a) an open position and b) a collapsed position for storage with all rigid posts of the chair in general longitudinal arrangement.

14. The chair assembly of claim 1 wherein the assembly is adapted to attach to a back of a wheelchair.

15. The chair assembly of claim 14 further comprising an upwardly facing ventilation section which is permeable to airflow at the top of the backrest between the and the airflow guide to provide cooling to the upper shoulders, head and neck of a person using the chair assembly.

16. The chair assembly of claim 1 wherein the assembly comprises a first sleeve along a right side of the backrest and a second sleeve along a left side of the backrest for attaching the backrest to frame members of a wheelchair.

17. The chair assembly of claim 1 wherein the chair assembly further comprises a seat and a rigid frame including an open hook for securing the chair assembly to a bleacher seat.

18. The chair assembly of claim 17 further comprising an upwardly facing ventilation section which is permeable to airflow at the top of the backrest between the and the airflow guide to provide cooling to the upper shoulders, head and neck of a person using the chair assembly.

19. A chair assembly comprising:

a backrest comprising a bottom, a top opposite the bottom, a front side, and a back side opposite the front side, wherein the backrest includes a material that allows airflow to pass therethrough;

a fan assembly attached to the chair assembly at the bottom of the backrest;

an airflow guide attached to the back side of the backrest into which airflow from the fan assembly is directed, wherein the airflow guide is associated with the backrest in a manner such that airflow emitted from the fan assembly exits the chair assembly through the backrest, wherein the airflow guide is substantially impermeable to airflow, and wherein the airflow guide angles at least generally toward the top of the backrest and angles at least generally away from the bottom of the backrest;

wherein the fan assembly comprises at least one fan unit, and wherein said at least one fan unit is oriented to blow air through the airflow guide in a direction generally parallel to the backrest.

20. The chair assembly of claim 19 wherein said at least one fan unit is oriented to blow air through the airflow guide in the direction generally parallel to the backrest and upward toward the top of the backrest.

21. A chair assembly comprising:

a backrest comprising a bottom, a top opposite the bottom, a front side, and a back side opposite the front side, wherein the backrest includes a material that allows airflow to pass therethrough;

a fan assembly attached to the chair assembly at the bottom of the backrest;

an airflow guide attached to the back side of the backrest into which airflow from the fan assembly is directed, wherein the airflow guide is associated with the backrest in a manner such that airflow emitted from the fan assembly exits the chair assembly through the backrest, wherein the airflow guide is substantially impermeable to airflow;

wherein the airflow guide further comprises an upwardly facing ventilation section which is permeable to airflow and positioned at the top of the backrest;

wherein the fan assembly comprises at least one fan unit, and wherein said at least one fan unit is oriented to blow air through the airflow guide in a direction generally parallel to the backrest.

22. The chair assembly of claim 21 wherein the upwardly facing ventilation section is adapted to provide cooling to upper shoulders, head and neck of a person seated in the chair assembly.

23. A chair assembly comprising:

a backrest comprising a bottom, a top opposite the bottom, a front side, and a back side opposite the front side, wherein the backrest includes a material that allows airflow to pass therethrough;

a fan assembly attached to the chair assembly at the bottom of the backrest;

an airflow guide attached to the back side of the backrest into which airflow from the fan assembly is directed, wherein the airflow guide is associated with the backrest in a manner such that airflow emitted from the fan assembly exits the chair assembly through the backrest, wherein the airflow guide is substantially impermeable to airflow;

wherein the chair assembly is movable between a collapsed position and a chair open position;

wherein the fan assembly comprises two fan units having fan housings, wherein in the chair open position, the two fan housings are side-by-side with an airstream axis of each fan being perpendicular to the seat and generally parallel with the backrest; and in the collapsed position, the two fan housings are face-to-face.

24. The chair assembly of claim 23, wherein the chair assembly further comprises a seat and the fan assembly is co-planar with the seat when the chair assembly is in its open position.

25. The chair assembly of claim 23 wherein the chair assembly further comprises a seat and the fan assembly is in a plane elevated with respect to the seat when the chair assembly is in its open position.

26. The chair assembly of claim 23 wherein the two fan housings are oriented to blow air through the airflow guide in a direction generally parallel to the backrest when the chair assembly is in its open position.

* * * * *